US008584436B2

(12) United States Patent
Griggs et al.

(10) Patent No.: US 8,584,436 B2
(45) Date of Patent: Nov. 19, 2013

(54) AUTOMATED CLIPPING PACKAGING APPARATUS AND ASSOCIATED DEVICES, METHODS, SYSTEMS AND COMPUTER PROGRAM PRODUCTS

(75) Inventors: Samuel D. Griggs, Raleigh, NC (US); Dennis J. May, Pittsboro, NC (US); David T. Wince, Fuquay-Varina, NC (US); William M. Poteat, Fuquay-Varina, NC (US); Derek L. Brown, Apex, NC (US)

(73) Assignee: Tipper Tie, Inc., Apex, NC (US)

( * ) Notice: Subject to any disclaimer, the term of this patent is extended or adjusted under 35 U.S.C. 154(b) by 2253 days.

(21) Appl. No.: 11/151,669

(22) Filed: Jun. 13, 2005

(65) Prior Publication Data

US 2005/0229541 A1 Oct. 20, 2005

Related U.S. Application Data

(60) Provisional application No. 60/579,709, filed on Jun. 15, 2004.

(51) Int. Cl.
*B65B 51/00* (2006.01)
*B65B 51/09* (2006.01)

(52) U.S. Cl.
USPC ..... 53/417; 53/138.4; 29/243.56

(58) Field of Classification Search
USPC ..... 53/138.4, 413, 417, 567, 138.1–4, 578, 53/134.1; 29/243.56–57; 452/30, 35, 37, 452/58
See application file for complete search history.

(56) References Cited

U.S. PATENT DOCUMENTS

| | | | | |
|---|---|---|---|---|
| 2,720,055 | A | 10/1955 | Morris | |
| 2,880,419 | A | 4/1959 | Tipper | |
| 3,342,017 | A | 9/1967 | Yerkey | |
| 3,358,418 | A | 12/1967 | Manetta | |
| 3,383,754 | A | 5/1968 | Klenz | |
| 3,389,533 | A | 6/1968 | Tipper et al. | |
| 3,400,433 | A | 9/1968 | Klenz | |
| 3,499,259 | A | 3/1970 | Tipper et al. | |
| 3,543,378 | A | 12/1970 | Klenz | |
| 3,587,204 | A | 6/1971 | George | 53/138.4 |
| 3,662,514 | A | 5/1972 | Goss | 53/567 |

(Continued)

FOREIGN PATENT DOCUMENTS

| | | | |
|---|---|---|---|
| DE | 2452760 | 5/1976 | |
| EP | 0 301 768 | 2/1989 | B65B 9/15 |

(Continued)

OTHER PUBLICATIONS

U.S. Appl. No. 10/969,717, filed Oct. 20, 2004.

(Continued)

*Primary Examiner* — Alexandra Elve
*Assistant Examiner* — John Paradiso
(74) *Attorney, Agent, or Firm* — Myers Bigel Sibley & Sajovec, P.A.

(57) ABSTRACT

Methods, devices and computer program products automatically or semi-automatically package an object in a covering material such as casing and/or netting by pulling a covering material upstream of a product chute off an exterior surface of the product chute to automatically enclose the object in the covering material as the object exits the product chute, then applying a clip to the covering material to secure the object in the covering material.

46 Claims, 42 Drawing Sheets

(56) References Cited

U.S. PATENT DOCUMENTS

| | | | | |
|---|---|---|---|---|
| 3,719,022 | A | 3/1973 | Cherio | |
| 3,732,662 | A | 5/1973 | Paxton | 53/415 |
| 3,797,199 | A | 3/1974 | Seifert | |
| 3,815,323 | A | 6/1974 | Longo | 53/530 |
| 3,945,171 | A | 3/1976 | Marietta, Jr. et al. | 53/576 |
| D243,158 | S | 1/1977 | Bolwell | D15/145 |
| 4,044,450 | A | 8/1977 | Raudys et al. | |
| 4,091,595 | A | 5/1978 | Peister et al. | 53/417 |
| 4,165,593 | A | 8/1979 | Niedecker | |
| 4,247,005 | A | 1/1981 | Buxton | 53/138.4 |
| 4,430,772 | A | 2/1984 | Michel et al. | |
| 4,505,003 | A | 3/1985 | Becker et al. | 53/576 |
| 4,516,387 | A * | 5/1985 | Kupcikevicius | 452/40 |
| 4,525,898 | A | 7/1985 | Gallion et al. | 24/30.5 W |
| 4,537,006 | A | 8/1985 | Pieri | 53/134 |
| 4,590,748 | A | 5/1986 | Harrison et al. | 53/576 |
| 4,651,498 | A | 3/1987 | Piereder | 53/122 |
| 4,675,945 | A | 6/1987 | Evans et al. | 452/48 |
| 4,683,700 | A | 8/1987 | Evans et al. | 53/138.4 |
| 4,766,713 | A | 8/1988 | Evans | 53/138.2 |
| 4,847,953 | A | 7/1989 | Evans et al. | 452/36 |
| 4,944,172 | A | 7/1990 | Evens | 72/53 |
| 4,969,233 | A | 11/1990 | Stanley | |
| 5,016,424 | A | 5/1991 | Stirling | 53/459 |
| 5,017,175 | A | 5/1991 | Klusmire | |
| 5,024,041 | A | 6/1991 | Urban et al. | 53/449 |
| 5,042,234 | A | 8/1991 | Evans et al. | 53/523 |
| 5,044,144 | A | 9/1991 | Foote et al. | 29/803 |
| 5,067,313 | A | 11/1991 | Evans | 53/576 |
| 5,074,386 | A | 12/1991 | Evans | 188/67 |
| 5,085,036 | A | 2/1992 | Evans et al. | 53/550 |
| 5,107,666 | A | 4/1992 | Rahtican | |
| 5,109,648 | A | 5/1992 | Evans | |
| 5,135,770 | A | 8/1992 | Underwood | 426/271 |
| 5,161,347 | A | 11/1992 | May et al. | 53/138.2 |
| 5,165,216 | A | 11/1992 | May et al. | |
| 5,167,567 | A | 12/1992 | Evans | 452/37 |
| 5,181,302 | A | 1/1993 | Evans | 29/243.56 |
| 5,203,760 | A | 4/1993 | Chen et al. | 493/302 |
| D340,467 | S | 10/1993 | Pollak et al. | D15/150 |
| 5,402,625 | A | 4/1995 | Halstead | 53/570 |
| 5,421,142 | A | 6/1995 | Cullen | |
| 5,426,910 | A * | 6/1995 | Cullen | 53/128.1 |
| 5,476,673 | A | 12/1995 | Sombrio | |
| 5,495,701 | A | 3/1996 | Poteat et al. | 53/138.2 |
| 5,570,561 | A | 11/1996 | May et al. | 53/138.4 |
| 5,586,424 | A | 12/1996 | Chen et al. | 53/138.2 |
| 5,715,656 | A | 2/1998 | Pearce | |
| 5,884,346 | A | 3/1999 | Hengl | |
| 6,052,972 | A | 4/2000 | Rea et al. | 53/576 |
| 6,131,367 | A | 10/2000 | Fukuda et al. | |
| 6,401,885 | B1 | 6/2002 | Whittlesey | 188/322.16 |
| 6,604,338 | B1 | 8/2003 | May et al. | 53/138.2 |
| 6,634,400 | B2 * | 10/2003 | Barbosa | 156/384 |
| 6,637,075 | B1 | 10/2003 | Gorman et al. | 24/30.5 W |
| 6,694,711 | B1 | 2/2004 | Cullen | 53/567 |
| 6,695,364 | B2 | 2/2004 | Bierlin | 292/307 |
| 6,708,742 | B2 | 3/2004 | Weathers et al. | |
| 6,719,194 | B2 | 4/2004 | Richards | |
| 6,729,102 | B2 * | 5/2004 | Ailey et al. | 53/134.1 |
| 6,745,547 | B2 | 6/2004 | Bussey et al. | 53/576 |
| 6,883,297 | B2 | 4/2005 | Kirk et al. | 53/502 |
| 6,932,688 | B2 * | 8/2005 | Stanley et al. | 452/48 |
| 6,976,346 | B2 | 12/2005 | May et al. | |
| 2003/0131564 | A1 | 7/2003 | Ailey, Jr. et al. | |
| 2004/0250512 | A1 | 12/2004 | May et al. | |
| 2005/0034426 | A1 | 2/2005 | Griggs | |
| 2005/0039419 | A1 | 2/2005 | Griggs et al. | |
| 2005/0053699 | A1 | 3/2005 | Whittlesey | |
| 2005/0072119 | A1 | 4/2005 | Griggs et al. | |
| 2005/0087075 | A1 | 4/2005 | Mysker | |
| 2005/0101240 | A1 | 5/2005 | Mysker | |
| 2005/0235608 | A1 | 10/2005 | Griggs et al. | |
| 2005/0247026 | A1 | 11/2005 | Griggs | |
| 2005/0274088 | A1 | 12/2005 | Griggs | |
| 2005/0284108 | A1 | 12/2005 | Griggs | |

FOREIGN PATENT DOCUMENTS

| | | | | |
|---|---|---|---|---|
| GB | 1491444 | 11/1977 | | |
| GB | 1564397 | 4/1980 | | |
| GB | 2403198 | * 12/2004 | | 53/138.1 |
| JP | 2002-019735 | 1/2002 | | |
| WO | WO 00/20282 | 4/2000 | | B65B 51/04 |
| WO | WO 2004/007298 | 1/2004 | | |
| WO | WO 2004/007298 | A2 | 1/2004 | |
| WO | WO 2004/007298 | A3 | 1/2004 | |
| WO | WO 2005/044020 | 5/2005 | | |

OTHER PUBLICATIONS

U.S. Appl. No. 11/256,809, filed Oct. 24, 2005, Gupton.

U.S. Appl. No. 11/262,600, filed Oct. 31, 2005, Wince.

U.S. Appl. No. 60/579,709, Poteat et al.

Brochure *TCM 2250 Pumpable for muscle pieces*, 2 sheets, 1994©.

International Search Report and Written Opinion of the International Searching Authority for PCT application PCT/US2005/020006 dated Oct. 25, 2005.

International Search Report and Written Opinion of the International Searching Authority for International Patent Application No. PCT/US2005/017252 mailed on Sep. 7, 2005.

Product Brochure, 1 sheet, "Tipper Clipper ®-Signature Series SZ3214 Double Clipper for Netting," © 2002.

Product Brochure, 1 sheet, "Tipper Netter TN-3000 Automatic Netting-Packaging Machine," © 2002.

Product Brochure, 1 sheet, "Tipper Tie-Net, Safely and quickly package plugs before shipping," © 1999.

Product Brochure, 2 sheets, "Net-All Sleeved Plastic Netting System," © 2000.

Product Brochure, 2 sheets, "Tipper Net Z3200 Double Clipper and Plant Netting System," © 2000.

Product Brochure, 4 sheets, "Net-All® Netting Is the answer To All Your Horticultural Applications," © 2001.

Product Brochure, 6 sheets, "Tipper Net for Smoking, Hanging & Decoration, Net-All® Netting Is the Answer," © 2000.

Rigidized Metals Corporation, Corporate Profile, 1 page , <http://www.rigidized.com> accessed on Sep. 23, 2005, but for the purposes of examination, the reference is deemed to be before the priority filed of the instant application.

www.mcmaster.com, Compressed Air Flow Control Valves, 1 sheet, Date unknown but believed to be before Oct. 2004.

www.tippertie.com/smoked/tcm2250.asp, 2 sheets, date believed to be before Nov. 1, 2004.

International Search Report and Written Opinion of the International Searching Authority for PCT application No. PCT/US2005/020019 dated Jan. 16, 2006.

International Search Report and Invitation to Pay Additional Fees, dated Oct. 28, 2005 for corresponding PCT application No. PCT/US2005/020019.

* cited by examiner

AUTOMATED CLIPPING PACKAGING APPARATUS AND ASSOCIATED DEVICES, METHODS, SYSTEMS AND COMPUTER PROGRAM PRODUCTS

RELATED APPLICATIONS

This application claims priority to U.S. Provisional Patent Application Ser. No. 60/579,709 filed Jun. 15, 2004, the contents of which are hereby incorporated by reference as if recited in full herein.

FIELD OF THE INVENTION

The present invention relates to apparatus that can package and apply closure clips to materials that enclose products therein, and may be particularly suitable for clipping netting material about a desired product(s).

BACKGROUND OF THE INVENTION

Certain types of commodity and/or industrial items can be packaged by placing the desired product(s) in a covering material and then applying a closure clip or clips to end portions of the covering material to secure the product(s) therein. For non-flowable piece goods, the piece goods can be held individually in a respective clipped package, or as a group of goods in a single package. The covering material can be any suitable material, typically a casing and/or netting material.

Generally described, when packaging a piece good product in netting, the product can be manually pushed through a netting chute. The product can include, by way of example, a non-flowable semi-solid and/or solid object such as a meat product including whole or half hams, turkey, chicken, and the like. The netting chute holds a length of a netting sleeve over the exterior thereof. A first downstream end portion of the netting is typically closed using a first clip. As the product exits the netting chute, it is covered with the netting. An operator can then orient the product inside the netting between the discharge end of the chute and the clipped first end portion of the netting. The operator can then pull the netting so that the netting is held relatively tight (typically stretched or in tension) over the product. The operator then uses his/her hands to compress or gather the open end of the netting (upstream of the product) and manually applies a clip to the netting, typically using a Tipper Tie® double clipper apparatus. A clip attachment apparatus or "clippers" are well known to those of skill in the art and include those available from Tipper Tie, Inc., of Apex, N.C., including product numbers Z3214, Z3202, and Z3200. Examples of clip attachment apparatus and/or packaging apparatus are described in U.S. Pat. Nos. 3,389,533; 3,499,259; 4,683,700; and 5,161,347, the contents of which are hereby incorporated by reference as if recited in full herein.

A double clipper can concurrently apply two clips to the netting proximate the open (upstream) end of the package. One clip defines the first end portion of the next package and the other defines the trailing or second end portion of the package then being closed. A cutting mechanism incorporated in the clipper apparatus can sever the two packages before the enclosed package is removed from the clipper apparatus. U.S. Pat. No. 4,766,713 describes a double clipper apparatus used to apply two clips to a casing covering. U.S. Pat. No. 5,495,701 proposes a clipper with a clip attachment mechanism configured to selectively fasten a single clip or two clips simultaneously. The mechanism has two punches, one of which is driven directly by a pneumatic cylinder and the other of which is connected to the first punch using a pin and key assembly. The pin and key assembly allows the punches to be coupled or decoupled to the pneumatic cylinder drive to apply one single clip or two clips simultaneously. U.S. Pat. No. 5,586,424 proposes an apparatus for movement of U-shaped clips along a rail. The apparatus includes a clip feed for advancing clips on a guide rail and the arm is reciprocally driven by a piston and cylinder arrangement. The contents of each of these patents are hereby incorporated by reference as if recited in full herein.

Other deices provide for semi-automated or automated clipping as described in U.S. patent Ser. No. 10/339,910 and co-pending, co-assigned U.S. Provisional Patent Application Ser. No. 60/508,659, the contents of which are also hereby incorporated by reference as if recited in full herein. For example, U.S. Pat. Ser. No. 10/339,910 describes a device with a chute that is configured to package a product, such as a vacuum-packed turkey, and can also form a handle in a tubular covering encasing the product.

SUMMARY OF EMBODIMENTS OF THE INVENTION

Embodiments of the present invention provide apparatus, subassemblies and/or other devices, systems, methods and computer program products for packaging a product in a covering material and/or applying clips thereto.

In certain embodiments, the product can be manipulated and packaged so that at least one clip is automatically applied to enclose the product in the covering material. Particular embodiments (automatically) weigh, electronically transmit the weight to a printer, deliver an object into a predetermined travel path through a chute, and then package a discrete object or objects in netting as the object(s) exits the chute.

In certain embodiments, apparatus can be configured to enclose at least one product in a covering material. The apparatus include: (a) an elongate product chute having an outer surface and opposing receiving and discharge end portions with an interior cavity extending therethrough; and (b) a clipper mechanism disposed downstream of the product chute, the clipper mechanism configured to automatically apply at least one clip to a covering material that encloses a product after the product exits the product chute, wherein the clipper mechanism is configured with an automatic stroke cycle that comprises a first retracted home position, a second pre-clip dwell position, and a third clipping position.

In some embodiments, the clipper mechanism comprises a two-stroke actuation cylinder to pivotably and controllably serially advance from the first position, to the second position, and the third position, and then pivotably retract back to the first position. The second clipper mechanism position may be at least about 50% of the stroke distance between the first and third clipper mechanism positions.

Other embodiments are directed to an automated or semi-automated clipper mechanism for attaching at least one closure clip to a product held in netting. The mechanism includes a pivotable clipper mechanism having a clipper body configured to automatically deliver clips to a clip window and attach at least one clip to gathered netting. The clipper mechanism can have a predetermined automatic stroke cycle that comprises a first retracted home position, a second pre-clip dwell position, and a third clipping position.

In some embodiments, the clipper mechanism can also include: (a) a clipper body; (b) a curvilinear clip rail attached to the clipper body having opposing top and bottom end portions and defining a generally downwardly extending clip feed direction; (c) a clip entry window in communication with the bottom end portion of the clip rail and a clip closure delivery path in communication with a punch mechanism that is adapted to wrap a clip from the clip rail about covering encasing a target product; (d) a clip pusher configured to selectively engage with clips held on the clip rail to force the clips in the feed direction; (e) a first gathering plate disposed on a first side of the clip entry window, the first clipper gathering plate configured to extend a distance below the clip rail and generally outwardly therefrom toward the covering; and (f) a second clipper gathering plate disposed on an opposing side of the clip entry window downstream of the first clipper gathering plate so as to be spaced apart from the first clipper gathering plate, the second clipper gathering plate configured to extend a distance below the clip rail and generally outwardly therefrom toward the target covering material. In operation, the first and second clipper gathering plates move in concert with the clipper mechanism.

Other embodiments are directed to clipper apparatus that include: (a) a mounting frame; (b) a clipper mechanism attached to the mounting frame so as to be able to travel to advance and retract relative to a product travel path, the clipper mechanism having a clipper body configured to automatically attach at least one clip to a portion of gathered target covering material, wherein the clipper mechanism has an automatic stroke cycle that comprises a retracted home position and a clipping position; and (c) a discharge tray held downstream of the clipper mechanism, the tray having first and second spaced apart upwardly extending flaps that automatically pivot laterally inward to reside closer together to trap a forwardmost position of a respective product in a clip location, then pivot away from each other to allow the clipped product to pass.

The apparatus may also include first and second longitudinally extending laterally spaced apart slots. The first and second pivotable flaps can each have a leg that extends downwardly through a respective slot, the legs configured to advance and retract in the respective slots to thereby position the flaps at longitudinally adjustable distances. In some embodiments, an underside of the tray comprises a four bar linkage with a center link and opposing first and second side links attached to the center link. The side links have opposing first and second end portions. One leg is attached to a first end portion of the first side link and the other leg is attached to a first end portion of the second side link. The center link may also include a slot on opposing end portions thereof. The second end portion of the first side link can travel in one of the center link slots and the second end portion of the second side link can travel in the other center link slot.

Some embodiments include clipper apparatus that include: (a) a mounting frame having opposing first and second upstanding sides residing on opposing sides of a product flow path; (b) a clipper mechanism attached to the first side of the mounting frame, the clipper mechanism configured to automatically deliver clips to a clip window, attach at least one clip to a portion of gathered target covering material, wherein the clipper mechanism has an automatic stroke cycle that comprises a retracted home position and a clipping position; and (c) a printer platform holding a printer thereon, the printer platform pivotably mounted to the mounting frame and configured with a generally planar top member configured to allow the printer to slide for loading of consumable items. The printer platform has an operative position that aligns a printer output port of the printer with a label feed window in the product flow path and a re-load position. The printer platform pivots laterally outward and the printer top member slides in a predetermined direction. The printer platform can provide increased precision re-alignment with the feed window upon repositioning in the operative position.

The apparatus can be configured with a frame that can accommodate modular interchangeable subassembly components that can be selectively mounted at different positions on the frame to thereby provide increased manufacturing build options and/or selectable purchaser options without requiring custom designed equipment. The flexible mounting arrangements and/or modular sub-assembly selections can reduce inventory, build-times, and provide greater customer options.

Some embodiments are directed to packaging apparatus for packaging at least one discrete product in a netting material. The apparatus includes a clipper mechanism and a support platform disposed downstream of the clipper mechanism. The support platform includes longitudinally extending laterally spaced apart first and second slots with first and second pivotable flaps, each flap having a generally downwardly extending leg extending through a respective one of said slots. In operation, a free end of each of the flaps move to reside closer together, the flaps then move upstream to trap a target product while the netting material is being clipped by the clipper mechanism, then the flaps automatically pivot outwardly to open to allow the enclosed netted product to travel downstream thereof.

Still other embodiments are directed to methods of packaging a product in netting. The methods include: (a) weighing a packaged whole bird product having encased protruding legs; (b) conveying the whole bird product on a first conveyor along a first travel direction with the legs positioned substantially orthogonal to the conveying direction; (c) conveying the product in a primary travel path on a second conveyor, the primary travel path being substantially orthogonal to the product first travel direction with the product held on the second conveyor with its legs facing downstream; (d) automatically wrapping the product in netting as it exits a netting product chute; and (e) clipping an end portion of the netting to enclose the product therein.

Other embodiments are directed to methods of operating an automated or semi-automated packaging apparatus that includes a clipper mechanism and a product chute with a supply of covering material held thereon. The methods, include: (a) weighing a product; (b) directing the product to travel through the product chute to automatically encase the product in the covering material as the product exits the product chute; (c) electronically transmitting the weight of the product to a printer held downstream of the product chute; (d) automatically clipping the covering material encasing the product; automatically attaching a label from the printer with the product weight printed thereon onto the encased product proximate to the clipping step; (e) pivoting the printer laterally away from the clipper mechanism; and (f) sliding the printer to allow external access to the printer for reloading consumable items.

Some embodiments are directed to computer program products for operating a packaging apparatus. The packaging apparatus includes a product chute and a clipping apparatus that applies at least one closure clip to target gathered covering material. The computer program product includes a computer readable storage medium having computer readable program code embodied in the medium. The computer-readable program code including: (a) computer readable program code that automatically controllably actuates a clipper mechanism actuation cylinder to direct the clipper mechanism to travel through a retracted home position, a pre-clip dwell position and a full-clip position; and (b) computer readable program code that automatically controllably directs the clipper mechanism to apply at least one clip during a clipping operation when the clipper mechanism is in the full-clip position.

The product may also further comprising computer readable program code that automatically controllably directs an automated handle maker to form a handle, and computer readable program code that directs the clipper mechanism to travel from the home to the pre-clip position during the handle making operation, then to the full clip position after the handle is formed.

These and other objects and/or aspects of the present invention are explained in detail in the specification set forth below.

DESCRIPTION OF EMBODIMENTS OF THE INVENTION

Figure 1A:
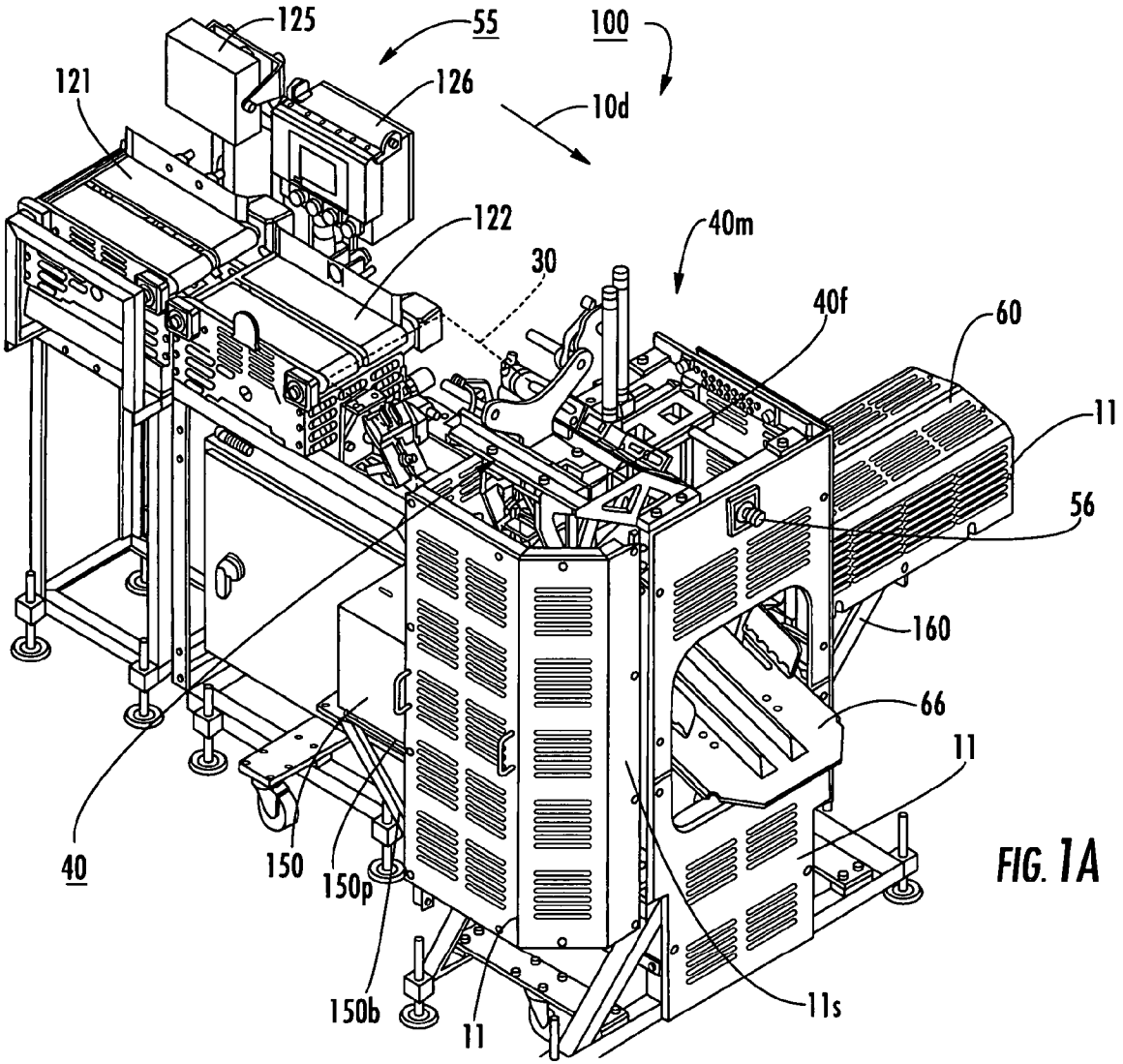
FIG. 1A is a perspective view of a packaging apparatus according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations, unless specified otherwise. In addition, the sequence of operations (or steps) is not limited to the order presented in the claims unless specifically indicated otherwise. Where used, the terms "attached", "connected", "contacting", "coupling" and the like, can mean either directly or indirectly, unless stated otherwise. The term "concurrently" means that the operations are carried out substantially simultaneously. The term "frame" means a generally skeletal structure used to support one or more modules and/or components. The term "modular" means that a frame is configured to accept one or more subassemblies designed with standardized dimensions or configurations for interchangeable use with replacement modules of the same and/or similar type and/or other different modules, and may be configured for selectable mounting on a right or left hand side of a common frame.

In the description of the present invention that follows, certain terms are employed to refer to the positional relationship of certain structures relative to other structures. As used herein, the terms "front," "forward" and derivatives thereof refer to the general or primary direction that a target product travels for enclosure and/or clipping; this term is intended to be synonymous with the term "downstream," which is often used in manufacturing or material flow environments to indicate that certain material traveling or being acted upon is farther along in that process than other material. Conversely, the terms "rearward," "upstream" and derivatives thereof refer to the directions opposite, respectively, the forward and downstream directions. It is also noted that different mounting orientation configurations of one or more modules and/or apparatus may be shown in the figures. Thus, the figures may show certain of the devices in different views with different mounting configurations and the views in different figures do not necessarily correspond to a common or single mounting arrangement as different views may have certain components and/or devices oriented differently.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the application and should not be interpreted in an idealized or overly formal sense unless expressly so defined herein.

The present invention is particularly suitable for applying closure clips to discrete objects held in a covering material. The covering material may be natural or synthetic and may be a casing material that can be sealed about a product. In other embodiments, the covering material can be netting. The casing can be any suitable casing (edible or inedible, natural or synthetic) such as, but not limited to, collagen, cellulose, plastic, elastomeric or polymeric casing. The term "netting" refers to any generally open mesh material in any form including, for example, knotted, braided, extruded, stamped, knitted, woven or otherwise. Typically, the netting is configured so as to be stretchable in both axial and lateral directions.

Netting or other covering material may be used to package discrete meat products such as loaves of meat, boned ham, spiral sliced ham, deboned ham, turkey, turkey loaves held in molds, or other meat or items directly or with the items held in subcontainers and/or wraps such as molds, trays, boxes, bags, absorbent or protective sheets, sealant, cans and the like. In particular embodiments, the systems of the present invention can be adapted for packing whole birds (such as turkeys). The term "whole bird" means that the bird is generally intact but the head and internal organs and the like may be removed.

Other embodiments of the present invention may be directed to package other types of food such as cheese, bread, fruit, vegetables, and the like. Examples of non-food items that may be packaged using embodiments of the present invention include living items such as flora, trees, and the like, as well as inanimate objects. Additional examples of products include discrete, semi-solid or solid objects such as firewood, pet food (typically held in a container if the wet type), recreational objects (such as balls), or other solid or semi-solid objects. The product may be packaged for any suitable industry including horticulture, aquaculture, agriculture, or other food industry, environmental, chemical, explosive, or other application. Netting may be particularly useful to package hams or turkeys (such as vacuum-wrapped hams or turkeys), manufactured hardware such as automotive parts, firewood, explosives, molded products, and other industrial, consumable, and/or commodity item(s).

Generally stated, embodiments of the present invention are directed at automating packaging of piece goods or discrete items by forcing them through a product chute and wrapping or enveloping the objects at the other end of the chute in a covering material, such as netting, and automatically clipping the covering material with a closure clip or other attachment means to close the covering and hold the object or objects inside of the covering material. As noted above, clippers are available from Tipper Tie, Inc., of Apex, N.C. Examples of suitable clips include metallic generally "U"-shaped clips available from Tipper Tie, Inc., in Apex, N.C. Other clips, clip materials and clip configurations or closure means may also be used.

Figure 1B:
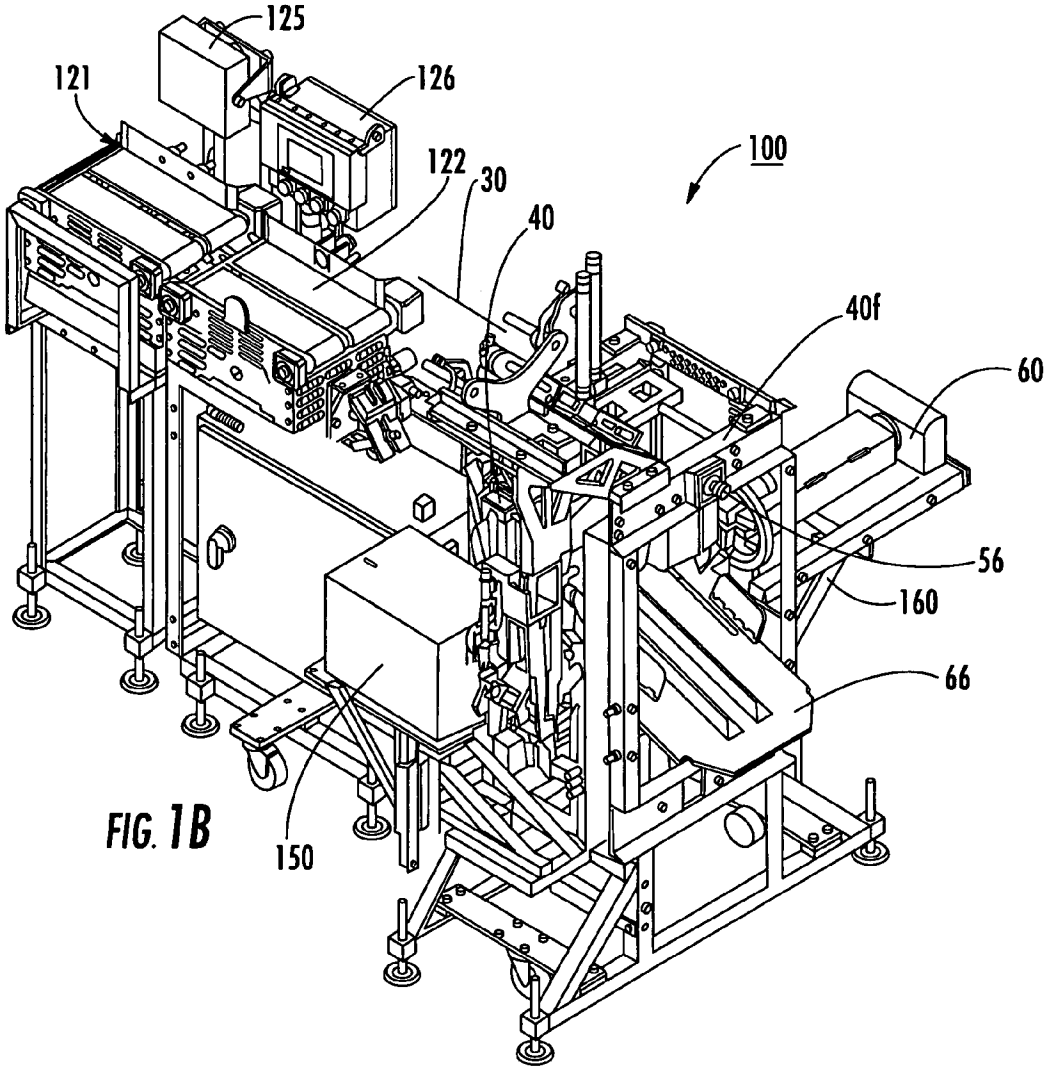
FIG. 1B is a perspective view of the packaging apparatus shown in FIG. 1A with the housing guards removed.
Figure 1C:
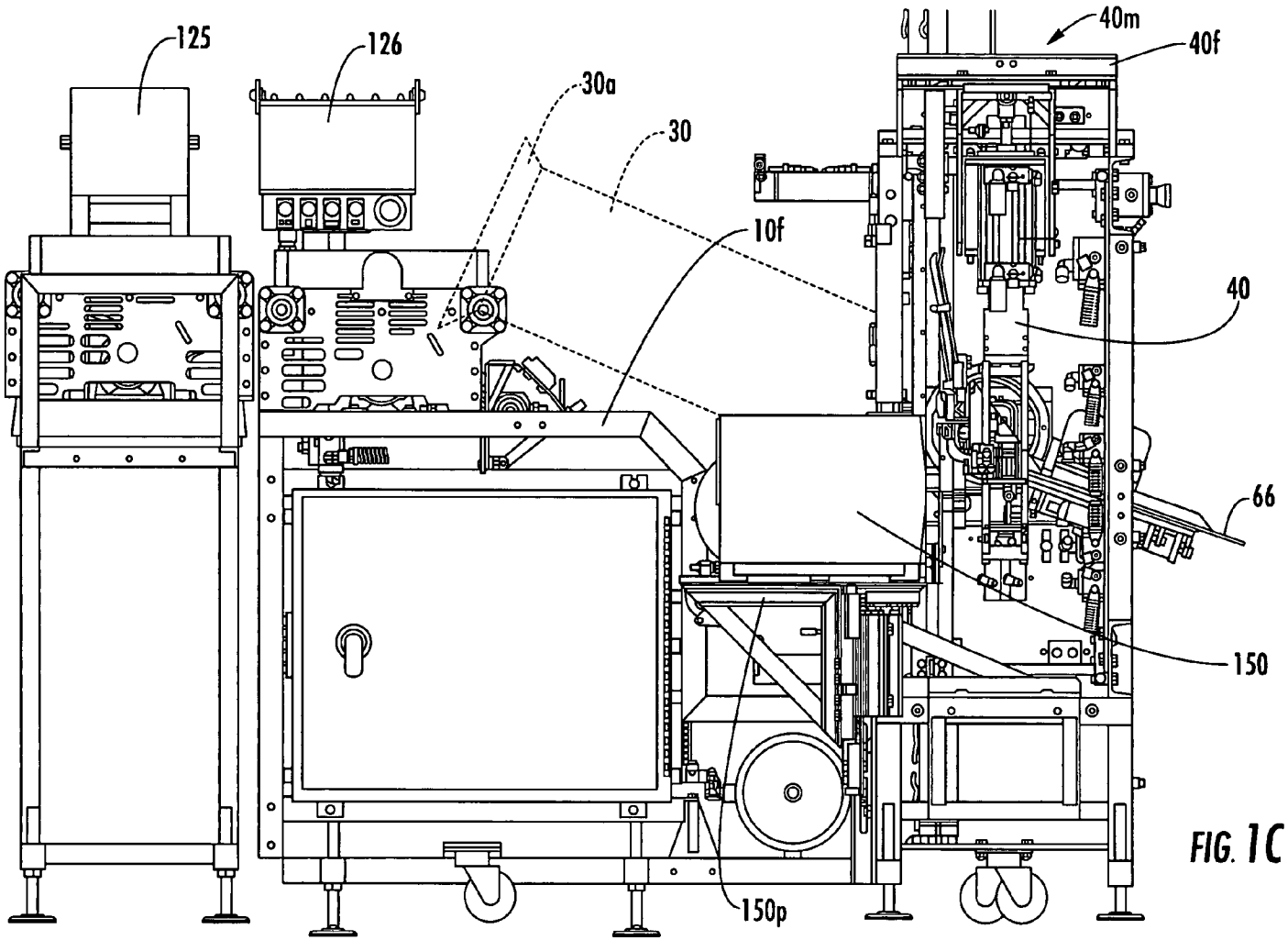
FIG. 1C is a front view of the apparatus shown in FIG. 1B.

FIGS. 1A-1C illustrate an exemplary clipping packaging apparatus 100 according to embodiments of the present invention. The packaging apparatus 100 includes a product chute 30, although the product chute in FIGS. 1A-1C is omitted for clarity and is indicated in broken line feature representation in an approximate location. FIG. 1A illustrates the apparatus 100 with housing guards 11. FIG. 1C shows the apparatus 100 with housing guards 11 removed. The chute 30 in the apparatus 100 shown in FIG. 1A may be inclined and may be at least partially gravity fed. The apparatus 100 includes a clipper module 40*m*. The clipper module 40*m* can have a frame 40*f* that selectively allows the clipper mechanism 40 to be mounted to either a right hand or left hand side thereof, as will be discussed further below. In certain particular embodiments, the apparatus 100 can be used to package sealed whole poultry products ("whole" meaning generally intact but typically missing the head/neck and/or internal organs). The arrows in FIG. 1A toward the product chute 30 and clipper 40 indicate the primary direction of product flow. In addition, although the downstream direction 10*d* is shown as in a direction that extends from left to right with the upstream direction in the opposing direction), the apparatus 100 can be oriented to run left to right or in a direction that is into or out of the paper.

Figure 3A:
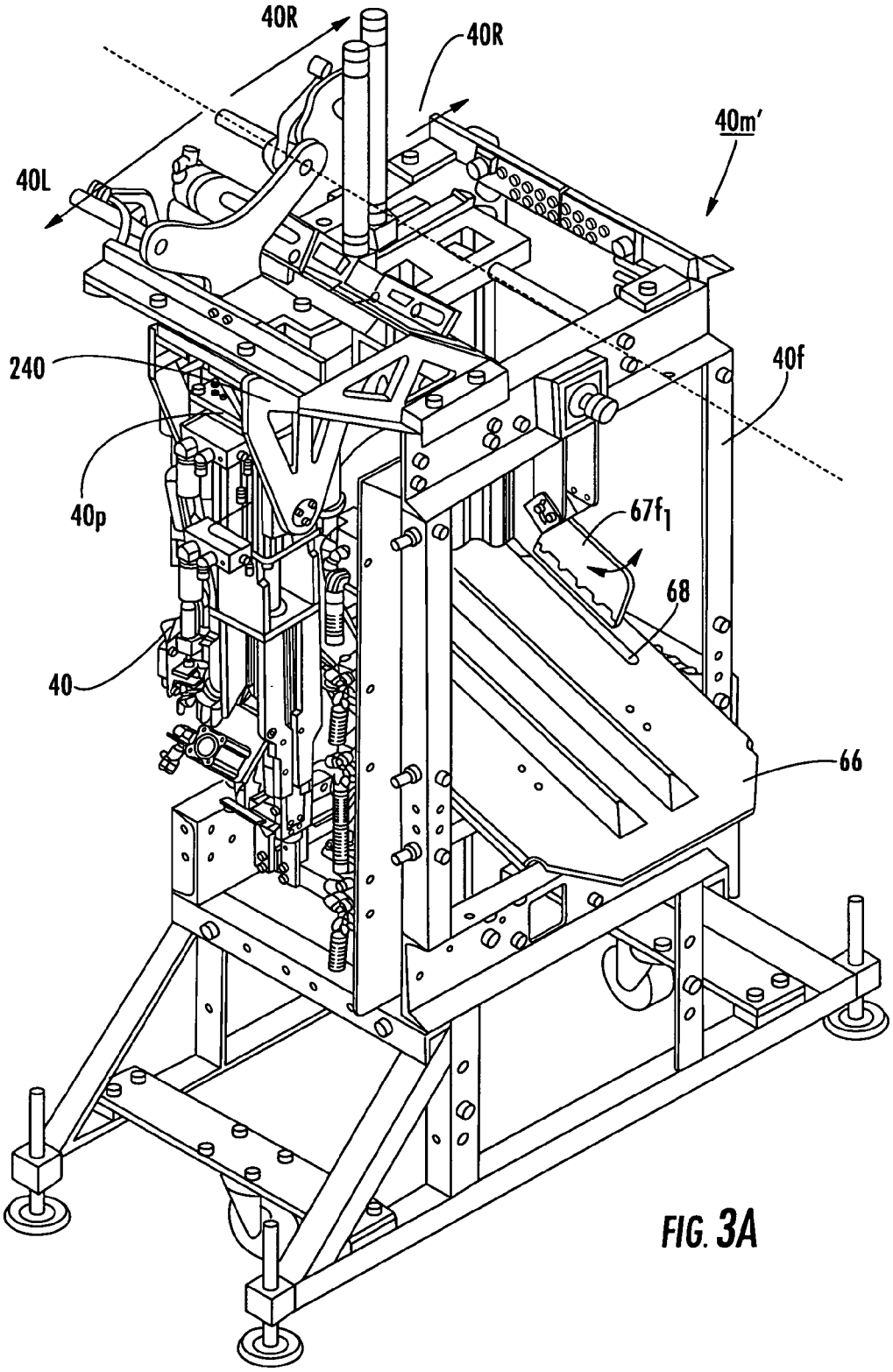
FIG. 3A is a perspective view of a clipper module, shown without housing guards and with the clipper in a home position, according to embodiments of the present invention.
Figure 3B:
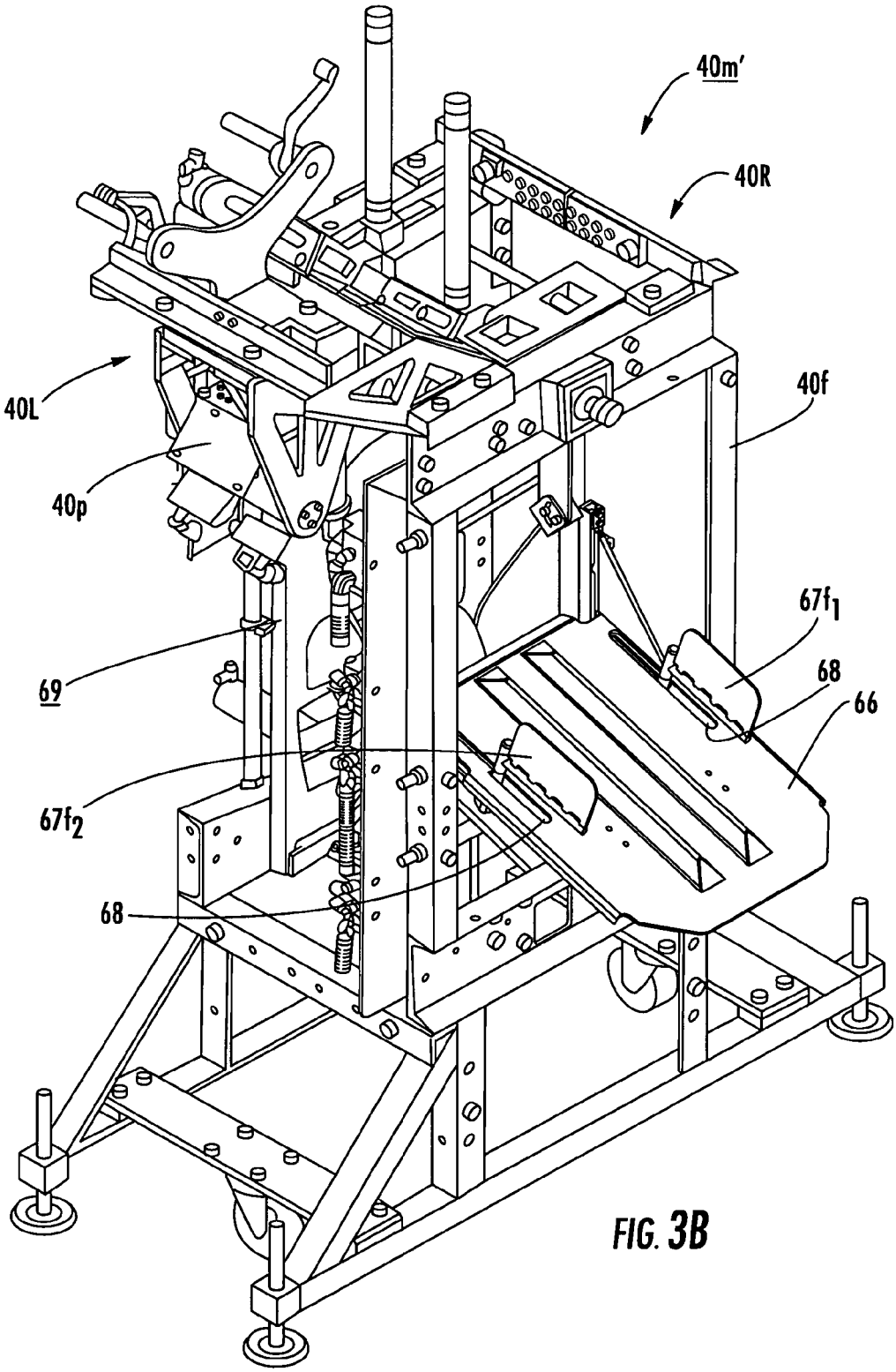
FIG. 3B is a perspective view of the clipper module shown in FIG. 3A, illustrating the clipper in a full-clip position.
Figure 3C:
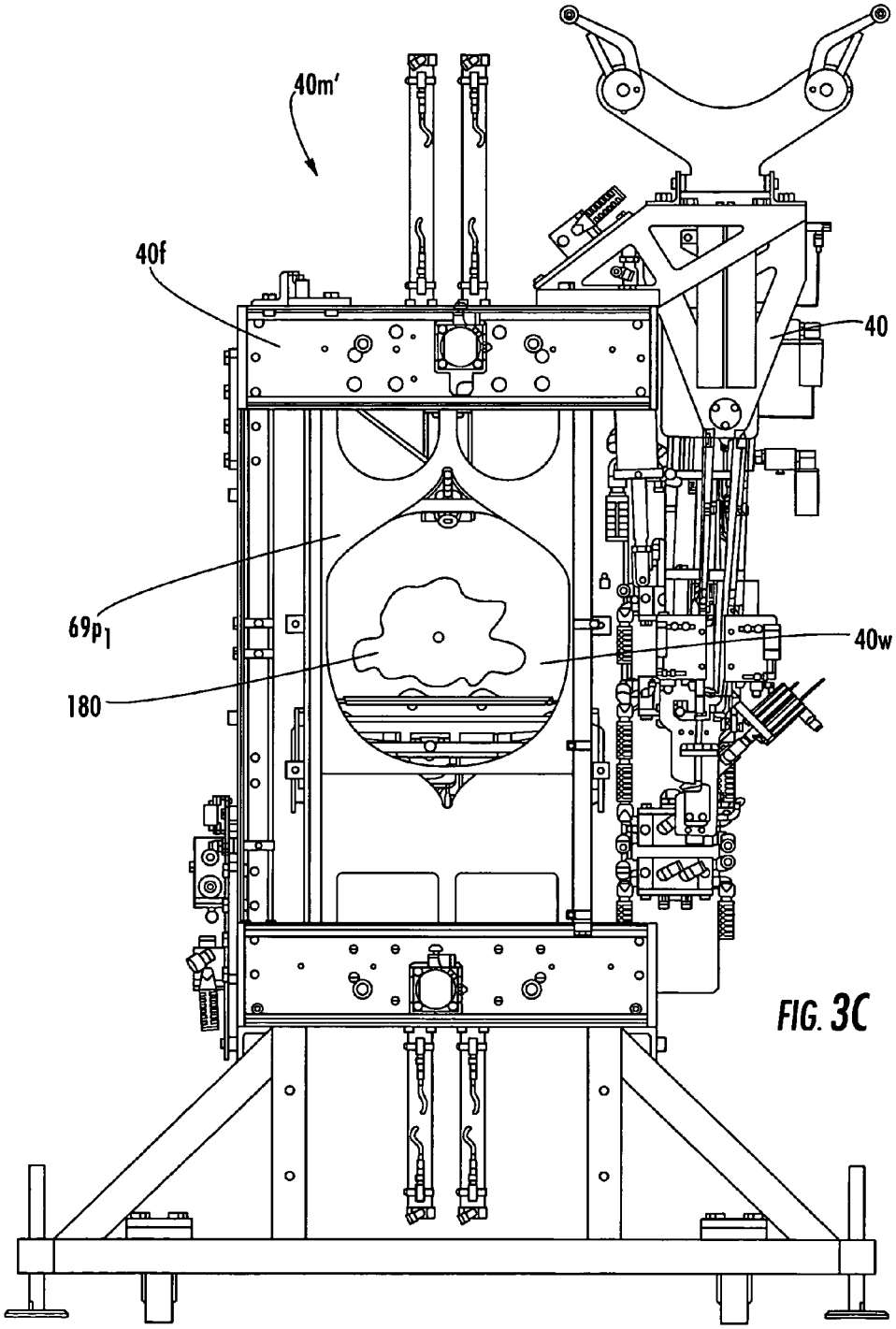
FIG. 3C is a side view (looking downstream) of the device shown in FIG. 3A.

As shown in FIG. 3C, the clipper module 40*m* can include a chute window 40*w* that receives the discharge end portion of the product chute 30 and holds the product chute in alignment with the clipper 40. As such, the discharge end portion of the chute 30 can reside on the frame 40*f* (directly or indirectly). The chute 30 can be changed out and replaced as desired to run different products and/or covering. The chute 30 may be configured the same or different from that shown. Typically, the length and/or height of the chute 30 is maintained within a desired tolerance for replacement chutes to reduce any adjustments on the other components. In any event, the product travels through the chute 30 and is enclosed in a covering material as it exits the chute 30 and enters the clipper module 40*m*.

FIGS. 1A-1C illustrate that the apparatus 100 can include a plurality of in-line floors, shown as two floors, 121, 122. The in-line floors 121, 122 can be configured to cooperate to move the product along the travel path and into the chute 30. Typically the floors 121, 122 are configured to move, and may be defined by surfaces of endless conveyors. The first floor 121 can be an in-feed conveyor. The first floor or conveyor 121 can be in communication with a scale 125 that can weigh the object(s) thereon.

It is noted that the floors 121 and/or 122 of apparatus 100, may include additional and/or other floor configurations, typically comprising moving floors or product advancement systems may be used, for example, rollers, rolling bars, belts or drives that advance trays or other support members and the like. In addition, the floor(s) 121, 122 may extend substantially horizontal and/or be angularly oriented to travel up, down, or otherwise to advance the product. In addition, the apparatus 100 can include an automated continuous advancement system with discrete product(s) separated at desired intervals on the moving floor to serially introduce product for packaging to the chute 30. In certain embodiments, the moving floor can include partitions, channels, or other spacer configurations to hold the product(s) in desired alignment on the moving floor.

For groups of objects, manual or automated bins or feeders can accumulate the desired amount of grouped objects upstream and place them together on the moving floor (not shown). In other embodiments, an automated counter can be used to count the number of products that pass a target location so that a desired number of products are accumulated (not shown). The conveyor 121 and/or 122 (FIG. 1A) and chute 30 may be configured to have a gap or bridge space therebetween, depending on the size of the conveyor and/or length of the chute 30. In certain particular embodiments, a gap space of about 2.5 inches extends in the axial direction between the conveyor 122 and the chute 30.

FIG. 1A also illustrates that the apparatus 100 can include a human machine interface ("HMI") station 55 that houses operational switches or components (and typically the controller 126) that an operator can access to operate the apparatus 100. The apparatus 100 can house system valves, pressure transducers, actuator controls, a processor that directs the automated operations of the apparatus 10 (which may also be held in-total or partially in the HMI 55) and other electronic, software and/or mechanical equipment as will be understood by one of skill in the art. The HMI 55 may include a touch screen interface/user input.

Figure 2A:
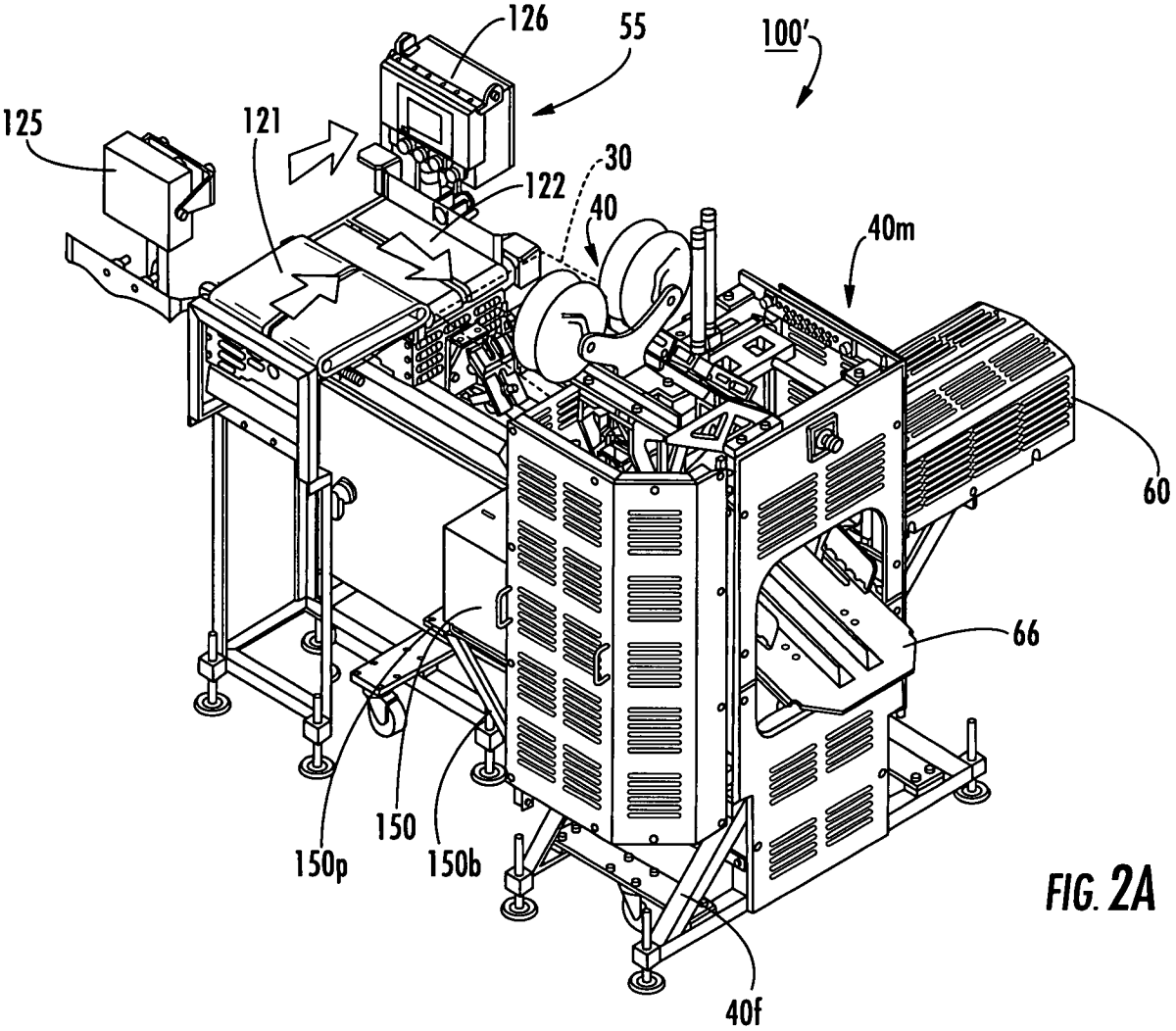
FIG. 2A is a perspective view of an alternately configured packaging apparatus according to embodiments of the present invention.

Generally described, the scale 125 can take a number of weight measurements, and accepts one when the weight measurement has stabilized to within a predetermined (statistically valid) range. In some embodiments, 10 or more, and typically about 25 or more weight measurements can be taken and when successive weight measurements for a product varies by less than a specified percentage or value, a weight can be "locked-in". The first floor 121 can be configured to automatically advance and/or move after the weight is successfully obtained. The scale 125 can be in communication with the moving floor 121 and the controller 126. The controller 126 can direct the movement of the floor 121 and/or relay the measured weight to the printer 150 in a queue order. The weight measurement can be electronically relayed to a label printer. In some embodiments, the label printer 150 can be a remote label printer, such as a printer module that is mounted to the frame 40*f* of the clipper module 40*m* as shown in FIGS. 1A and 2A. The scale 125 can serially obtain a plurality of measurements and relay them, typically in queue order (FIFO), to the printer module 150.

Figure 2B:
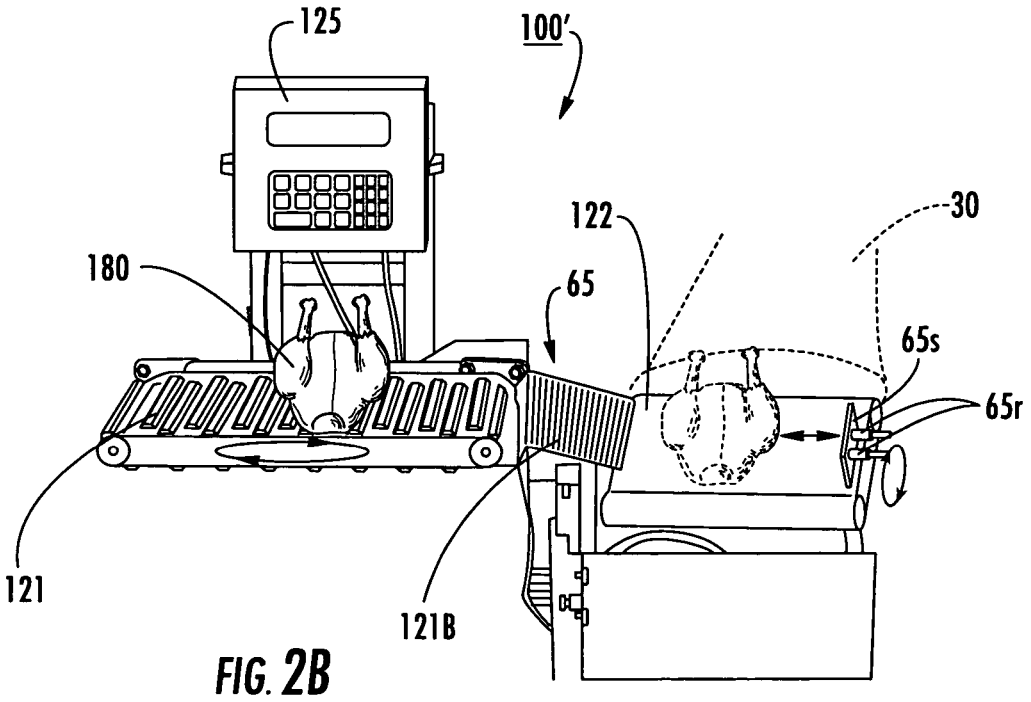
FIG. 2B is an enlarged perspective schematic view of a portion of a packaging apparatus similar to that shown in FIG. 2A according to embodiments of the present invention.
Figure 2C:
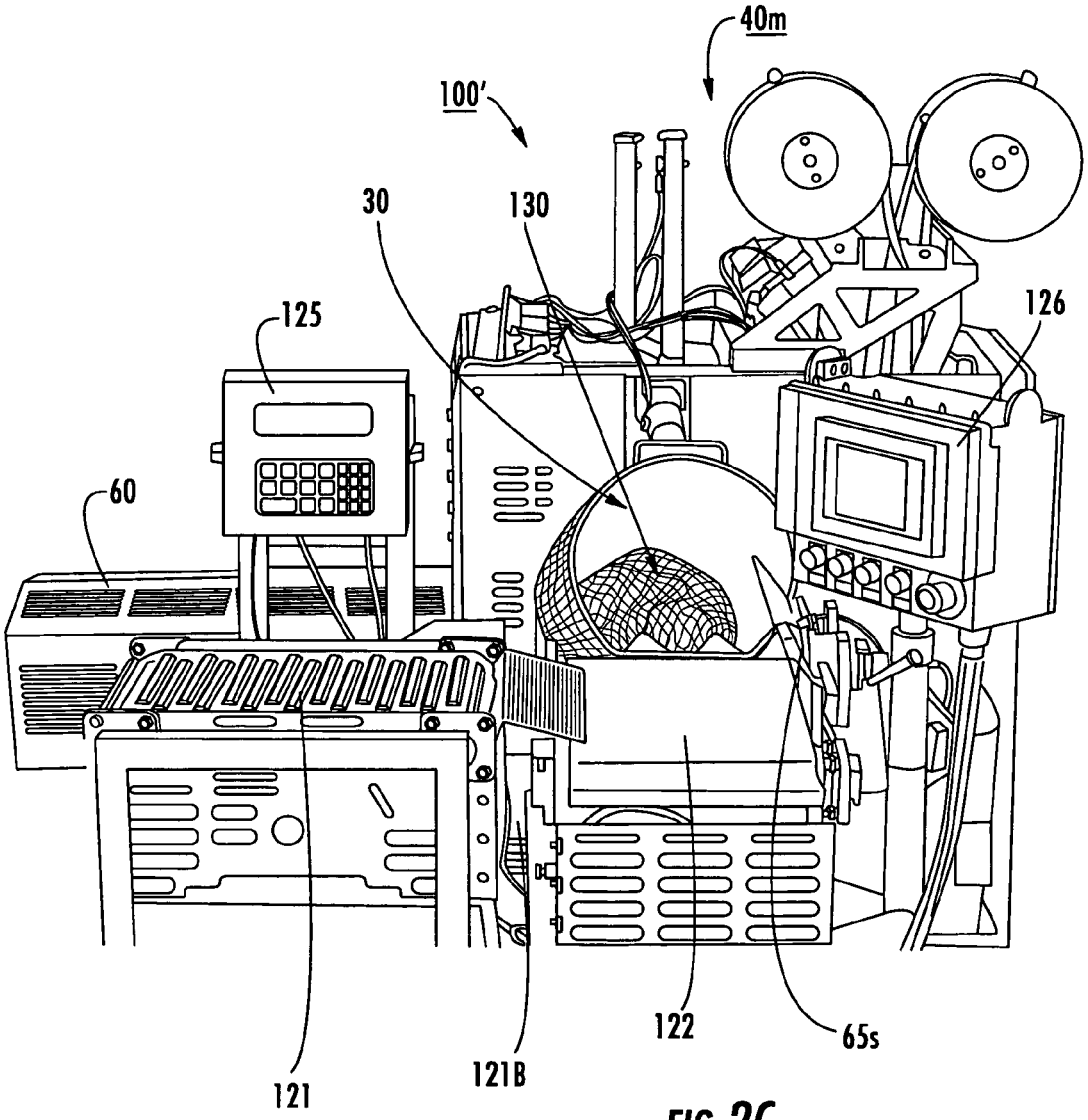
FIG. 2C is a digital image of a packaging apparatus with offset floors similar to that shown in FIG. 2B according to embodiments of the present invention.

FIGS. 2A-2C show that the apparatus 100' can be configured with offset first and second floors 121, 122, with the first floor 121 configured to travel substantially orthogonal to the primary product travel path and/or the second floor 122. When on the first floor 121 in the apparatus 100', particularly for whole bird or poultry products, the legs thereof may be oriented on the first floor 121 to align parallel to the primary product travel path so that the legs are oriented in a desired packaging orientation as the product enters the product chute 30. The scale 125 can be located on a different side of the floor 121 and/or the floors 121, 122 can be alternatively arranged with respect to each other and/or the product travel path. For example, as shown in FIG. 2B, the floor 121 can operate to in-feed the product 180 from the opposing side of the second floor 122. Other offset floor orientations can be used for the apparatus 100'.

FIGS. 2B and 2C also show a stationary bridging member 121B that can extend between the two floors 121, 122. The bridging member 121B may be stainless steel and/or comprise an anti-stick material. The bridging member 121B may angle down in the direction of travel toward the second floor 122. As shown in FIG. 2B, the apparatus 100' may also include a stop member 65*s* that is positioned above or on the second floor 122 to help align incoming product 180 on the primary travel path, so that the center of the product is generally aligned and in-line with the axial centerline of the product chute 30. The stop member 65*s* can be a plate that is moveable transversely in and out in response to movement of the first floor 121 after a weight has been successfully obtained and/or other sensor data that automatically determines that product is in position in a transfer zone 65, such as via direction of the controller 126 (FIG. 1A) based on a signal from a proximity sensor. In other embodiments, the stop member 65*s* can be fixed but typically adjustable across a portion of the width of the floor 122. FIG. 2B shows that the stop member 65*s* can be a generally vertically oriented elongate stop plate in communication with at least one (shown as two) adjuster rods 65*r* to allow the apparatus 100' to adjust the position and/or travel distance to accommodate different size conveyors 121, 122 as well as different sized chutes 30 and/or products 180.

Figure 1D:
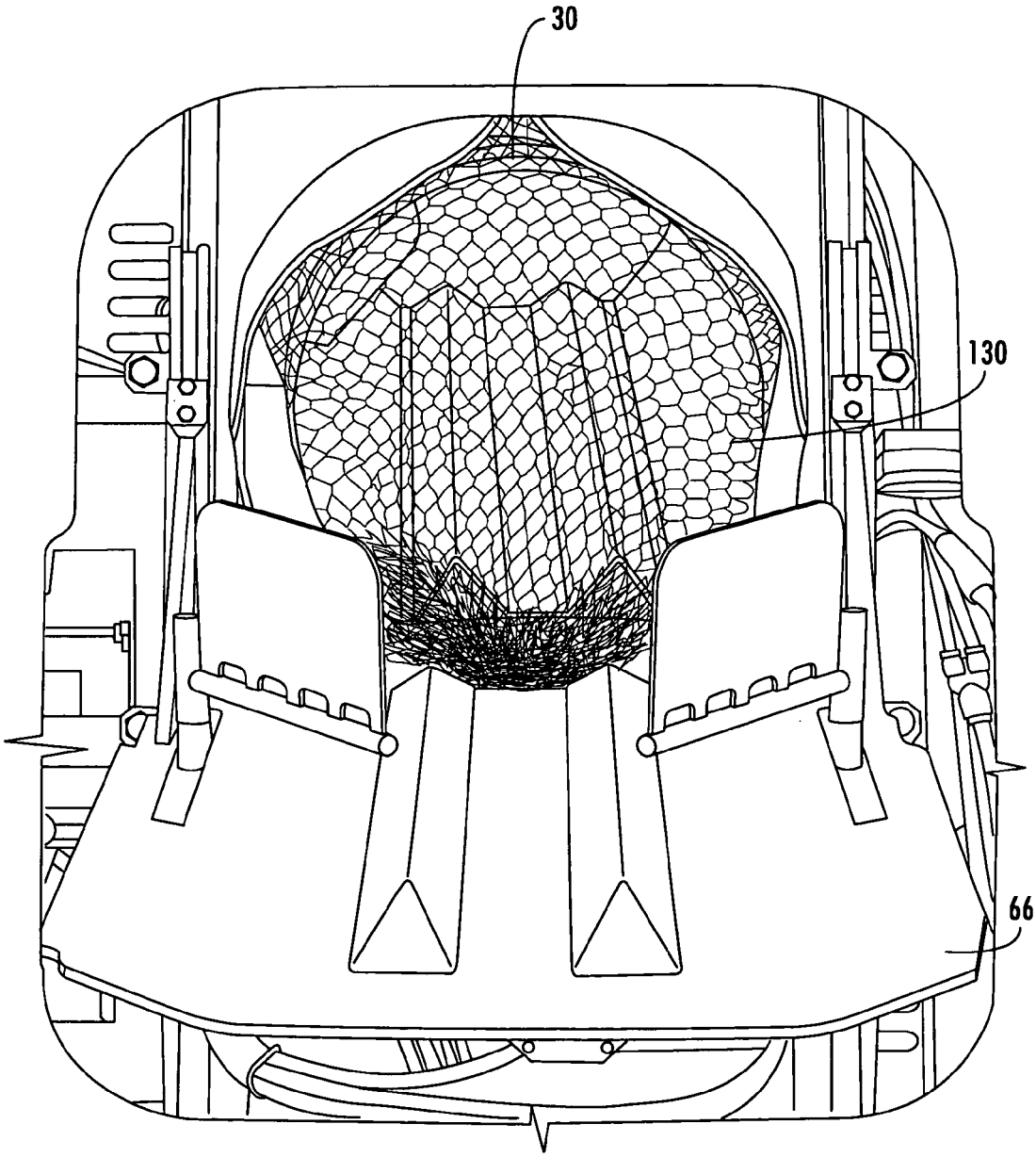
FIG. 1D is a digital image of a downstream portion of a packaging apparatus (looking upstream) similar to that shown in FIG. 1A illustrating a tubular covering material on the product chute according to embodiments of the present invention.

FIG. 1C illustrates a side view of the product chute 30 held on a mounting bracket and attached to a front-end frame 10*f*. As shown, the product chute 30 can be an elongate product chute. The product chute 30 can include a larger front-end cavity area 30*a* (shown as a funnel-like shape) relative to the intermediate and/or discharging portion, i.e., the chute cavity narrows in the pushing/product travel direction. Thus, the product chute 30 can include a primary body and a larger upstream guide portion that narrows into the shape of the primary body. The chute 30 may be formed as a unitary member or a series of attached members (not shown). The chute 30 can include a lifting handle to facilitate removal and installation. In operation, a supply of covering material 130 (FIG. 1D) can be placed on or about the chute 30, arranged to surround the exterior surface of at least a portion of the product chute 30 and extend in tension in the downstream direction to cover the product (tenting/tensioning in the axial direction) as the product exits the discharge end portion of the product chute. In certain embodiments, the covering material is configured and sized to stretch in at least the lateral direction and typically in both the lateral and axial directions as it is held on and dispensed from the product chute 30.

The product chute floor may comprise a stationary floor with an anti-stick coating or material. It is also noted that the product chute 30 may include a moving floor such as those types described above with respect to the infeed floor configurations. The chute 30 may be sized relative to the product 180 so that the product 180 extends across a major portion of the width of the cavity, and in certain embodiments, extends across at least about 75% of the width of the cavity. In certain embodiments, the product 180 and chute cavity 30*c* are sized so that the sides and/or top and bottom of the product 180 are pressed against the sidewalls of the cavity as the product is pushed therethrough. In other embodiments the chute cavity is sized to allow the product 180 to freely pass therethrough. The product chute 30 may comprise stainless steel and be coated with a friction reducing material such as TEFLON. Lubricants may also be disposed on the inner surface(s) of the product chute 30.

In certain embodiments, the product chute 30 has a cross-sectional profile that is non-circular. The product chute 30 may be configured with a planar top and/or bottom portion and semi-circular side portions. Other cross-sectional profile configurations may also be used including, but not limited to, circular, oval, triangular, rectangular, square and the like.

The chute widths may range from between about 9-13 inches and the height of the chutes 30 may be between about 5-12 inches. A smaller chute 30 may have a cavity that is about 9 inches wide by 5.75 inches tall while a larger chute 30 may have a cavity that is about 13 inches wide by about 11.25 inches tall. The chutes 30 may have a length (at least for the portion having a generally constant cross-sectional area) that is between about 28-30 inches, with a tolerance of about ±1/16 of an inch, facilitating alignment where replacement chutes are used. The chutes 30 may also have a flared or funnel-like entry portion 30*a* (FIG. 1C) that has a length of between about 4-10 inches. The funnel may be formed with larger flares for the larger chutes. In addition, the apparatus frame 10*f* may accommodate conveyors 122 having widths that are between about 18-24 inches wide.

As well known to those of skill in the art, a sleeve of covering material can be positioned about the external surface of the product chute 30 and configured to be drawn downstream thereof so as to automatically encase the product as the product emerges from the discharge end of the product chute 30. In some embodiments, a supplemental sleeve material holder may also be used instead of placing the sleeve of casing material on the product chute (not shown). The supplemental sleeve holder can be configured to surround a downstream portion of the product chute (not shown). The sleeve of covering material may be sized to stretch to substantially conform to the external wall or surface of the product chute 30 or may be more loosely held thereon.

In operation, the sleeve of covering material may be clipped, welded, fused, knotted or otherwise closed and sealed at a leading edge portion thereof. When the product exits the product chute 30, it is held in the covering material as the covering material is drawn downstream. The covering material may be loaded onto the product chute 30 and the leading edge portion thereof closed before or after the product chute 30 is mounted to the apparatus 100.

Figure 3D:
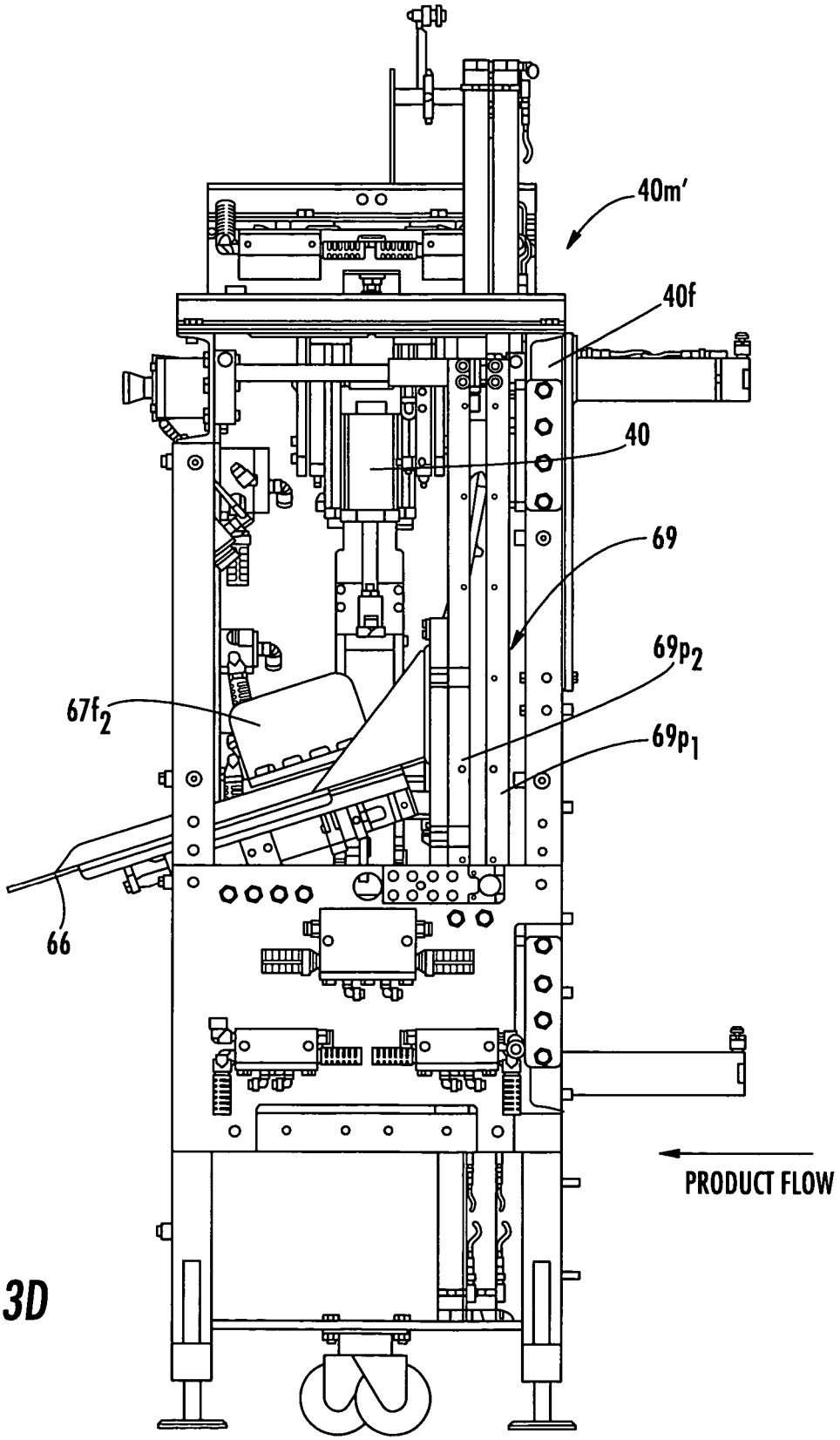
FIG. 3D is a rear view of the device shown in FIG. 3A.
Figure 3E:
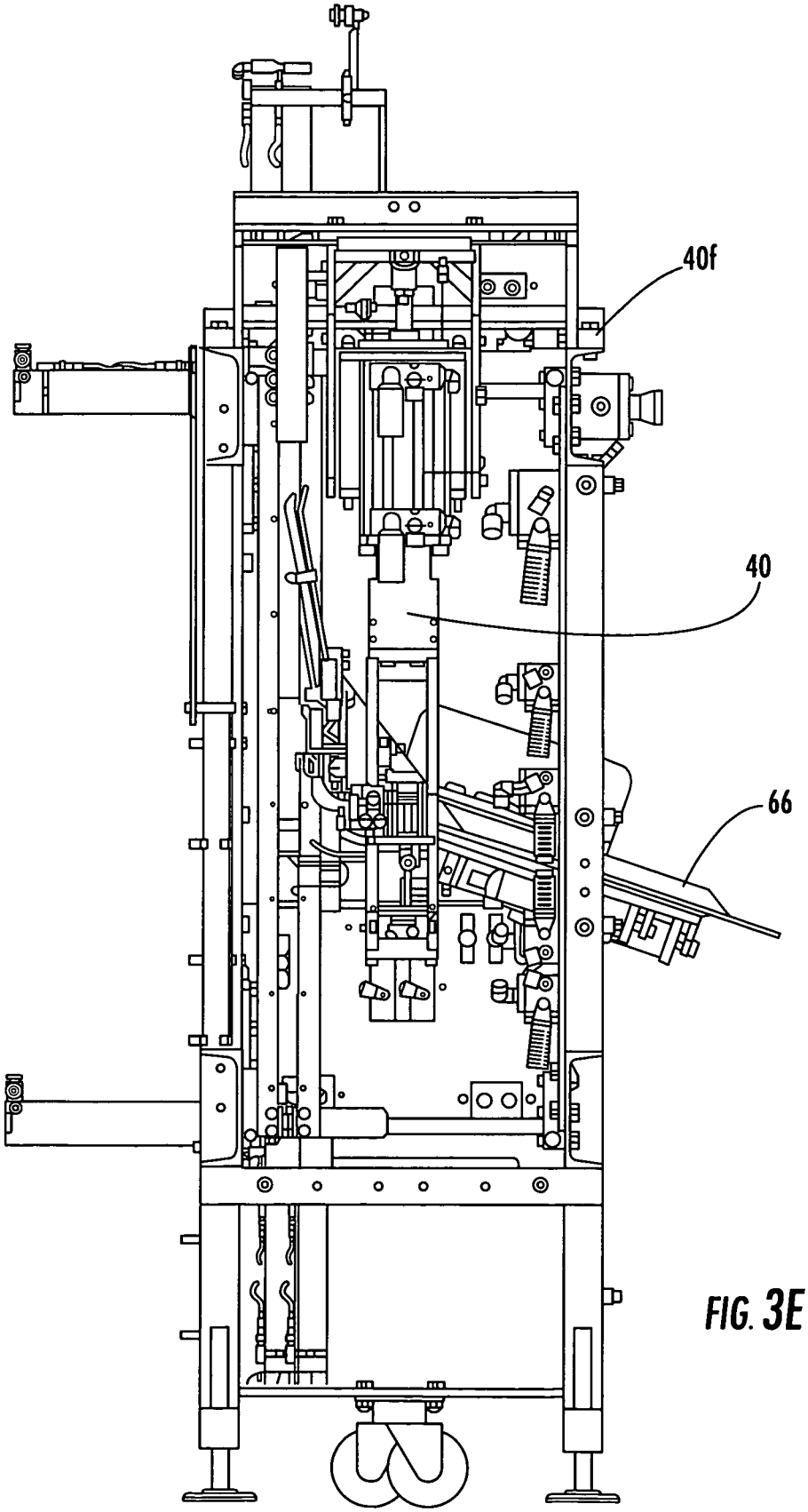
FIG. 3E is a front view of the device shown in FIG. 3A.
Figure 4:
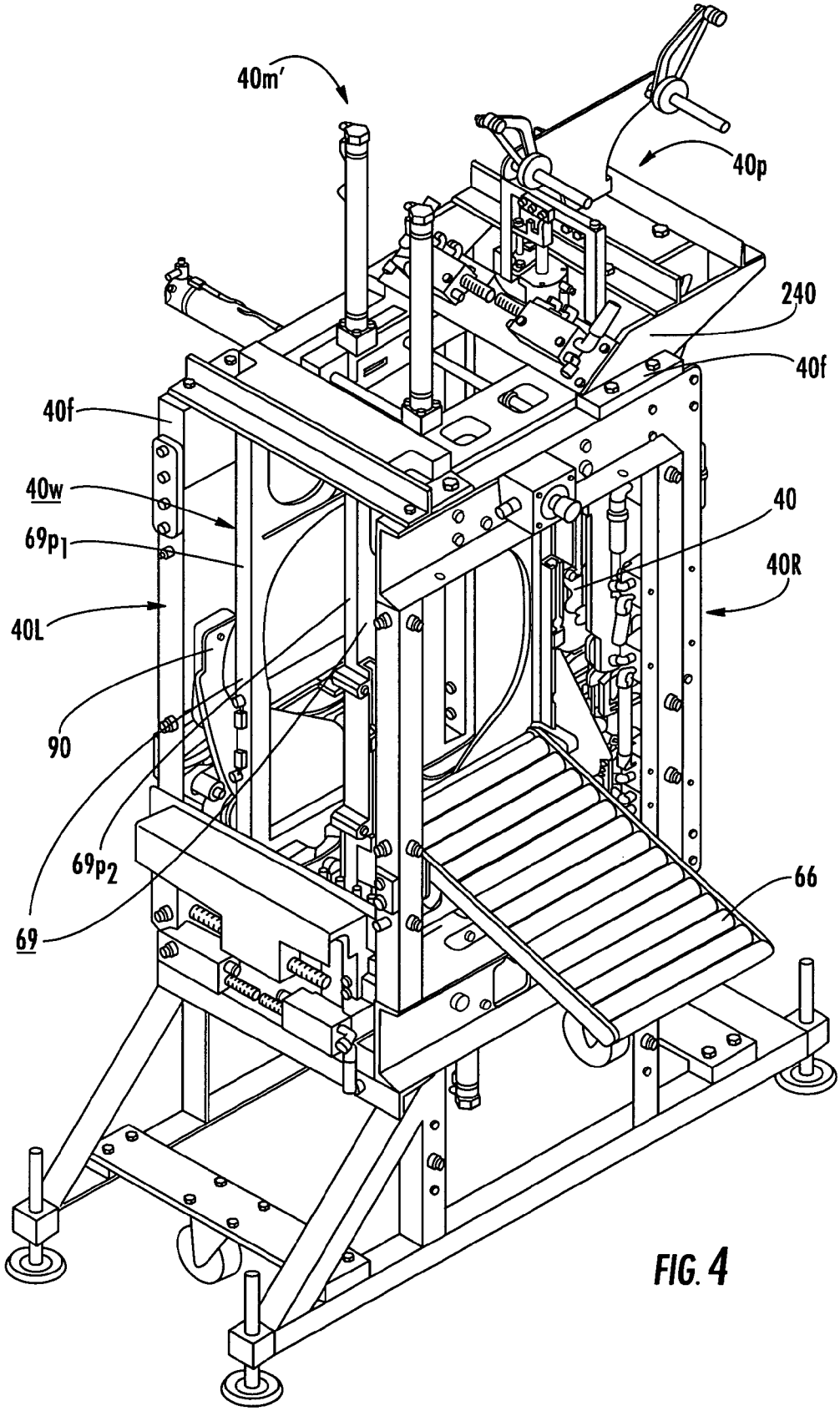
FIG. 4 is a perspective view of a clipper module illustrating a different discharge tray according to embodiments of the present invention.
Figure 5:
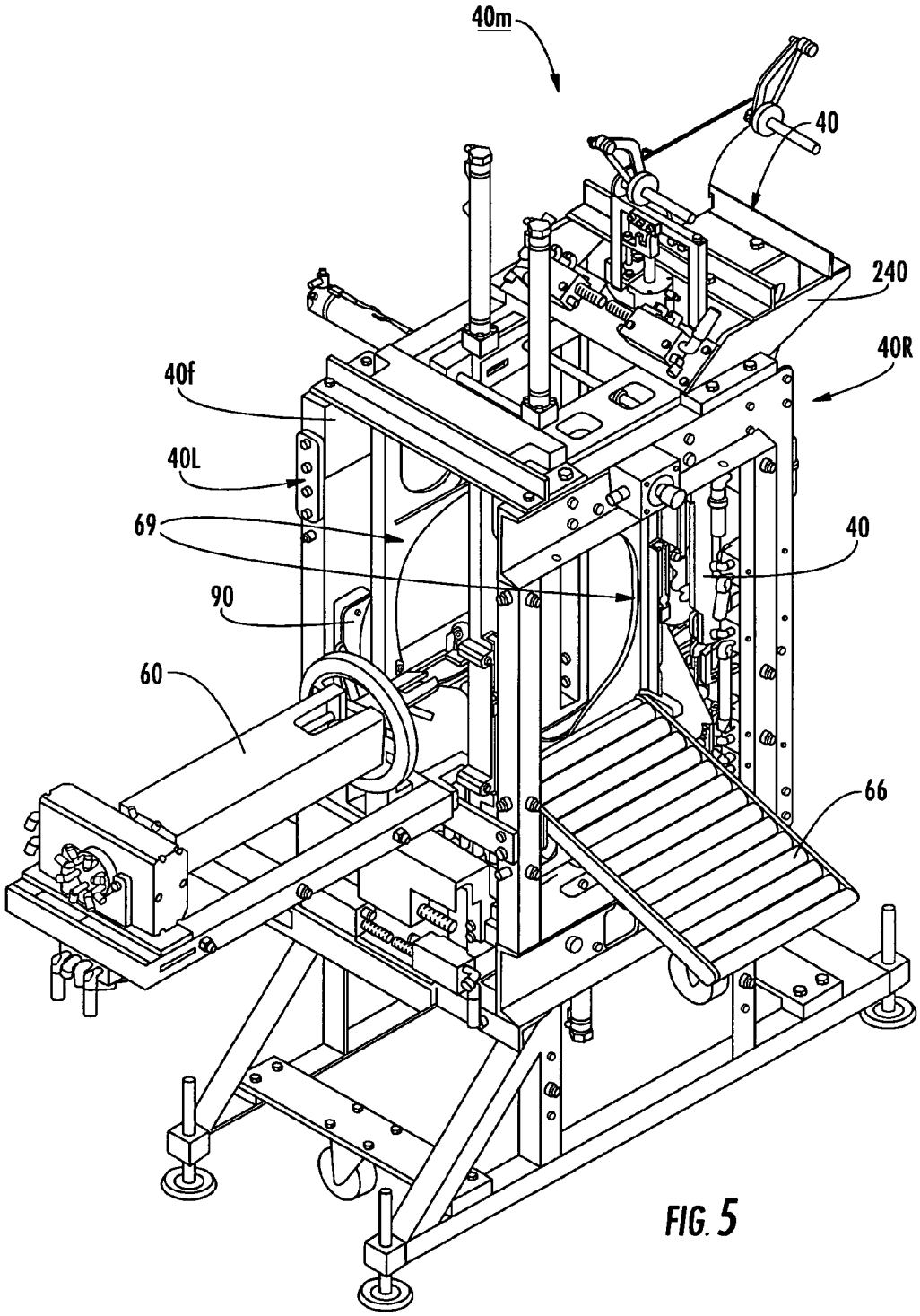
FIG. 5 is a perspective view of a clipper module having a handle maker module according to embodiments of the present invention.

FIGS. 3A-3E, 4 and 5 illustrate clipping modules 40*m*, 40*m*' with the housing guards 11 removed. It is noted that the clipper 40 may be referred to herein as a clipper apparatus, clipper module, clipper mechanism, and/or clipper assembly, but each term may be used interchangeably with the others. FIGS. 3A-3E and 4 show the module 40*m*' without a handle maker 60 and FIG. 5 shows the module 40*m* with a handle maker 60. FIGS. 3A-E also illustrates the clipper 40 mounted to a left side of the frame 40*f* and FIGS. 4 and 5 show the clipper 40 mounted to a right side of the frame 40*f*. Thus, the modules 40*m*, 40*m*' are configured with a frame 40*f* that allows the clipper 40 to mount to either the right or left hand sides 40R, 40L of the frame 40*f* and/or to allow the selective assembly of a handle maker 60 (as shown by the module 40*m* in FIG. 5) or not (shown by the module 40*m*' in FIGS. 3A-E). The right and left hand sides 40R, 40L of the frame 40*f* are defined with respect to the axial centerline location of the product primary travel path looking upstream, so that the right hand side 40R of the frame 40*f* extends from a generally medial position above and/or below the product travel path and rightward therefrom, while the left hand side 40L of the frame 40*f* extends from a generally medial position above and/or below the product travel path and leftward therefrom. Thus, it will be understood that the right side 40R of the frame 40*f* is not limited to the rightmost portion of the frame structure and the left side 40L of the frame 40*f* is not limited to the leftmost portion of the frame structure.

In some embodiments, as shown for example in FIG. 5, each clipper module 40*m* can include a clipper mechanism 40, a handle maker 60, a voiding mechanism 69 and a brake assembly 90. The modules 40*m*, 40*m*' may also include a printer module 150 with a printer platform 150*p* attached to the module frame 40*f* as shown in FIG. 1A. The clipper module 40*m* shown in FIGS. 3A and 4 includes different discharge trays 66 mounted to the frame 40*f*, the tray 66 shown in FIG. 3A having a ribbed floor with pivoting flaps $\mathbf{67}f_1$, $\mathbf{67}f_2$ (FIG. 11A) as will be discussed further below, and the tray 66 shown in FIG. 4 having rollers.

The voiding assembly 69 shown in FIGS. 3B-3D and 4 typically includes two spaced apart plates $\mathbf{69}p_1$, $\mathbf{69}p_2$ that cooperate to move together and apart to help gather and converge the covering material as it is pulled off the chute 30 and/or to void or purge (push) the product from the closure region of the covering material. Typically, the upstream voiding plate $\mathbf{69}p_1$ is stationary in the longitudinal direction and the downstream plate $\mathbf{69}p_2$ is configured to advance (the configuration shown in FIG. 3D illustrates the plates advanced together to a closed or closely spaced position) and retreat in the longitudinal direction (the configuration shown in FIGS. 4 and 5 illustrate the plates open or extended away from each other). Not all modules 40*m*, 40*m*' may require or need the voiding mechanism 69, handle maker 60, and/or brake assembly 90. In some embodiments, gathering plates configured on the clipper mechanism 40 and/or frame 40*f* may be used in lieu of and/or with a voiding mechanism 69 to gather the covering material for closure.

As described above, the apparatus 100 can include a brake assembly with brake gripping members 90 (FIG. 4). FIG. 4 illustrates the gripping members 90 are housed in the clipper modules 40*m*, 40*m*' and, in position, reside adjacent the sidewalls of the chute 30. The brake assembly can inhibit an excessive quantity of covering material from being pulled off the chute 30 during product insertion into the covering. The brake assembly may be particularly suitable for use with netting covering materials. In addition, the product covering can be held (stretched axially) to be relatively tight and substantially centered about the encased product. The tightness or tension of the covering material may be adjusted by varying the force that the gripper members 90 apply to the chute 30. Where a pneumatic cylinder is used to automatically operate the brakes, the force/tension adjustment can be carried out by adjusting the air pressure delivered to the cylinder. A pressure regulator for this operation may be disposed on the HMI 55 (FIG. 1).

When the handle maker 60 is not assembled, a generally planar upstanding housing sidewall 11*s* can be used to close the module 40*m* similar to the sidewall enclosing the clipper mechanism 40 as shown in FIG. 1A.

As with the clipper 40, in some embodiments, the handle maker 60 and frame 40*f* can also be configured to allow the handle maker 60 to mount to either the left or right hand side 40L, 40R, respectively, of the frame 40*f* (and primary product travel path) with their respective housing guards 11 (FIG. 1A) likewise mountable to either side.

Figure 14A:
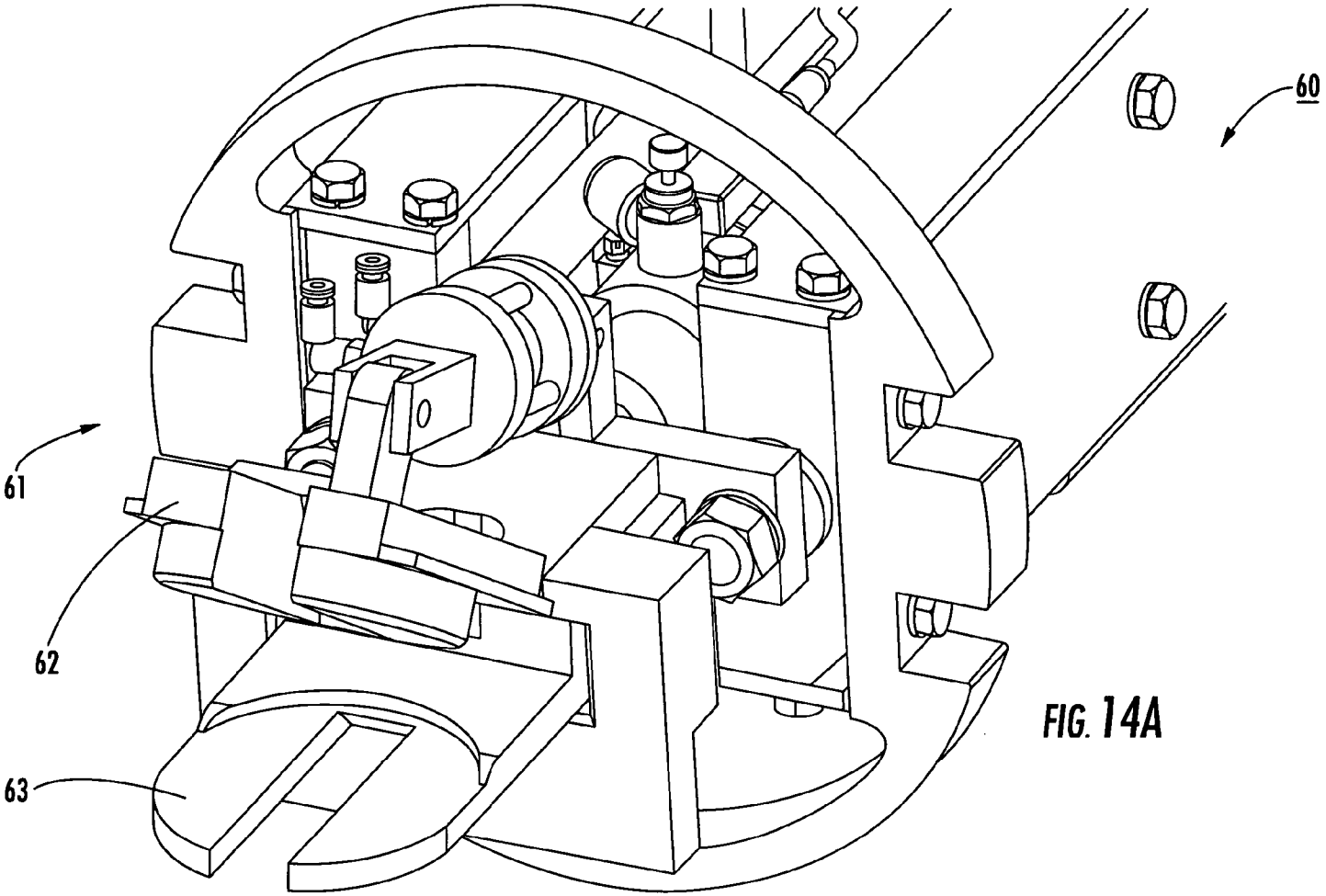
FIG. 14A is an enlarged perspective view of a forward portion of a handle maker according to certain embodiments of the present invention, illustrating the handle maker in an open ready configuration.
Figure 14B:
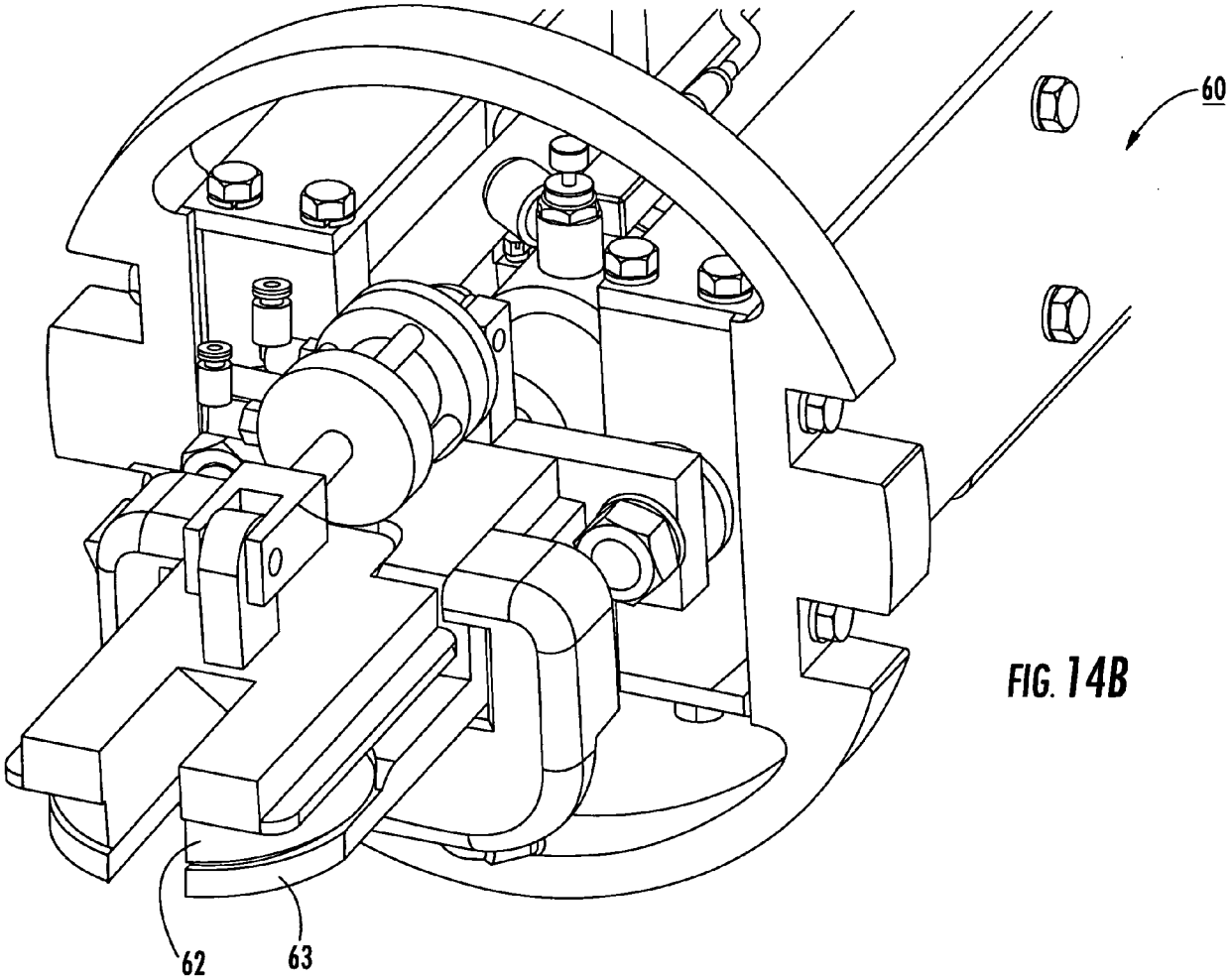
FIG. 14B is an enlarged perspective view of the portion of the handle maker shown in FIG. 14A, showing the handle maker in a closed configuration.
Figure 14C:
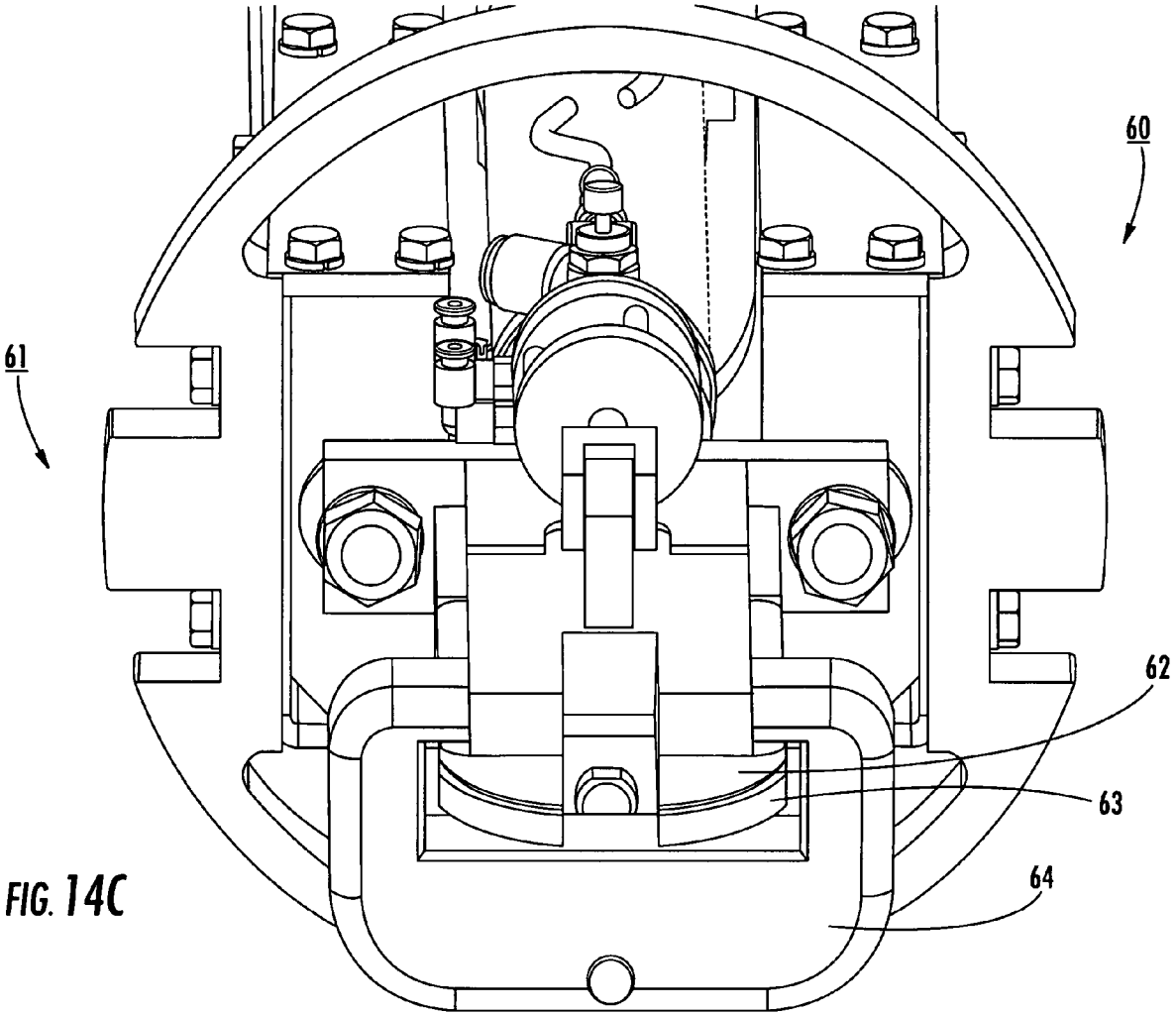
FIG. 14C is an enlarged perspective view of the portion of the handle maker shown in FIG. 14A, showing the netting-locking device in position over the closed configuration of the handle maker.
Figure 15:
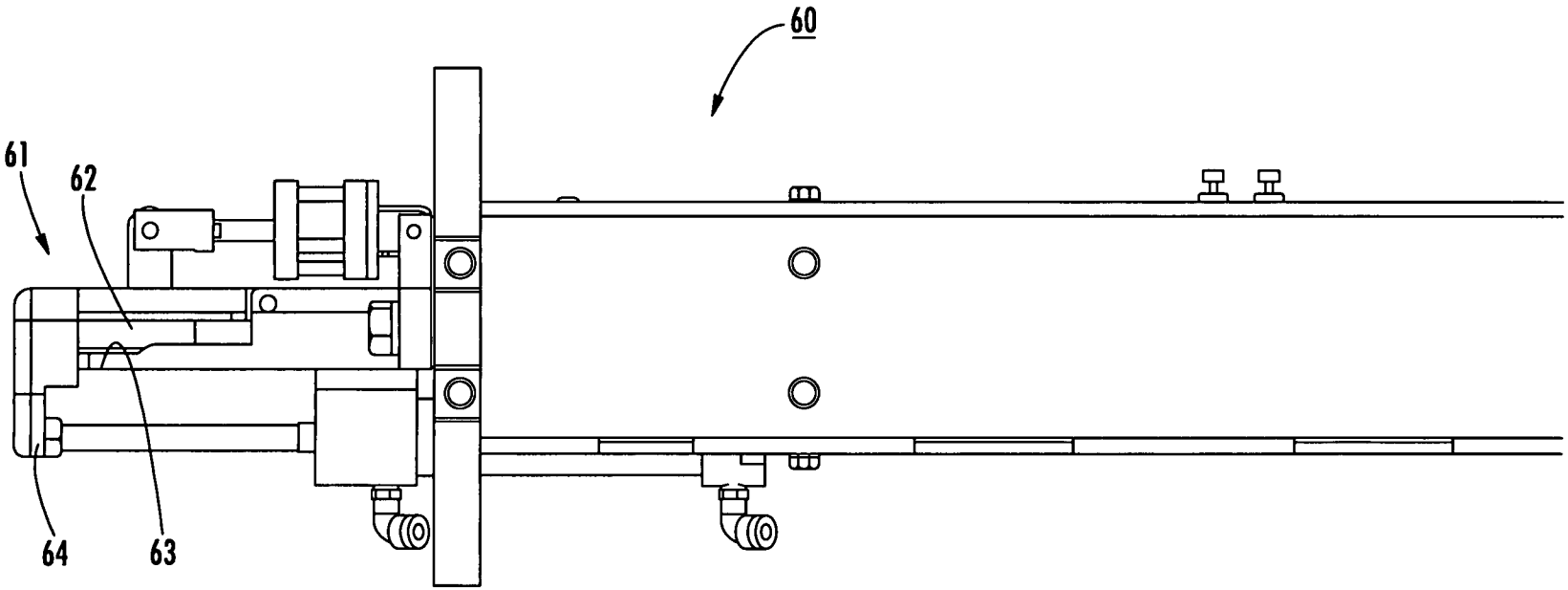
FIG. 15 is a side view of the handle maker illustrating the netting-locking device shown in FIG. 14C extended and in position over the forward portion of the handle maker.

Typically, the handle maker 60 (where used) will mount to a different opposing side of the frame 40*f* from the clipper 40. An example of a suitable handle-maker is described in U.S. Pat. No. 6,729,102, the contents of which are hereby incorporated by reference as if recited in full herein. The handle maker 60 is configured to automatically form a handle on (typically from) the covering material as the product exits the chute 30. FIGS. 14A-14C illustrate an example of an automated handle maker 60 in different operational configurations. FIG. 14A illustrates a forward portion 61 of the handle maker 60 with an upper forward member 62 and lower forward member 63 open in a "ready" configuration. FIG. 14B illustrates the two members 62, 63 closed against each other in a closed operative position. In operation, covering, such as netting, is trapped and/or pinched between the two closed members 62, 63. FIGS. 14C and 14D illustrate a locking device 64 extended and clamping the two closed members together 62, 63. In operation, the locked members cooperate and form the handle in the covering (netting). See also, co-assigned, co-pending U.S. Provisional Patent Application identified by Attorney Docket No. 9389-18PR, the contents of which are hereby incorporated by reference as if recited in full herein.

The frame 40*f* can have pre-formed apertures, brackets, alignment indicia and/or other structures or members that can allow the clipper 40 and/or handle maker 60 to mount to the desired side of the frame 40*f* without requiring specialized individual frame modifications or brackets for a particular customer. For example, the clipper mechanism 40 can be an assembly with a mounting bracket configuration that can be interchangeably mounted to either side of the frame 40*f* and still clip at a substantially common location in the product path. The handle maker 60 with the bracket 160 (FIG. 1A) and the printer module 150 with the support bracket 150*b* and mounting platform 150*p* (FIG. 1A) can be similarly configured to allow mounting to either side of the frame 40*f* while providing the desired functional alignment. Thus, in some embodiments, the frame 40*f* and the clipper 40 and/or handle maker 60 as well as the printer module 150 can be modular so as to be assembled to the desired side of the frame during manufacturing assembly to be able to provide several build options to meet a customer's order without customizing each component for each customer. This will allow a decrease in labor, less single-purpose inventory, and/or faster build cycles. For example, a modular frame 40*f* may have additional apertures over specific use frames. Unused apertures may be sealed, filled or closed for sanitary reasons, such as with fasteners or plugs.

Figure 6A:
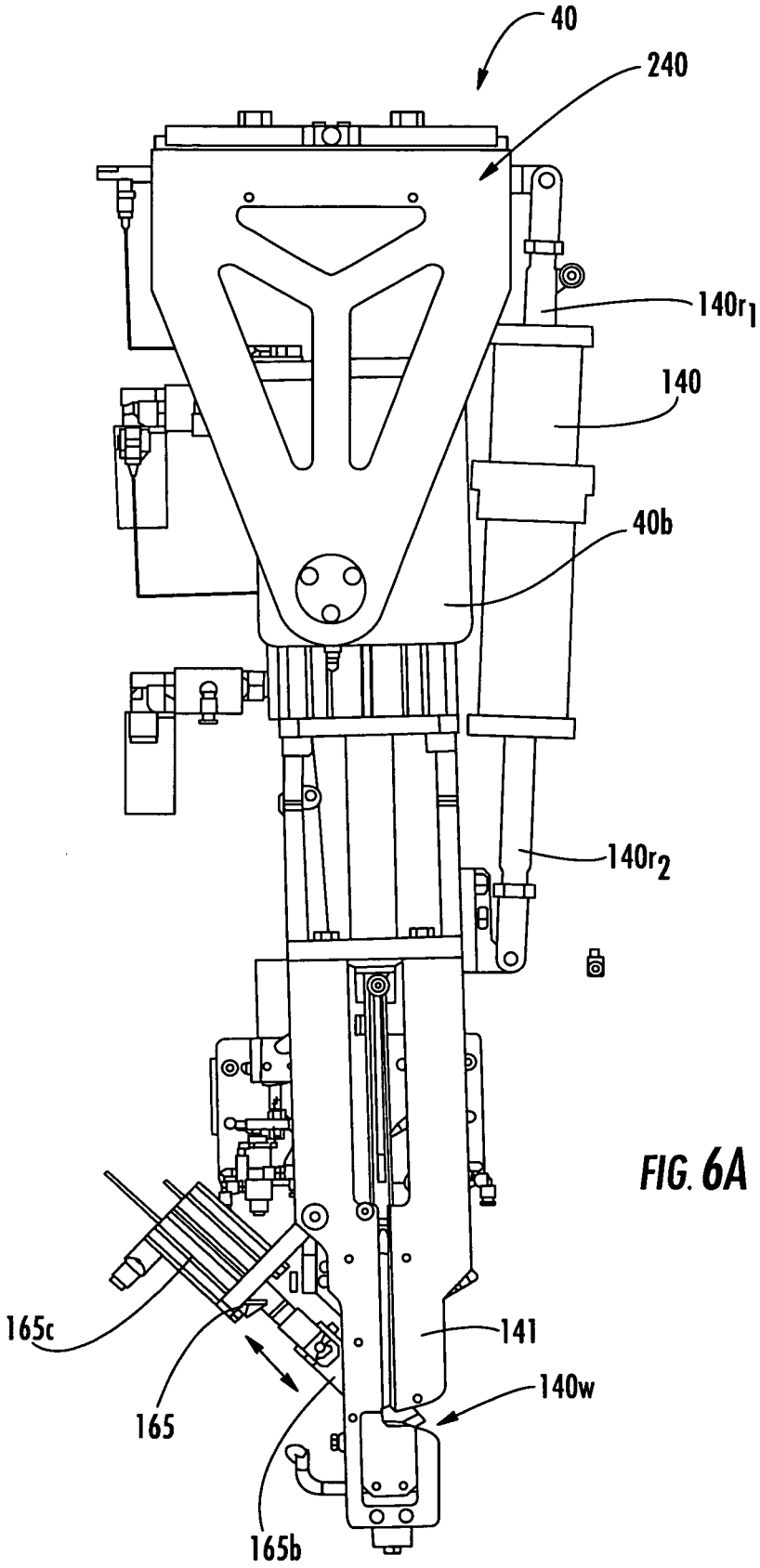
FIG. 6A is a side view of a clipper mechanism shown with the device in a home configuration.

The clipper 40 will typically mount to a top portion of the frame 40*f* in a manner that allows the clipper 40 to dynamically retract and advance into clipping position as discussed above. For example, as shown in FIGS. 3A and 6A, the clipper 40 is mounted to an upper portion of the left hand side of the frame 40*f* using a coupler member 240. In operation, the clipper 40 moves inward to a desired clip location. The coupler member 240 can alternatively be assembled to the upper portion of the left hand side of the frame 40*f* allowing the clipper 40 to move inward to substantially the same operative location. In any event, the modules 40*m*, 40*m*' are arranged to align with the chute 30 such that the discharge end portion of the product chute 30*d* terminates proximate the clipper 40. The modules 40*m*, 40*m*' are configured to hold the clipper 40 so that the clip window 140*w* (FIG. 8) can be generally axially aligned with a desired axial location of the product travel path in the full clip position, typically generally at the axial centerline of the chute 30, irrespective of whether the clipper 40 is mounted to the right or left hand side of the frame 40*f*.

In any event, the modules 40*m*, 40*m*' can be configured to align with the chute 30 such that the discharge end portion of the product chute 30*d* terminates proximate the clipper 40 with minimal adjustment. The modules 40*m*, 40*m*' are configured to hold the clipper 40 so that the clip window can be axially aligned with a desired axial location of the product travel path in the full clip position, typically substantially aligned with the axial centerline of the chute 30, irrespective of whether the clipper 40 is mounted to the right or left hand side of the frame 40*f*.

As shown, in FIG. 3A the clipper 40 can be pivotably mounted at a pivot 40*p* to the modular frame 40*f* and sized and configured to automatically and controllably actuate (via a pneumatic or fluid cylinder) to advance into a clipping position after the product is in position downstream thereof, then clip the covering material and retract to await to clip the next covering material for the next enclosed product. The clipper 40 may operate in response to data from a proximity sensor that is positioned to detect when a product is ready for clipping and provide the data to a controller or processor. The proximity sensor may be positioned at any suitable place to indicate when the product is in-position. The proximity sensor can be an optical sensor (infrared, photosensor, or the like), a Hall-Effect sensor, a magnetic sensor, an inductive sensor, and/or any other suitable sensor. The clipper 40 can be attached to a clipper rotation rotary actuator 140 that can control the movement of the clipper 40 during use as shown in FIGS. 6A-6C, 7 and 8. The clipper mechanism 40 actuator can include a two-stroke actuation cylinder 140 as shown in FIGS. 6A-6C, 7 and 8 that controllably and serially advances the clipper mechanism 40 from the first (home) position, to the second (pre-clip) position, and the third (full clip) position, then back to the pre-clip or first (home) position.

In some embodiments, the clipper mechanism 40 can operate with an automatic stroke cycle that comprises three dwell positions: a first retracted home position; a second pre-clip position; and a third clipping ("full-clip") position. When in the home position, the clipper body is retracted out of the product travel path as shown in FIG. 6A, typically pivoted outward to a generally upright configuration. In the third full-clip position, as shown in FIG. 6C, the clipper travels inward and is generally angled with the clip window disposed in the product travel path, typically so that the clip window is generally aligned with the axial centerline of the product chute 30 (not shown). FIG. 6A illustrates the clipper 40 in a generally upright "home" position and FIG. 6C illustrates the clipper 40 pivoted inward to an angled "full-clip" position (typically cooperating with other clipping components so that the voider mechanism 69 plates (FIG. 3D) are separated and closed in preparation of the clip being applied to the gathered covering (netting)).

Figure 6B:
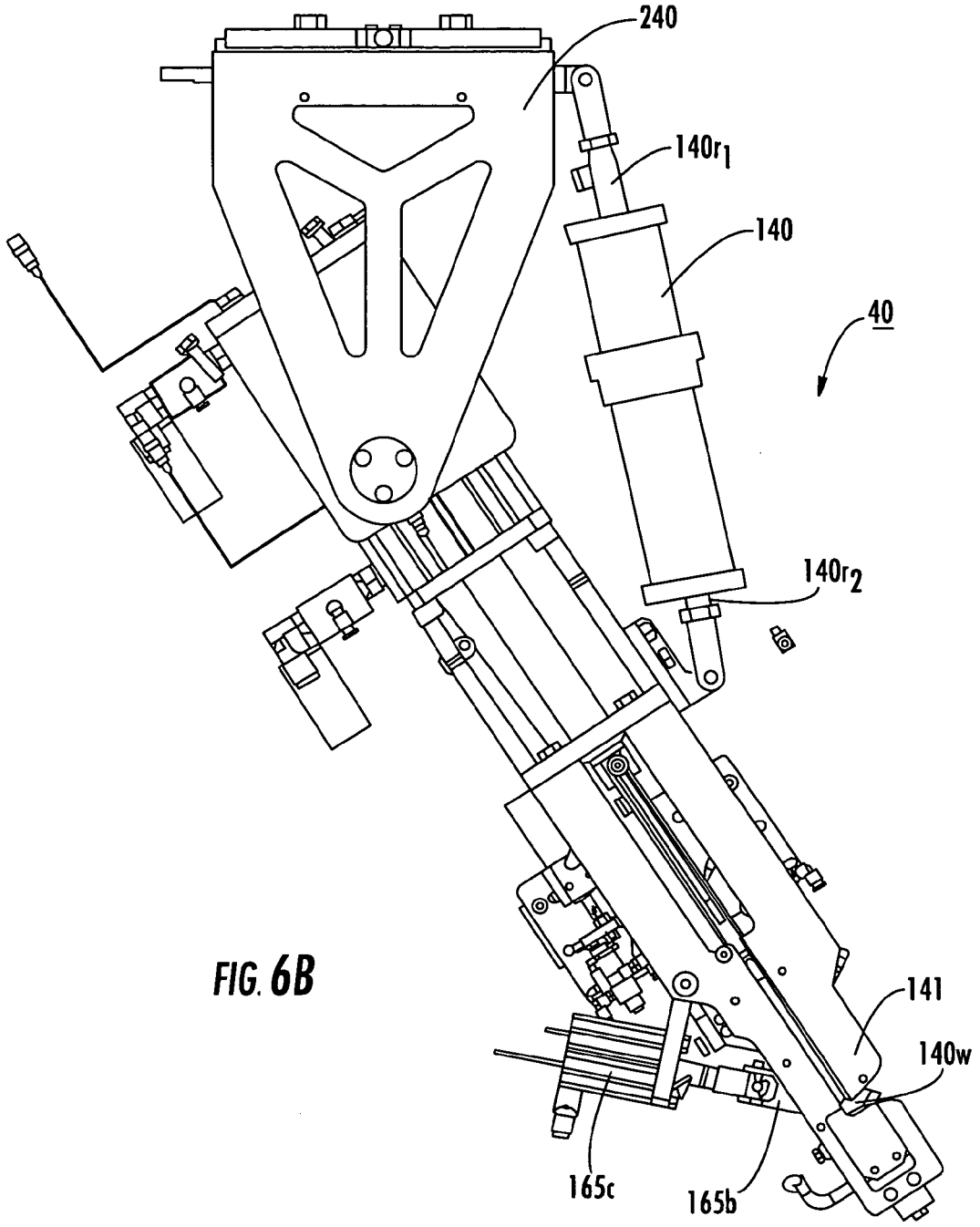
FIG. 6B is a side view of the device shown in FIG. 6B, shown with the device in a staged pre-clip configuration according to certain embodiments of the present invention.
Figure 6C:
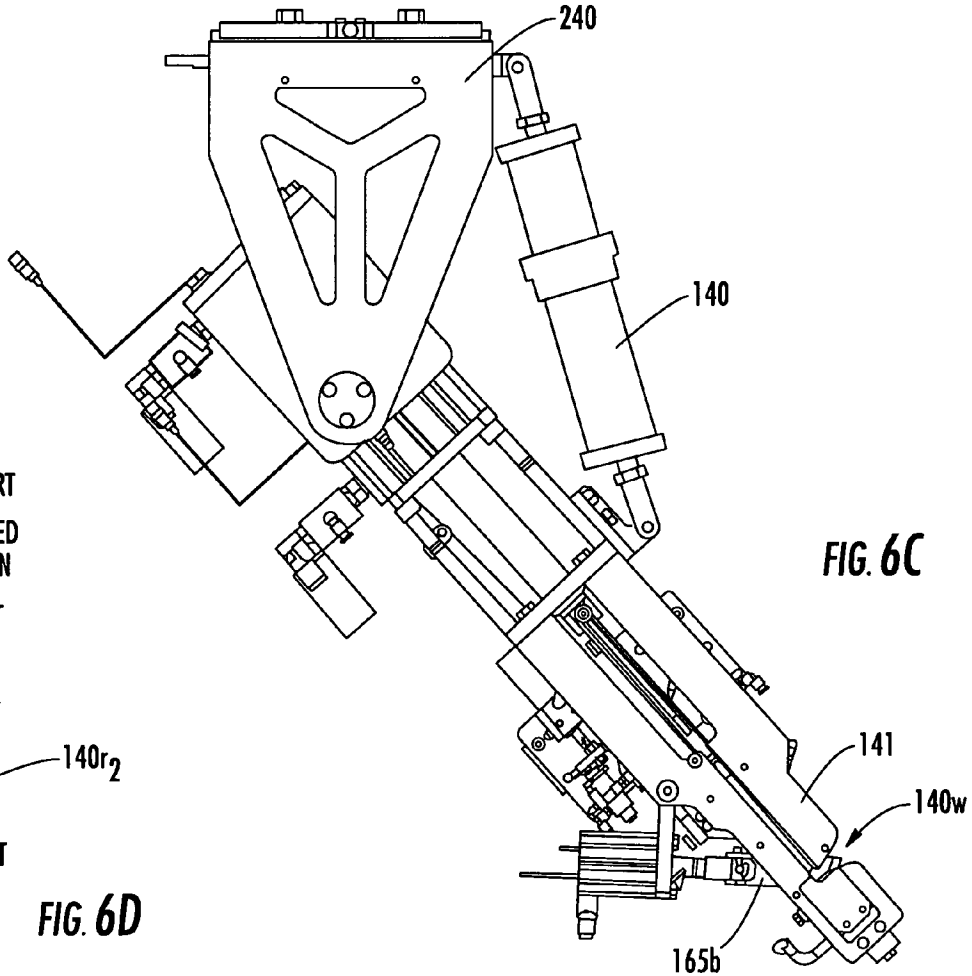
FIG. 6C is a side view of the device shown in FIG. 6A, shown with the device in a full-clip position.
Figure 6D:
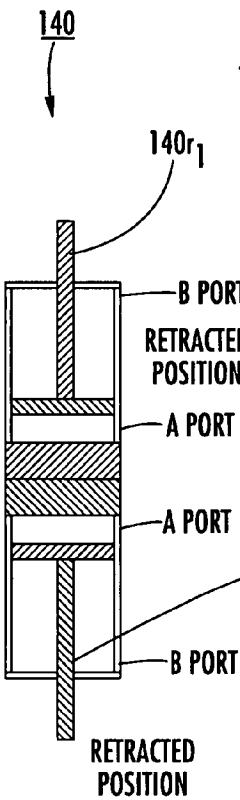
FIG. 6D is a schematic section view of an integrated double two-stage cylinder used in the clipper mechanism shown in FIGS. 6A-6C according to embodiments of the present invention.

In certain embodiments, as shown in FIGS. 6A-6D, the clipper 40 includes an integrated double two stroke cylinder 140 with upper and lower cylinder rods $140r_1$, $140r_2$. FIG. 6D schematically illustrates both rods $140r_1$, $140r_2$ in a retracted configuration with the cylinder heads facing each other across the respective stroke chambers. The stroke length of the upper rod $140r_1$ may be shorter than the stroke length of the lower rod $140r_2$. As shown in FIG. 6A, the lower rod $140r_2$ extends a greater distance than the upper rod $140r_1$ in the home position. In the full clip position, both cylinder rods $140r_1$, $140r_2$ can be in a retracted position as shown in FIGS. 6C and 6D. FIG. 6B illustrates the clipper in a pre-clip or intermediate dwell position with the upper rod $140r_1$ extended and the lower rod $140r_2$ retracted. The lower rod $140r_2$ can be extended a greater distance than the upper rod $140r_1$ at the home configuration as shown in FIG. 6A.

In certain embodiments, the second position of the clipper mechanism 40 can be at least 50% of the stroke distance between the first and third clipper mechanism positions, typically at about 75% of the stroke distance. The travel from the first home to the second pre-clip position can be carried out as the product is exiting the product chute 30 to save the cycle time that it would take to clip the product while waiting for the clipper to travel the full "home to clip" position cycle. For example, where a handle maker 60 is used (the handle maker being an optional device and/or operation and may reside upstream of the clipper), the clipper mechanism 40 can advance from the home to the pre-clip second position during the handle-making operation. It is noted that the dwell times in each position can be different. The home dwell time may have the longest duration in any stroke cycle.

Additional description of examples of components used in packaging apparatus can be found in co-pending, co-assigned U.S. applications identified by Attorney Docket Nos. 9389-3PR, 9389-16PR and 9389-17PR, the contents of which are hereby incorporated by reference as if recited in full herein.

The apparatus 100 may include a sensor positioned proximate the receiving end of the product chute 30. The sensor can be configured to confirm that the product chute 30 is in operative position. An exemplary sensor is a two-part magnetic switch 31; one part can be positioned on a mounting bracket attached to a chute bracket and the other part held on a mounting frame. When the two matable parts of the switch engage, the chute 30 is determined to be in proper position. Other types and/or additional sensors may also be used as suitable as is known to those of skill in the art.

A controller/processor (such as a Programmable Logic Controller) may be configured to monitor a signal from this sensor and deactivate certain components whenever a product chute 30 position-error is noted at any time during the process. The signal can be automatically monitored through a Safety Circuit Module. If the product chute 30 is missing or out of position, the apparatus 100 can be held in a low energy state that removes power to air supplies and controls to inhibit machine operation. To reinitiate the procedure, an operator may press a restart or reset button. In certain embodiments, the clipper 40 may be operated on override even when the chute 30 is absent. Once the product chute 30 is in location and the stop is reset, power air can be applied to the machine control valves and electric power can be applied to the control (PLC) outputs. After the PLC confirms the operative positions of the components (such as the clipper 40, the product holding member and the like) an automatic reset can be performed and those components automatically moved to a respective home position as needed.

The HMI 55 can include an input display screen, an emergency stop button, a reset button and a clipper only activation button. The HMI can also include a pressure regulator for corresponding gages. The pressure regulators can be for the retractable product holding member on a discharge tray (which may be described as a product clamp bar), and/or one for a retractable brake system 90 (FIG. 4), typically used to selectively apply brake pressure to the covering material proximate the discharge end portion of the product chute 30.

The apparatus 100 may be configured to allow the clipper 40 to operate irrespective of the upstream devices using the "clipper only" push button instead of the apparatus-start push button. Alternatively, the modules 40*m*, 40*m*' can-be stand-alone devices that operate the clipper 40. The HMI 55 and/or modules 40*m*, 40*m*' can also include an emergency stop 56 (FIG. 1A) and reset pushbutton or other type of switch as shown.

FIGS. 6A-6C and 7 illustrate one example of a clipper mechanism 40 assembly which employs a cutting mechanism 165 that cuts or severs with a generally downward and/or lateral stroke. FIG. 8 illustrates a clipper mechanism 40 with a cutting mechanism 165' that cuts or severs with a generally upward stroke. In any event, the clipper 40 can include a coupler member 240 that is a hanger with a pivot attachment that allows the clipper body 40*b* to pivot as discussed above. The hanger coupler 240 can be supported on an upper portion of the frame 40*f* (such as by two trunnion-type arms as shown) to pivotally mount the clipper to the frame 40*f* as shown in FIG. 3A. The clipper 40 can include a curvilinear clip rail or channel 41 that is in communication with the clip window 140*w* to automatically supply clips to the underlying covering material. The clipper 40 may be particularly suitable for clipping netting but may be used for other materials as well. The clipper 40 can be configured to attach to the coupling member 240 to suspend the clipper from the frame 40*f* as shown for example in FIG. 3A.

Figure 7:
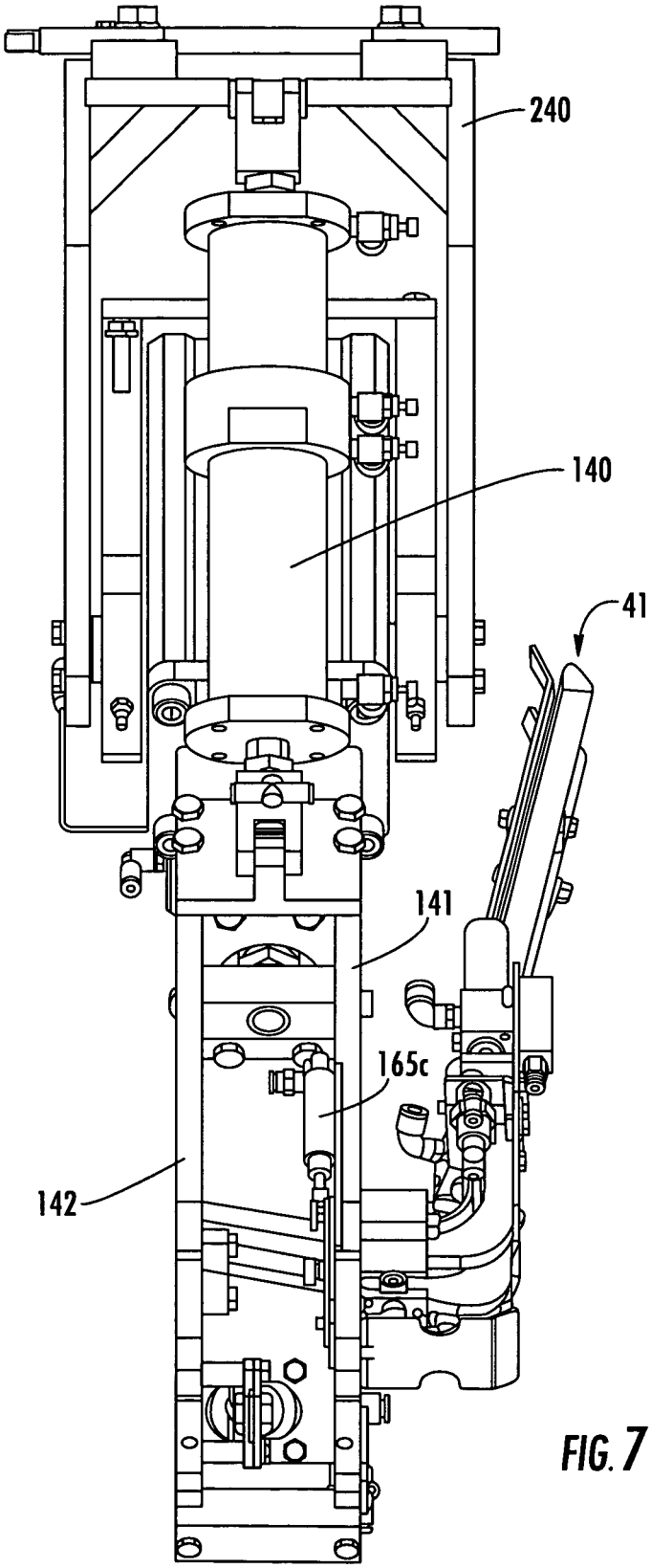
FIG. 7 is a front view of the clipper mechanism shown in FIG. 6C, with the device in the full-clip position.
Figure 8:
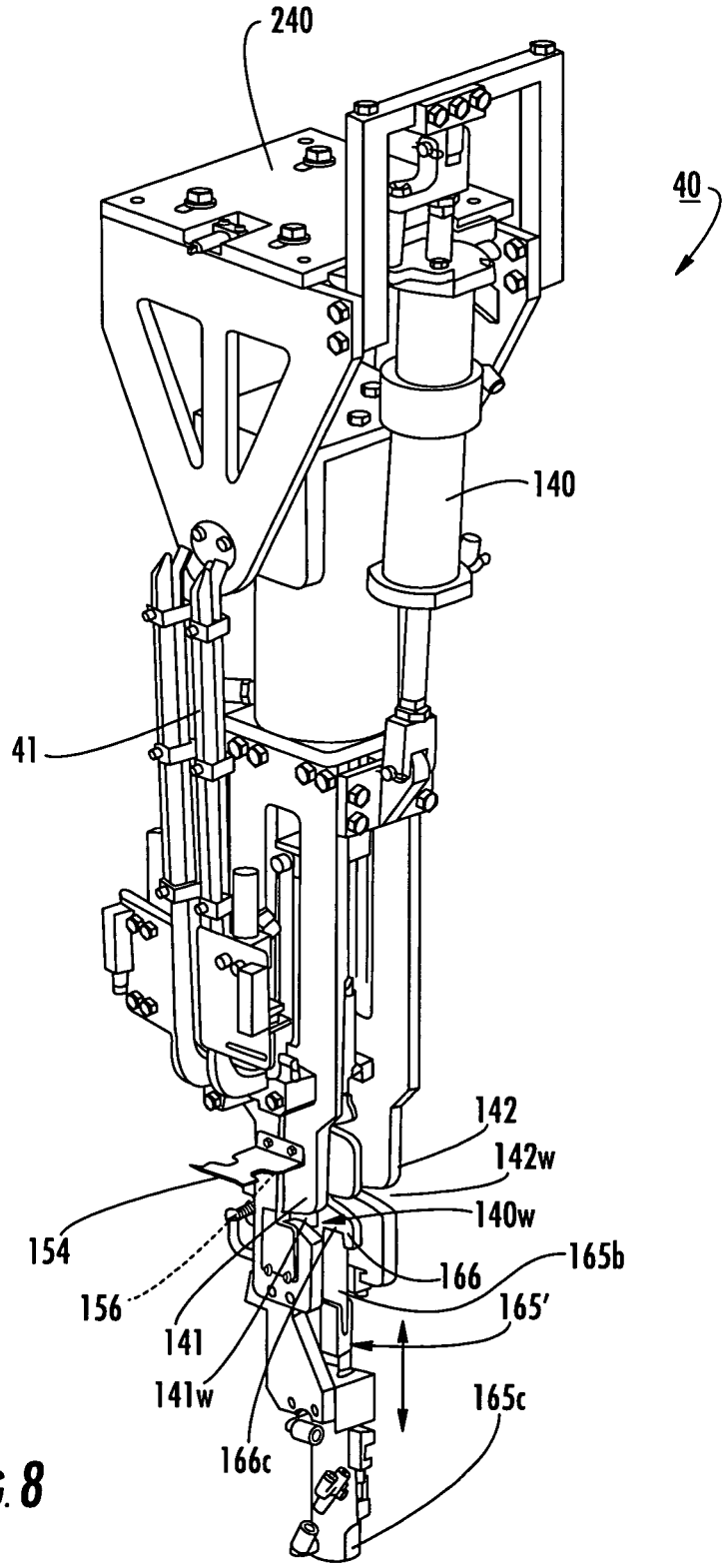
FIG. 8 is a perspective view of the clipper mechanism shown in FIG. 6A, but with an alternative cutting member configuration.

As is well known to those of skill in the art, in operation, with reference to FIGS. 7 and 8, the clipper 40 defines a closure/clip delivery path using a clip rail 41 in communication with the clip window 140*w* in a clip channel for receipt of a U-shaped metal clip. The clip is advanced in the closure path or channel by means of a punch so that the clip will engage a die positioned in a manner permitting the clip to be formed about gathered material that encases the product in the material at a closure zone in the product travel path. Although not illustrated, pressurized air or other means of pressing or moving the clip to close about the tubular package may also be used. As shown, the guide rail 41 can have a curvilinear configuration with a vertical run which is curved at its lower end so that it gradually merges into a horizontal run to direct clips mounted thereon into the window 140*w*. The clips are typically arranged in a stack with adjacent clips abutting each other so that the legs of each clip fit around the guide rail with a crown of each clip fitting over the guide rail. The multiple clips may be connected to one another by means of a thin elastomeric film, tape or adhesive (typically along the crown) so that the clips together may slide down the guide rail and around the bend therein between the vertical and horizontal runs of the guide rail. Typically, clips are provided in a coil or on a reel for feeding onto the guide rail. Although illustrated herein as a generally vertical and downwardly directed clip feed, other feed orientations may also be employed.

As shown in FIGS. 6A-6C, 7 and 8, the clipper 40 can include a cutting member 165, 165' mounted to a lower portion of the clipper body. The cutting member 165 shown in FIGS. 6A-6C and 7 is configured to cut with a downward or lateral stroke, i.e., from the top down or side to side in the embodiment shown in FIGS. 6A-6C. The cutting member 165' shown in FIG. 8 is configured to cut with an upward stroke, from the bottom up. The cutting member 165, 165' can be configured to move in concert with the clipper 40 as the clipper 40 moves to its home and full clip position (and, where used, to the pre-clip position). As shown, gathering plates 141 and 142 can be mounted to the lower portion of the clipper 40 with the clip window 140*w* therebetween. When the clipper 40 is in its full-clip position, the cutting member 165 is disposed above and/or to the side of the gathered netting for the embodiment in FIG. 6A and generally vertically oriented and disposed under for the embodiment in FIG. 8, the gathering plate windows 141*w*, 142*w*, respectively. The cutting member 165, 165' can then sever the gathered and typically clipped or otherwise closed/sealed covering about the package. The cutting member 165, 165' can be in communication with an actuator 165*c* that automatically extends the cutting member blade 165*b* into the cutting position and retracts the cutting member 165, 165'.

Figure 9:
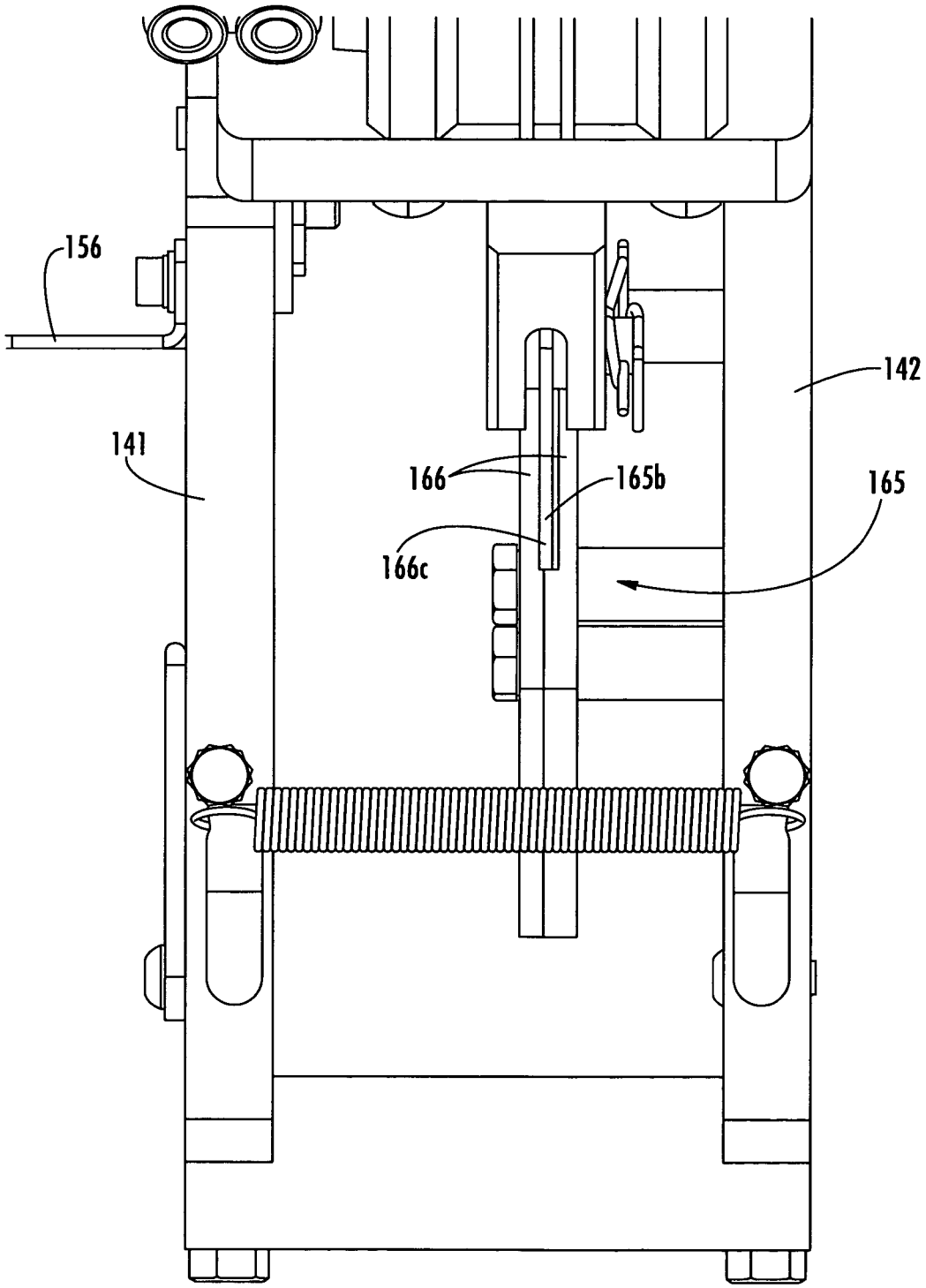
FIG. 9 is an enlarged rear view of the clipper mechanism and cutting member assembly shown in FIG. 6A.

As shown in FIGS. 8 and 9, the cutting member blade 165*b* can reside in a guide 166 having a channel 166*c* and, in operation, slidably travel in the cutting guide channel 166*c*. The guide 166 can be aligned with the gathering plates 141, 142, typically disposed axially intermediate thereof and can be attached to the clipper 40. The guide 166 can be a separate component from the gathering plates. In other embodiments, the guide 166 may be formed into or onto a gathering plate (not shown). Typically, the guide 166 is disposed proximate but upstream of the clipping location, at least where a single clip is applied. Where two spaced-apart clips are applied to the gathered covering, the guide 166 can be held intermediate the two clip locations to provide the desired cut location.

One long edge portion of the cutting member 165, 165' can be retained in the cutting guide channel 166*c* as the cutting member 165, 165' travels across the guide window 165*w* into the extended cutting, shearing and/or severing position. Where used, this positive retention of the cutting member 165, 165' may provide additional alignment stability in some applications. The cutting member 165 can comprise a generally planar blade 165*b* with a leading angled knife-edge portion. Other cutting configurations can be used including, but not limited to, heat (of whatever type), water, pressure, and other knife and/or blade shapes, as well as combinations thereof. Accordingly, the term "cutting" as used herein is used broadly to mean separating and/or severing adjacent portions of covering material and is not limited to physically cutting with a sharp implement.

In addition, it is noted that the present invention is not limited to the cutting operations described. Other cutting mechanisms can be used, for example, hot-knife devices as described in U.S. Pat. Nos. 4,683,700 and 5,161,347, the contents of which are hereby incorporated by reference as if recited in full herein.

As shown in FIGS. 6A-6C and 7-9, The clipper 40 can include a plurality of spaced apart plates 141, 142 that may be configured to automatically gather a portion of the tubular or sleeve of covering material (held in tension) to form the material into a rope-like and/or compressed configuration in preparation for receiving the clip(s) thereabout. In operation, plates 141-142 and/or voider plates $\mathbf{69}p_1$, $\mathbf{69}p_2$ (FIG. 3D) are configured to gather or compress the covering material that extends between the clipper 40 and the product chute discharge end portion. Pairs of cooperating plates can be positioned across the product travel path to retractably travel toward each other, substantially orthogonal to the direction of product travel, to gather the covering material therebetween. See co-pending, co-assigned U.S. Provisional Patent Application Ser. No. 60/508,609 for additional description, the contents of which have been incorporated by reference hereinabove. As shown, the plates 141, 142 may be mounted to the clipper 40 and can be described as clipper gathering plates (and may also be called die supports by those of skill in the art). That is the gathering plates can hold the die that forms a clip(s) onto the wrapped product using a punch. In some embodiments, the plates 141, 142, guide 166 and cutting member 165, 165' are mounted to the body of the clipper 40 (i.e., clipper gathering plates) to all move in concert therewith from the home to the full-clip position. As the clipper 40 is rotated into position, the clipper gathering plates 141, 142 automatically start the gathering operation. In certain embodiments, the modules 40*m*, 40*m'* can include additional gathering plates that are positioned on the opposing side of the travel path and which may be configured to laterally linearly translate into and out of operative position. In certain embodiments, each gathering plate can be mounted so that in operative position they are horizontally and vertically aligned with the corresponding centerlines of the product chute cavity.

In operation, once the covering material is gathered, a clip or clips can be applied to secure the encased product in the covering material. The covering material can then be severed to release the encased product in the clipped package. In certain embodiments, two clips are applied substantially concurrently proximate to each other using a dual clipper so that one clip closes the trailing edge of the covering material forming a first encased package and the other closes a leading edge of the covering material forming the next encased package. The clipped configuration of the covering material encasing the product may be configured to substantially conform to the shape of the enclosed product(s) or may be more loosely configured.

Figure 10D:
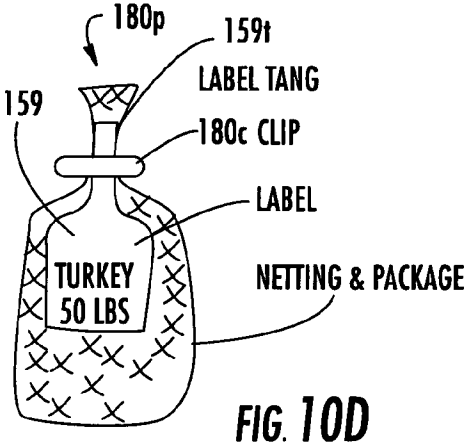
FIG. 10D is a schematic front view of a clipped product with a printed label provided by the printer module shown in FIG. 10A according to embodiments of the present invention.
Figure 10A:
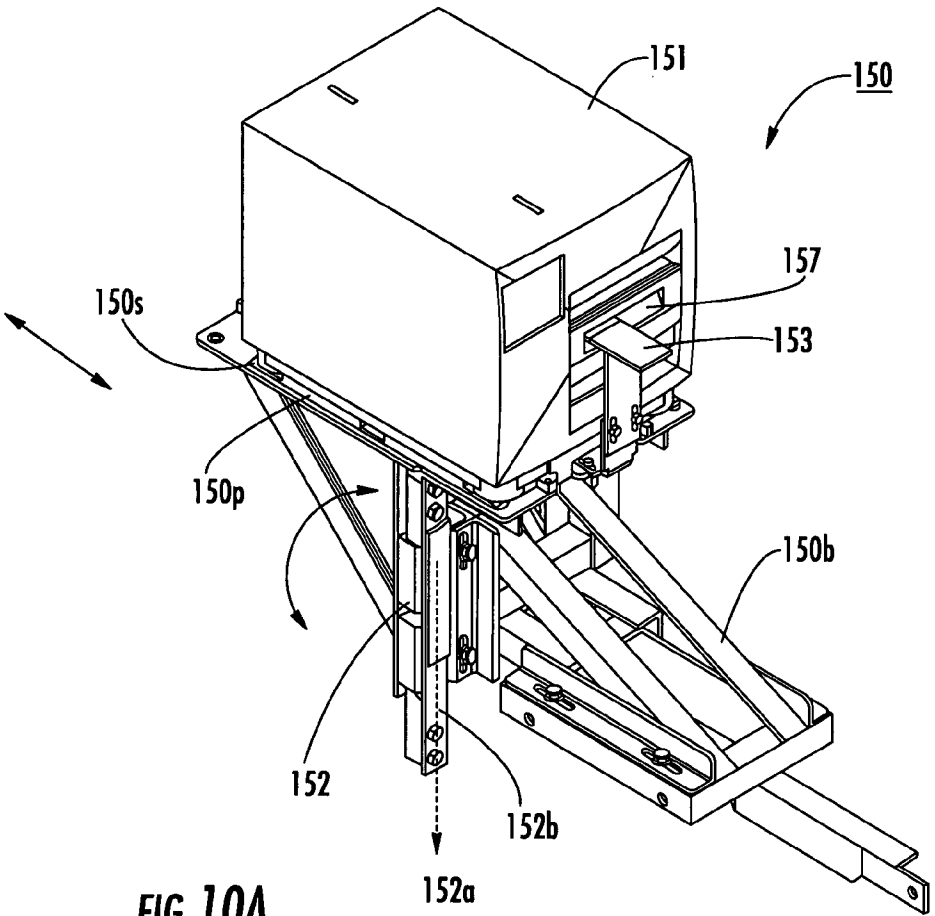
FIG. 10A is a perspective view of a printer module according to embodiments of the present invention.

FIGS. 10A-10G illustrate a printer assembly 150. Referring to FIG. 10A, as shown, the printer assembly 150 includes a printer bracket 150*b* and a support platform 150*p* that holds the printer 151. The printer bracket 150*b* can mount to the clipper frame 40*f*. The printer assembly 150 can be a module that can be optionally used with the apparatus 100, 100'. As shown in FIG. 10A, the printer assembly 150 is configured to print labels (that may include the weight of the product as measured by the scale 125 (FIG. 1A)) and supply the printed labels from a printer output port 157 to a tag feed guide member 153. FIG. 10D illustrates an example of a packaged product 180*p* with a label 159 attached by a clip 180*c* applied by the clipper 40 (FIG. 8). The label 159 (also called a tag) is generally planar and can include a label tang 159*t* as shown in FIG. 10D. The labels 159 are typically supplied as a continuous roll 159*r* (FIG. 10E) with perforations 159*p* between adjacent labels.

Figure 10B:
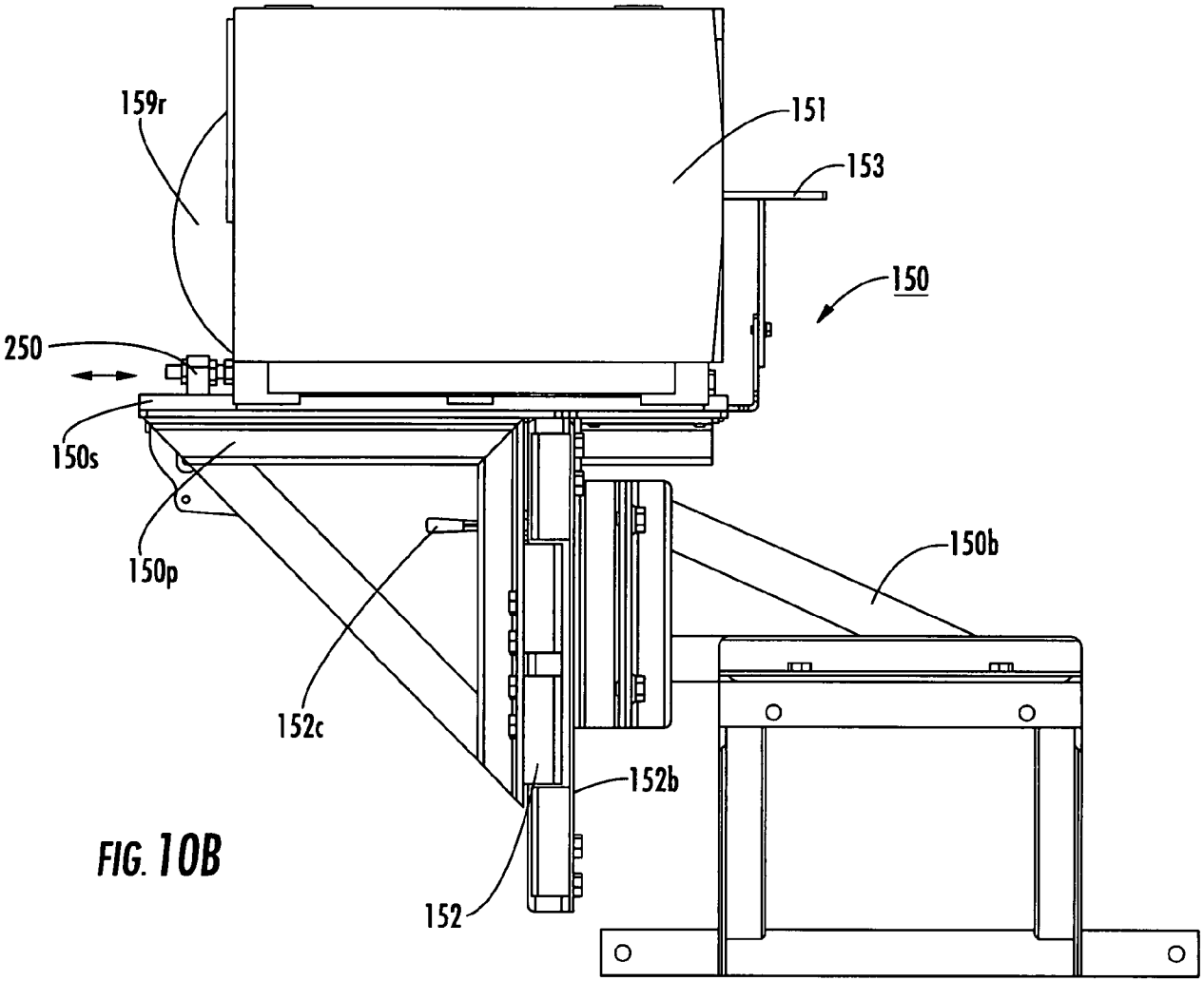
FIG. 10B is a front view of the device shown in FIG. 10A.
Figure 10C:
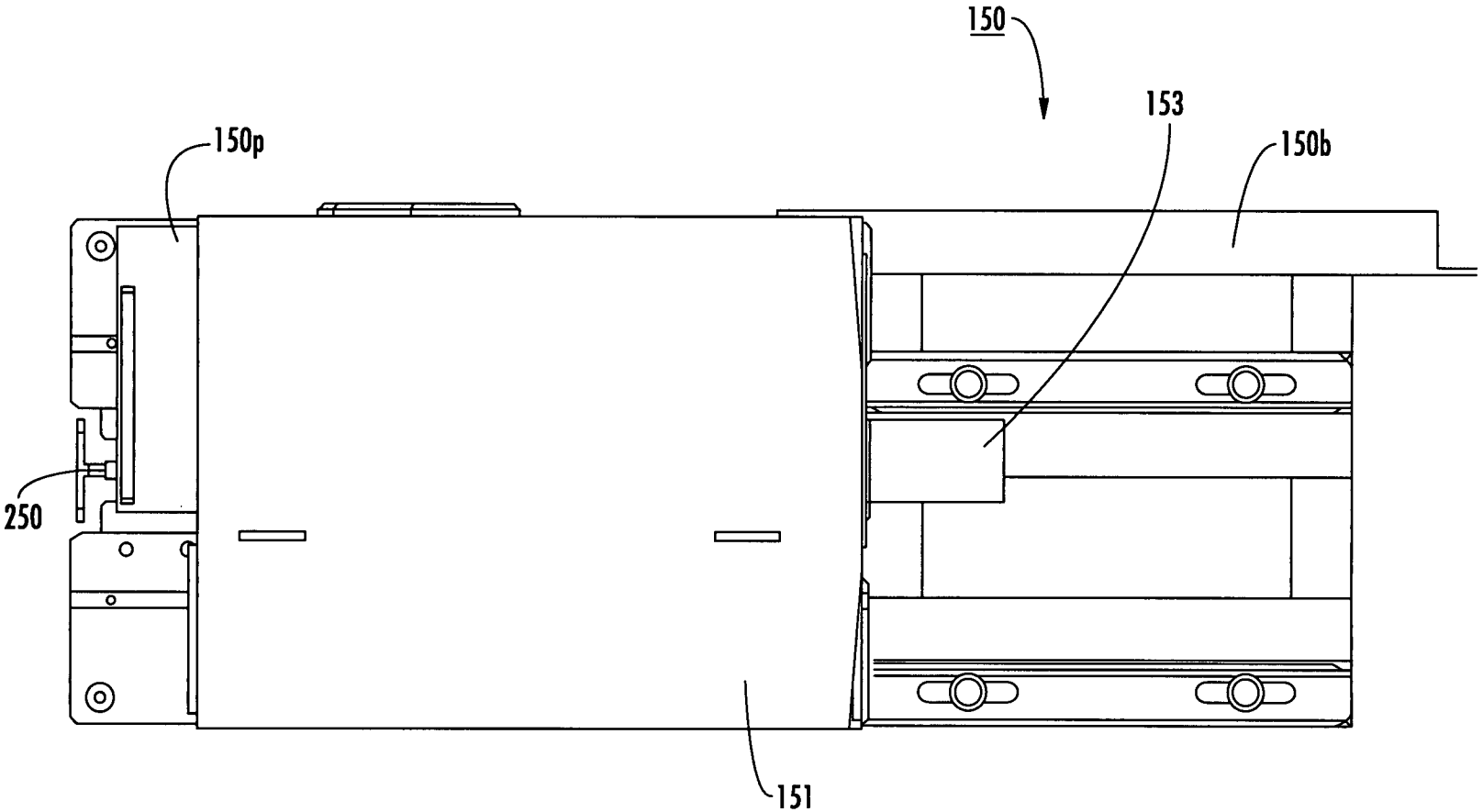
FIG. 10C is a top view of the device shown in FIG. 10A.
Figure 10E:
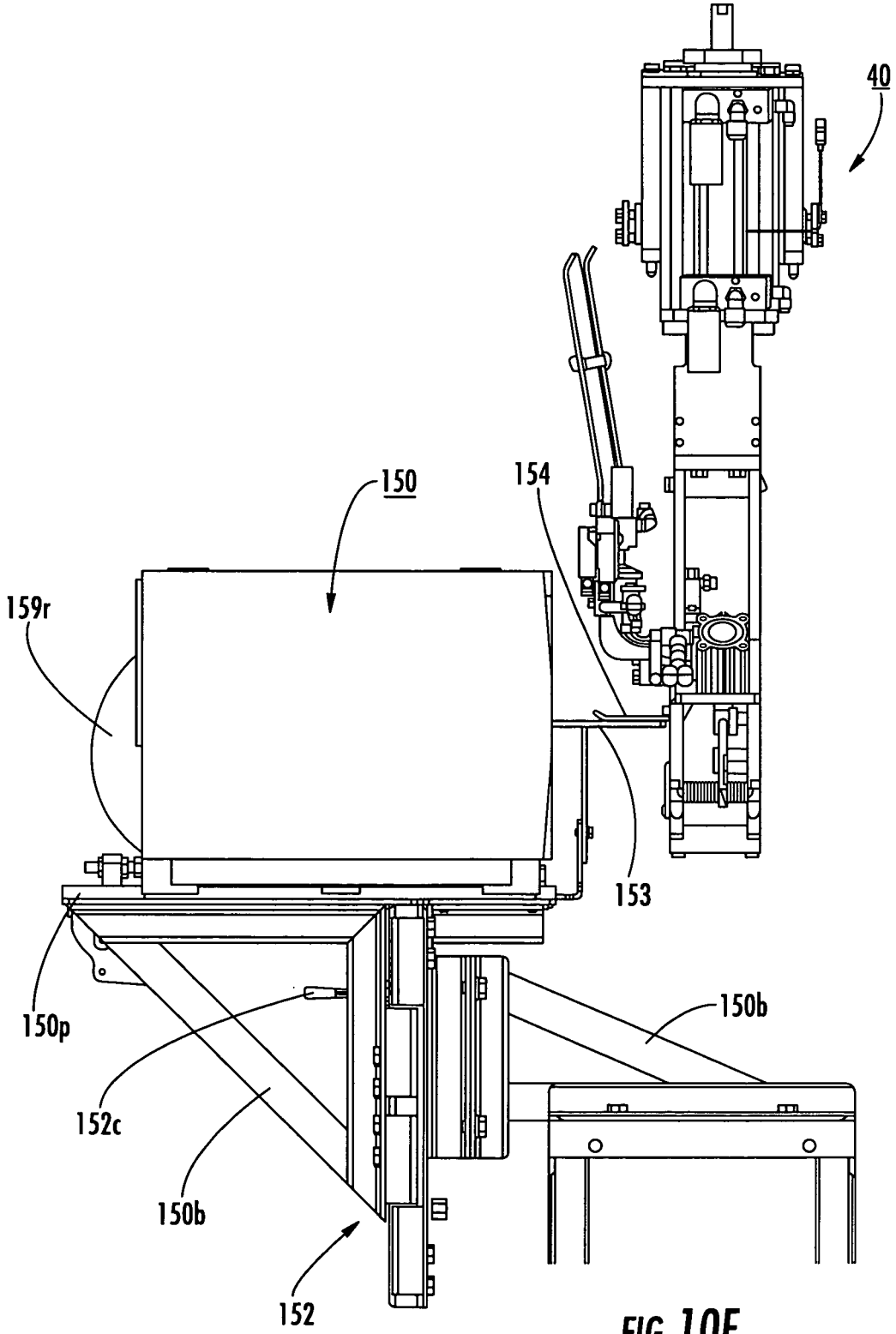
FIG. 10E is a side view of the printer module shown in FIG. 10A illustrating the printer module in position relative to a clipper according to embodiments of the present invention.
Figure 10F:
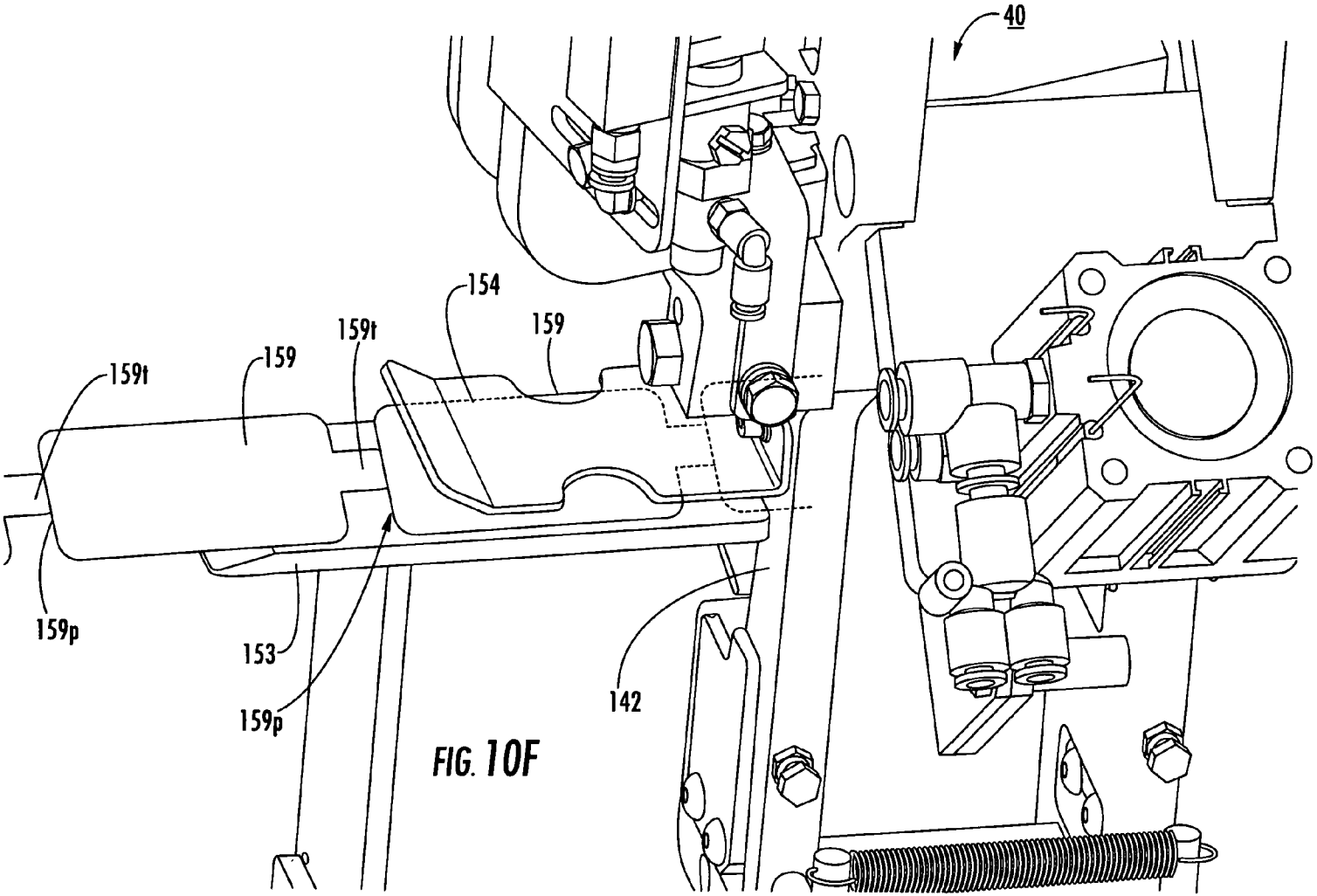
FIG. 10F is an enlarged perspective view of a portion of the clipper and printer modules shown in FIG. 10E according to embodiments of the present invention.

In position, as shown in FIG. 10E, the guide member 153 is aligned with a label feed plate 154 held on the body of the clipper 40. As shown in FIG. 10F, the guide member 153 and label feed plate 154 are configured to trap the labels 159 therebetween in a manner that allows the labels 159 to be pulled through a feed window 156 in the clipper body (FIGS. 10G, 10H), then applied onto the wrapped product with a clip. Thus, relatively precise alignment of the printer output port 157 with the feed window 156 can be desired in certain applications.

Figure 10G:
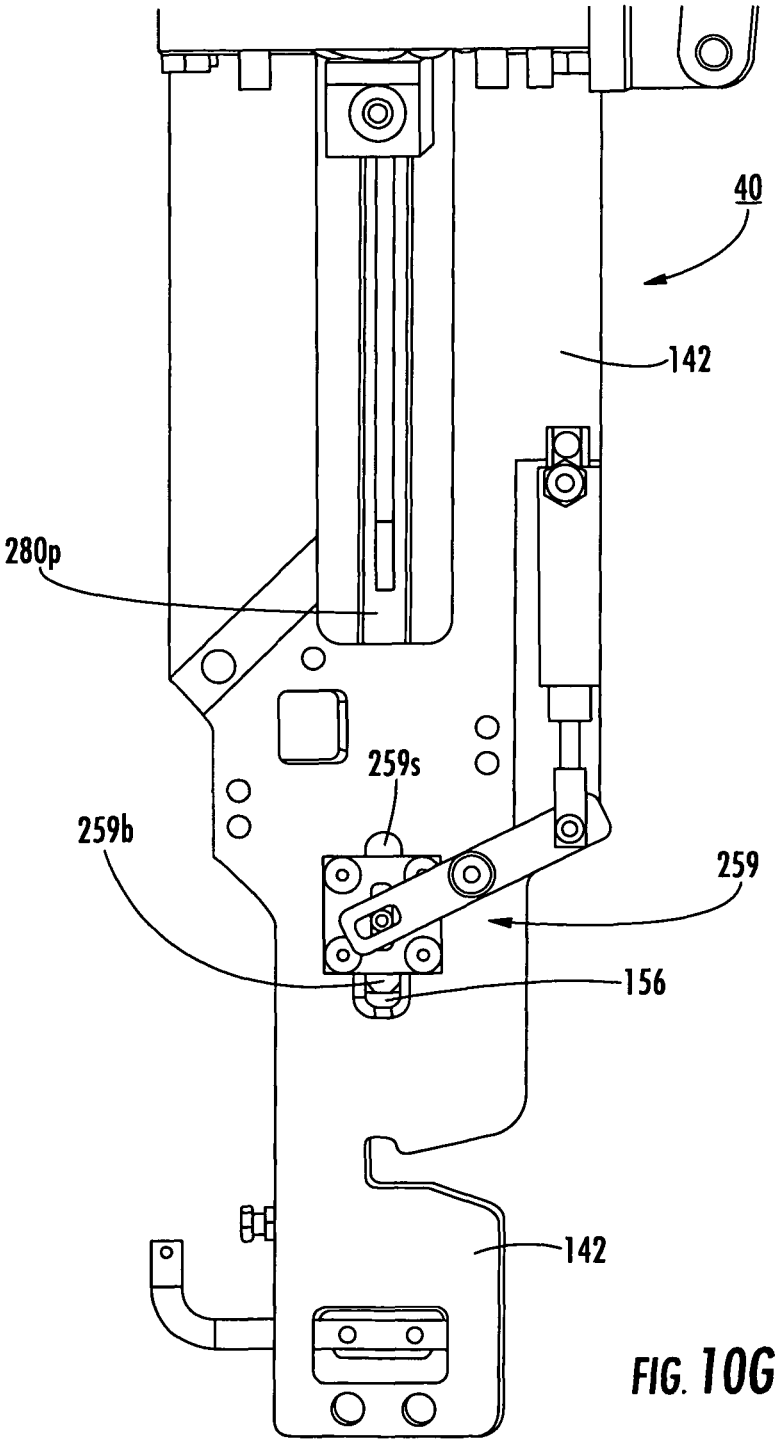
FIG. 10G is a side view of a die support with label window in a clipper body such as that show in FIG. 10F according to embodiments of the present invention.
Figure 10H:
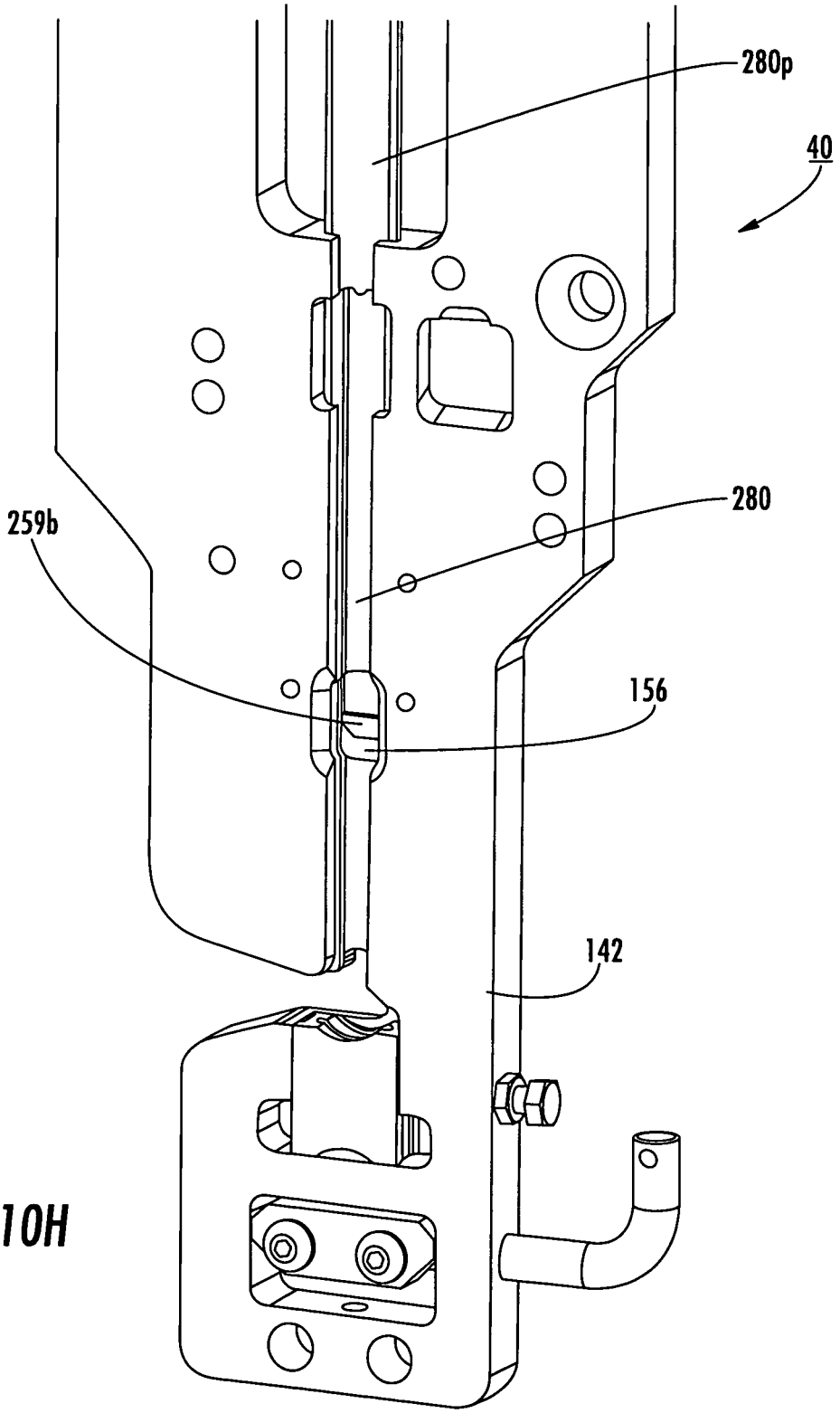
FIG. 10H is an opposing side view of the die support and label window shown in FIG. 10G.

FIGS. 10G and 10H illustrate the label feed window 156 through which a label tang 159*t* extends. A label clamp mechanism 259 is held on the inside of the plate 142 (the die support) above the label window 156 and clamps the tang 159*t* of the label. The clamp mechanism 259 can include a clamp bar 259*b* that travels up and down in a slot 259*s* (FIG. 10G) in the plate 142 or die support and forms a portion of the window 156. The mechanism 259 may be configured as a simple Scotch-yoke mechanism. When the clipper 40 is in the home position as shown in FIG. 10E, the tang of the label 159*t* is fed through the window 156 and the clamp 259 holds the forward section of the label tight to the clipper body. As the clipper 40 advances to a pre-clip or full-clip position, the label is torn at the leading perforation, separating the label that is trapped in the window 156 from the other labels. As a clip travels down through the clip channel 280, driven by punch 280*p* (FIG. 10H), the clip 180*c* (FIG. 10D) contacts the label tang 159*t* and forces the tang 159*t* down the clip channel 280 in front of the clip 180*c* thereby attaching the label 159 to the product as the clip 180*c* closes about the product. The tang 159*t* is bent and does not pull out from under the clip. The channel 280 can include a relief on the hook side of the punch configured to inhibit the tang 159*t* on the hook side of the punch from being caught between the hook side of the punch and the die support.

In certain embodiments, the printer assembly 150 also includes a slide plate 150*s* that allows the printer 151 to slide away from its operative mounting position to allow an operator easier external access to replace consumable items (such as labels, ink and the like) and to slide back into the desired position providing increased "automatic" realignment.

As shown in FIG. 10A, the printer bracket 150*b* can include an external pivot attachment 152 with a generally vertical pivot axis 152*a* that allows the printer 151 to pivot laterally outward away from the product travel path, then pivot back into the desired axial location. The pivot attachment can include a pivot bracket 152*b* and a pivot lock clamp 152*c*. The pivot lock clamp 152*c* can be disengaged and/or released to allow the printer platform 150 to pivot. Thus, the printer platform 150*p* can pivot out away from the axial centerline of the product flow path and slide away from the bracket 150*b* to provide easier access to the printer 151. To re-position, an operator can then reverse the operations, e.g., slide the printer 151 (on plate 150*s*) back into location on the bracket 150*b* and pivot the platform 150*p* back into position (and lock the pivot lock clamp 152*c*) to thereby automatically realign to a desired operative position reducing the need for operator alignment adjustment.

FIG. 10B also illustrates that a stop clamp 250 can be used to position the printer 151 and/or plate 150*s* in a repeatable location with respect to the clipper 40. The stop clamp 250 can travel back and forth as illustrated by the arrow between two (typically fixed) positions.

In some embodiments, as discussed generally above, the modules 40*m*, 40*m*' can include a product-holding member (i.e., a product clamp) that can automatically be moved into position by actuating a clamp drive cylinder, thereby blocking or trapping the product to inhibit same from moving further downstream as noted above. One example of a product holding member is shown in FIGS. 11A-11E, 12 and 13. In this embodiment, the tray 66 includes laterally spaced apart elongate slots 68 with flap members 67$f_1$, 67$f_2$, that can move in a respective slot 68 to move upstream and pivot inwardly together to trap the product. The slots 68 can be configured to slidably receive a respective generally downwardly extending leg 167 that is configured to pivot the respective flap 67$f_1$, 67$f_2$. In operation, the leg members 167 automatically advance and retract in the respective slots 68 to thereby position the flaps at longitudinally adjustable distances and the flaps 67$f_1$, 67$f_2$ pivot inward and outward to trap and release the product. As shown, the tray 66 may also comprise two laterally spaced apart longitudinally extending support ribs 170$_1$, 170$_2$.

Figure 11A:
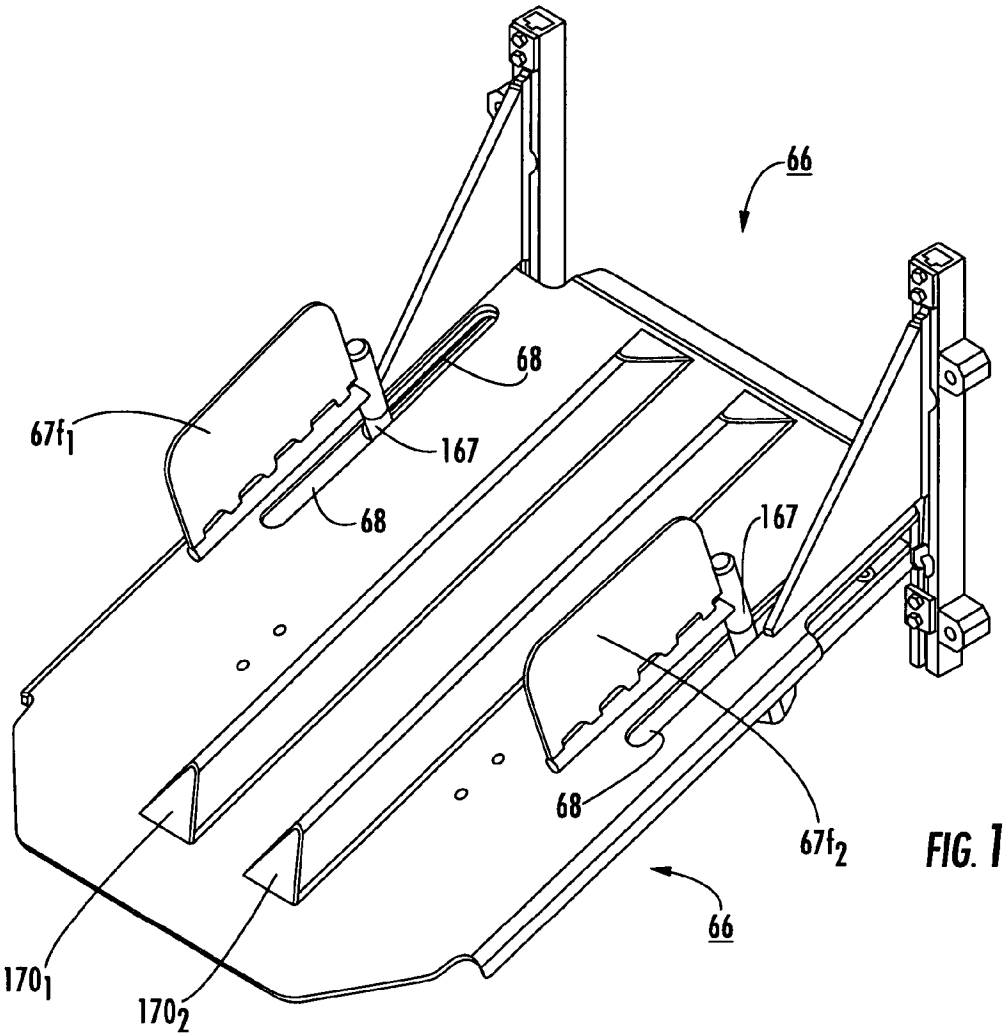
FIG. 11A is a perspective view of a discharge tray illustrating flap members in a home position according to embodiments of the present invention.
Figure 11B:
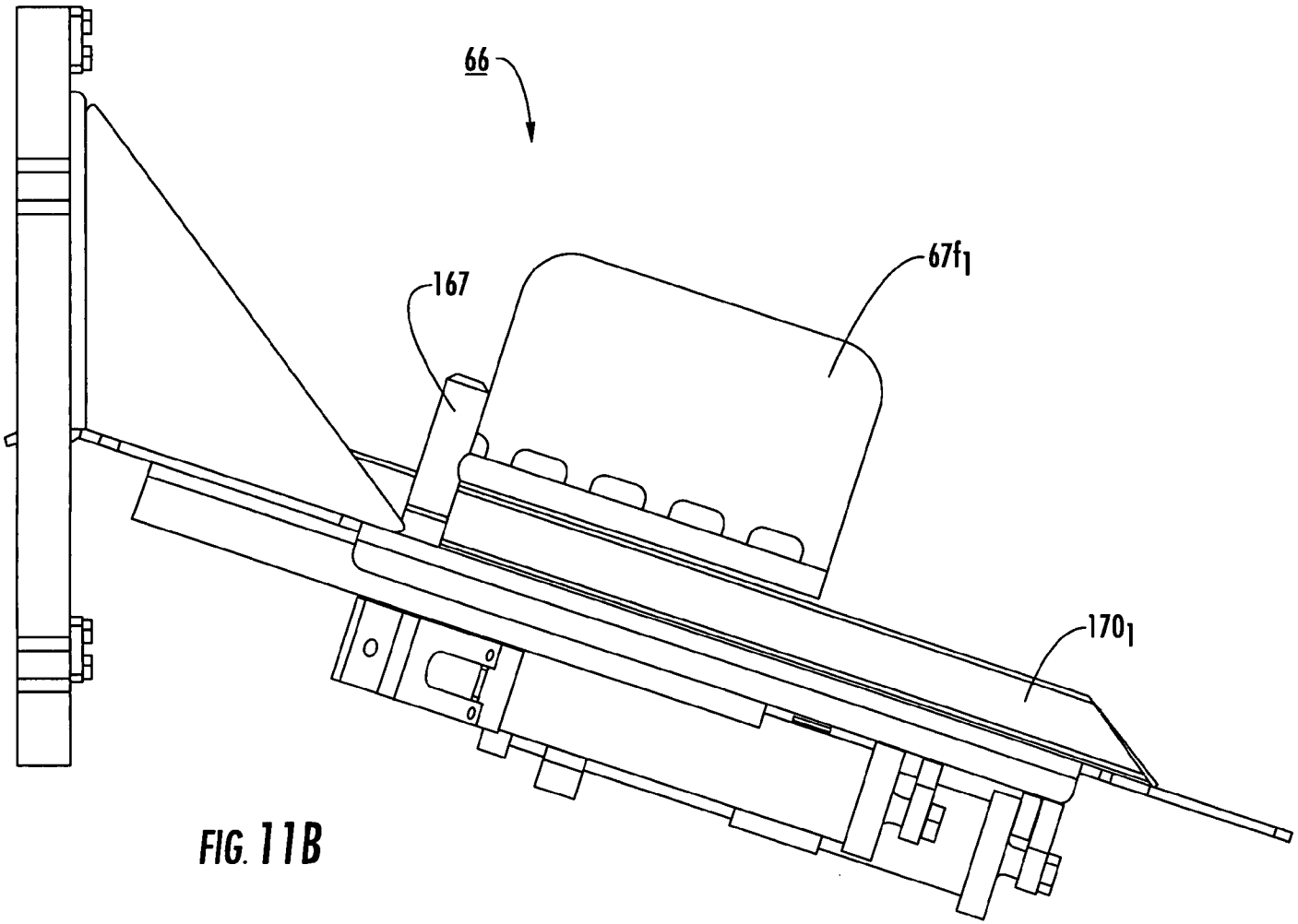
FIG. 11B is a front view of the device shown in FIG. 11A with the flap members in the home position.
Figure 11C:
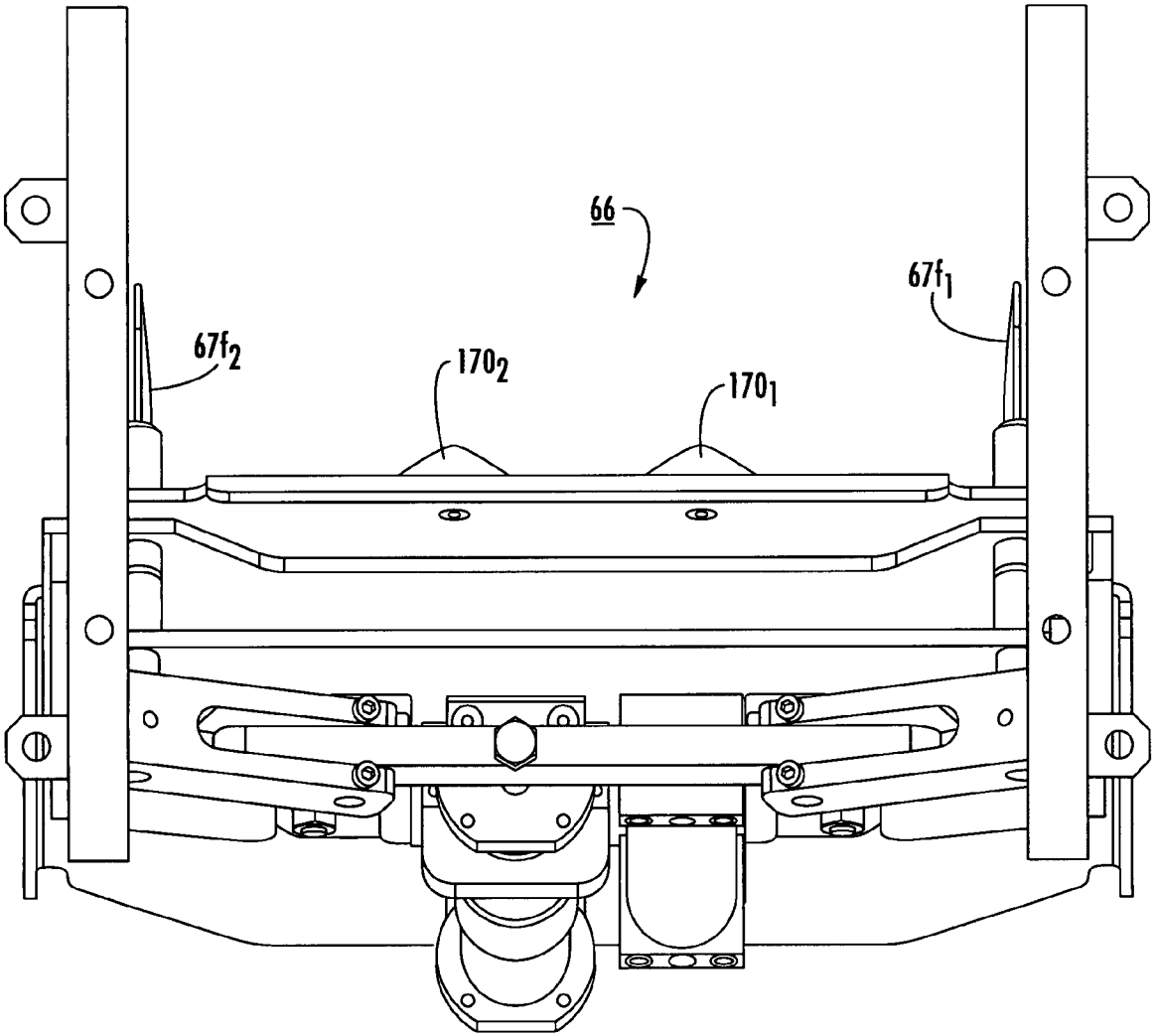
FIG. 11C is a side view (downstream looking upstream) of the device shown in FIG. 11A with the flap members in the home position.
Figure 11D:
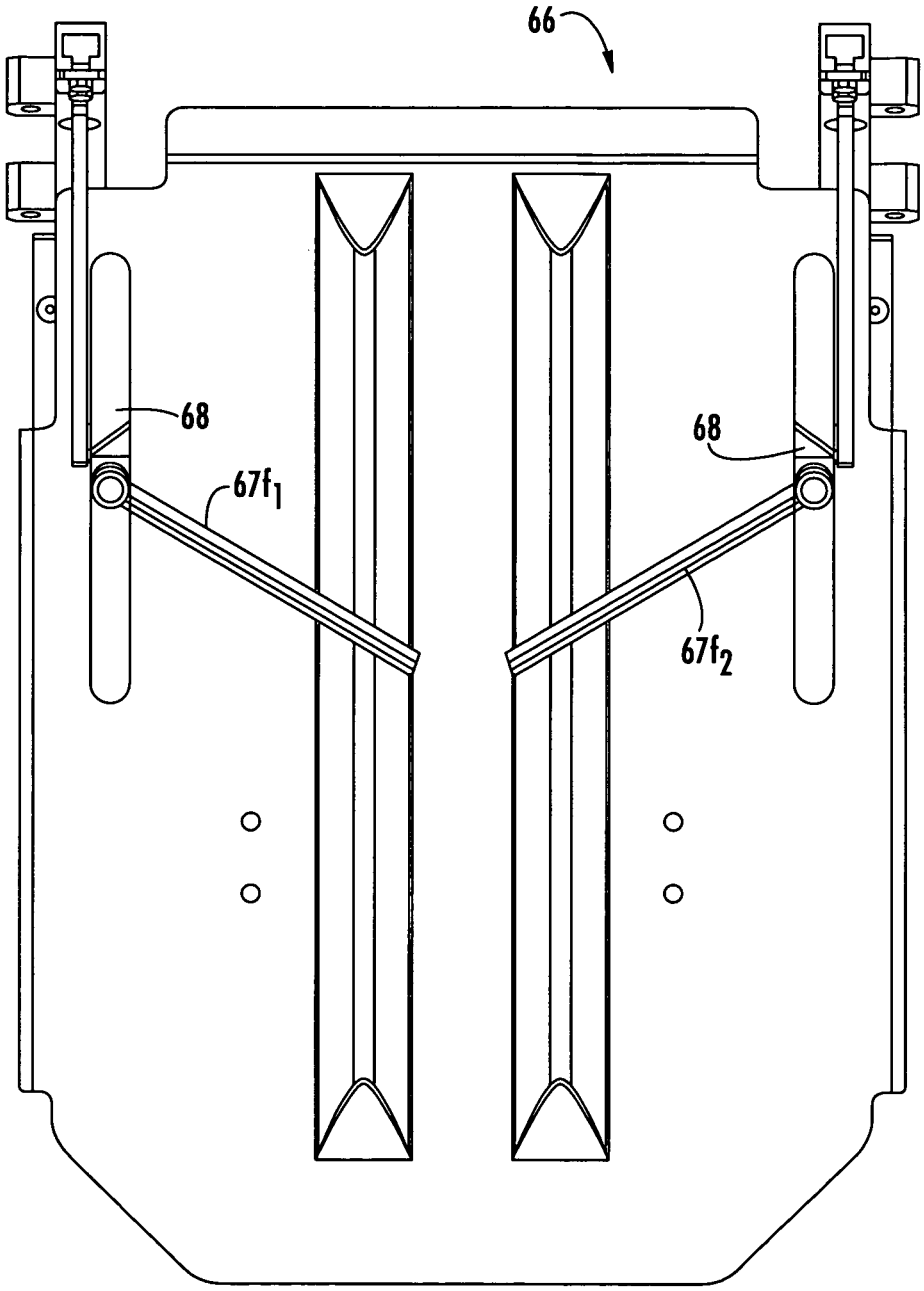
FIG. 11D is a top view of the device shown in FIG. 11A with the flap members in a product catch/restrain configuration according to embodiments of the present invention.
Figure 11E:
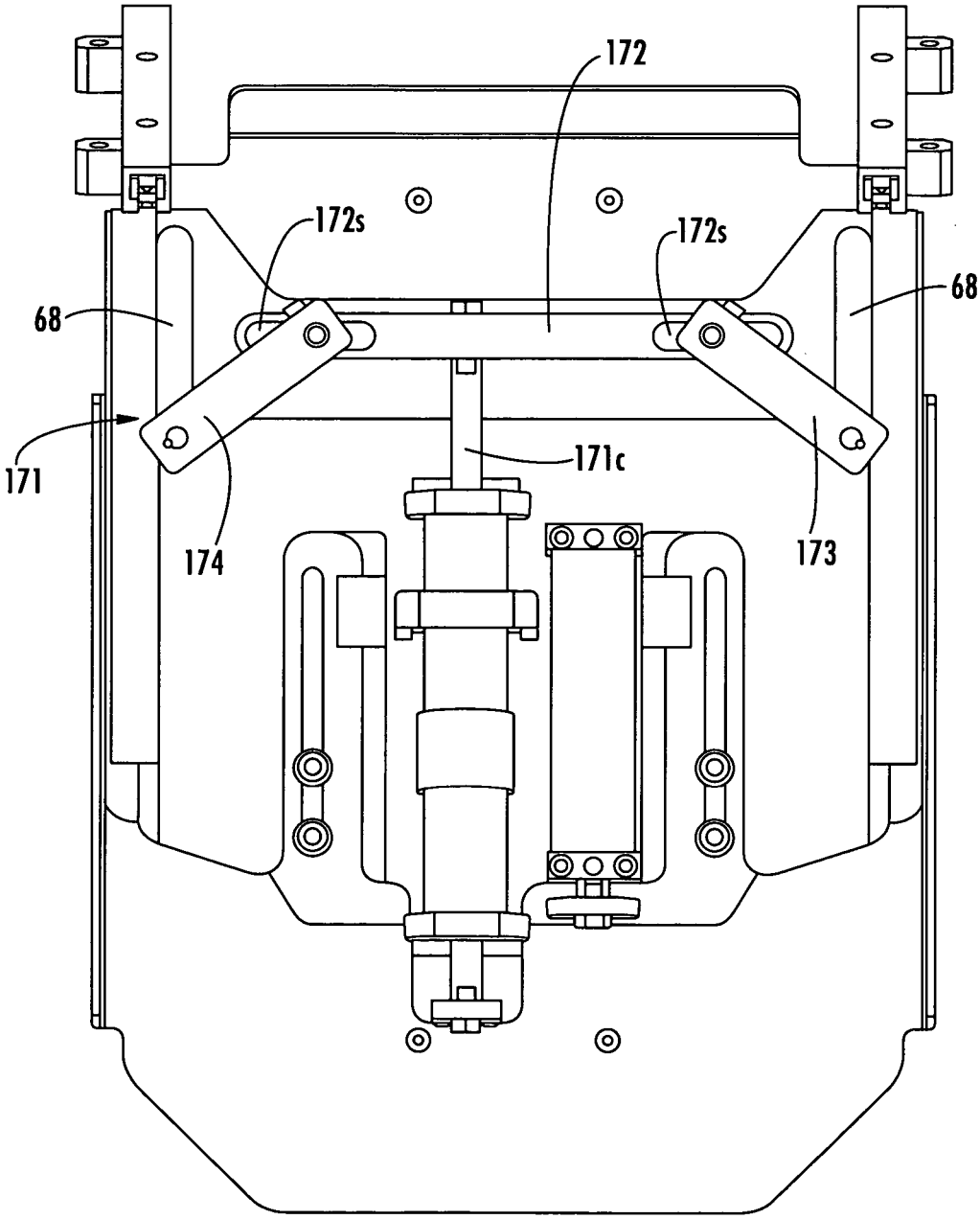
FIG. 11E is a bottom view of the device shown in FIG. 11A with the flap members in the product restrain configuration according to embodiments of the present invention.
Figure 12:
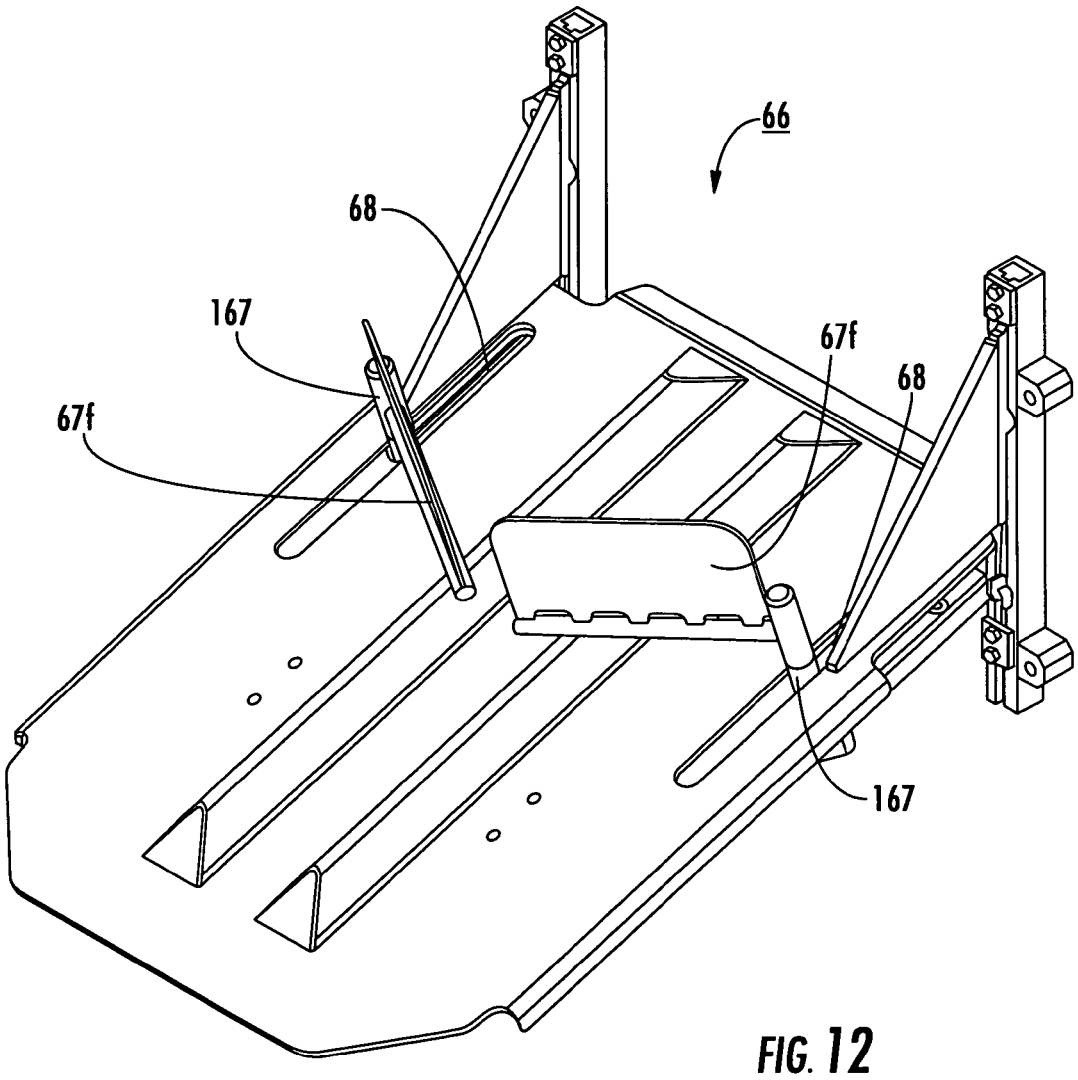
FIG. 12 is a perspective view of the device shown in FIG. 11A with the flap members in the product restrain configuration.
Figure 13:
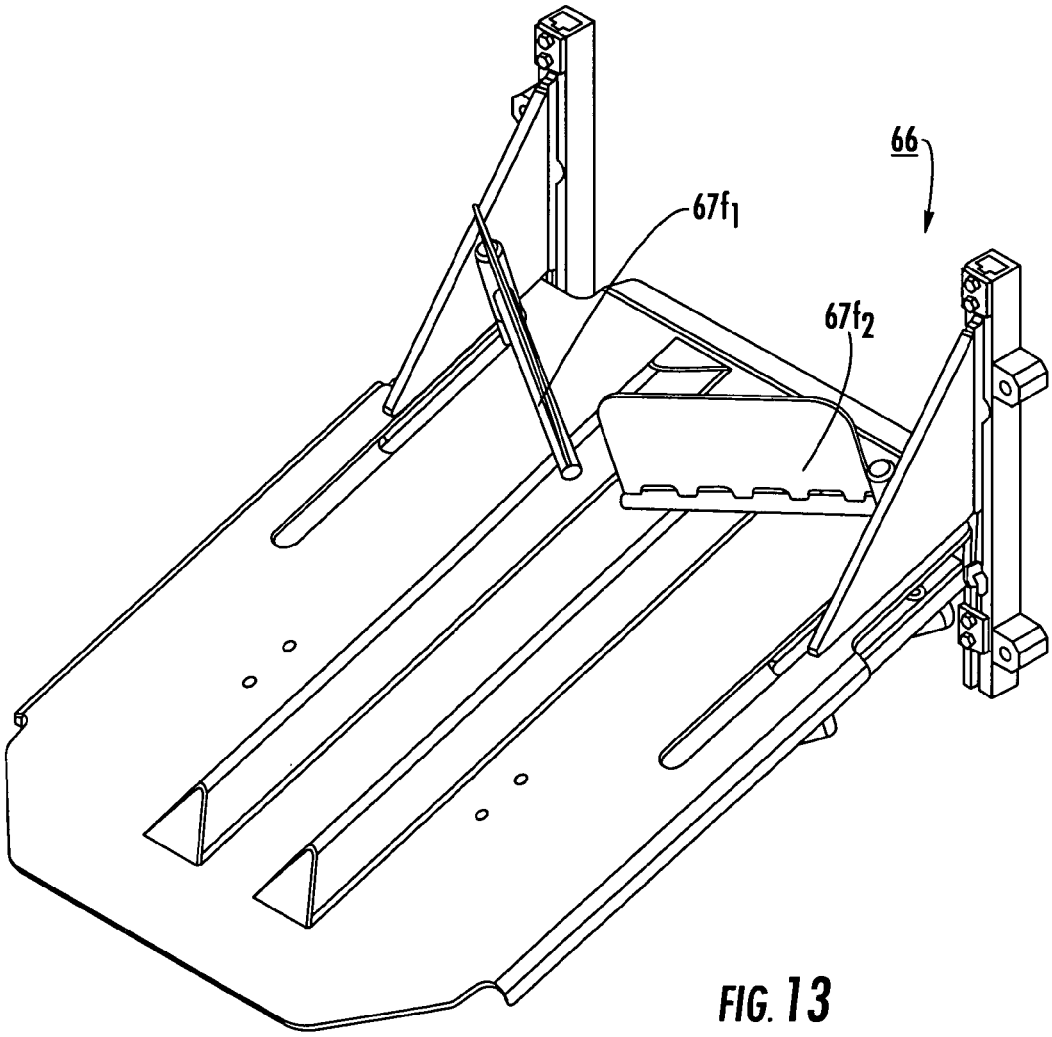
FIG. 13 is a perspective view of the device shown in FIG. 11A with the flap members in a product tighten configuration according to embodiments of the present invention.

FIGS. 11A-11C illustrate the flaps 67$f_1$, 67$f_2$ at a home position. FIG. 11D and 12 illustrate the flaps 67$f_1$, 67$f_2$ translated inward and closer together in a product catch or trap configuration. FIG. 13 shows the flaps 67$f_1$, 67$f_2$ moved upstream in a "tightened" catch position. FIG. 11E shows that a four-bar linkage mechanism 171 that can be used to controllably pivot the flaps 67$f_1$, 67$f_2$ and/or move the flaps 67$f_1$, 67$f_2$ longitudinally in both downstream and upstream directions. The four bar linkage mechanism 171 includes a center link 172 and first and second side links 173, 174 connected to opposing ends of the center link 172. The first and second links 173, 174 are connected to a respective one of the legs 167. The center link 172 includes slots 172*s* and first end portions of the first and second links move in slots 172*s*. In operation, in response to extension of the actuation cylinder 171*c*, the center link advances and pulls the first and second links 172, 173 forward which, in turn, rotates or pivots the flaps together, and can be used to further advance the legs to a tightened more advanced location.

The holding member flaps 67$f_1$, 67$f_2$ can hold the encased product so that the upstream covering material is relatively firmly or tightly held proximate the clipper 40 and/or facilitate centering the covering material during the gathering and clipping operations. The present invention is not limited to this configuration as other holding members may be used, such as, for example, that described in co-pending, co-assigned U.S. Provisional Application Ser. No. 60/508,609, which describes a clamp bar; the contents of which is hereby incorporated by reference as if recited in full herein.

The actuation of the legs and/or flaps can be controlled by the PLC using proximity sensors and operation feedback as will be understood by one of skill in the art. The discharge table 66 may be stationary (with or without rollers as shown). In other embodiments, the product table 66 may include a traveling floor (such as a conveyor) that advances the packaged product to another processing or subsequent workstation (not shown).

In certain embodiments, after the product moves past (and may be stopped by) the product-holding member 67$f_1$, 67$f_2$ (FIG. 11A), the clipper 40 moves into its full-clip position (either from a home or pre-clip position) with its actuation cylinder 140, which also moves the plates 141, 142 as well as the label 159 (held by clamp 259), cutting member guide 166 and cutting member 165, 165' toward the centerline of the travel path. The terms "actuator" or "actuation cylinder" are used generically to indicate any type of automatically moveable actuation member.

The operation and sequence of certain events can be controlled by a programmable logic controller and/or other controller. Certain operations may be selected by an operator input using a HMI to communicate with the controller as is well known to those of skill in the art. In certain embodiments, the apparatus 100 can be configured with control program code that includes OEM selectable pre-programmed run modes and options to direct what signals are monitored, the timing, powering and/or other control parameters or input/output of certain automated features. The run modes may be independent of or dependent on the RH or LH mounting of the clipper and/or handle maker. The program run mode will typically be different where the handle-maker is not employed and for each front-end module type employed as certain operational sequences will be different (different actuators, sensor monitoring, and the like). The program run mode may also vary depending on other build modules employed (or not employed). For example, the type of discharge table and/or the type of product clamp employed and whether a printer module is used to print labels.

Figure 16:
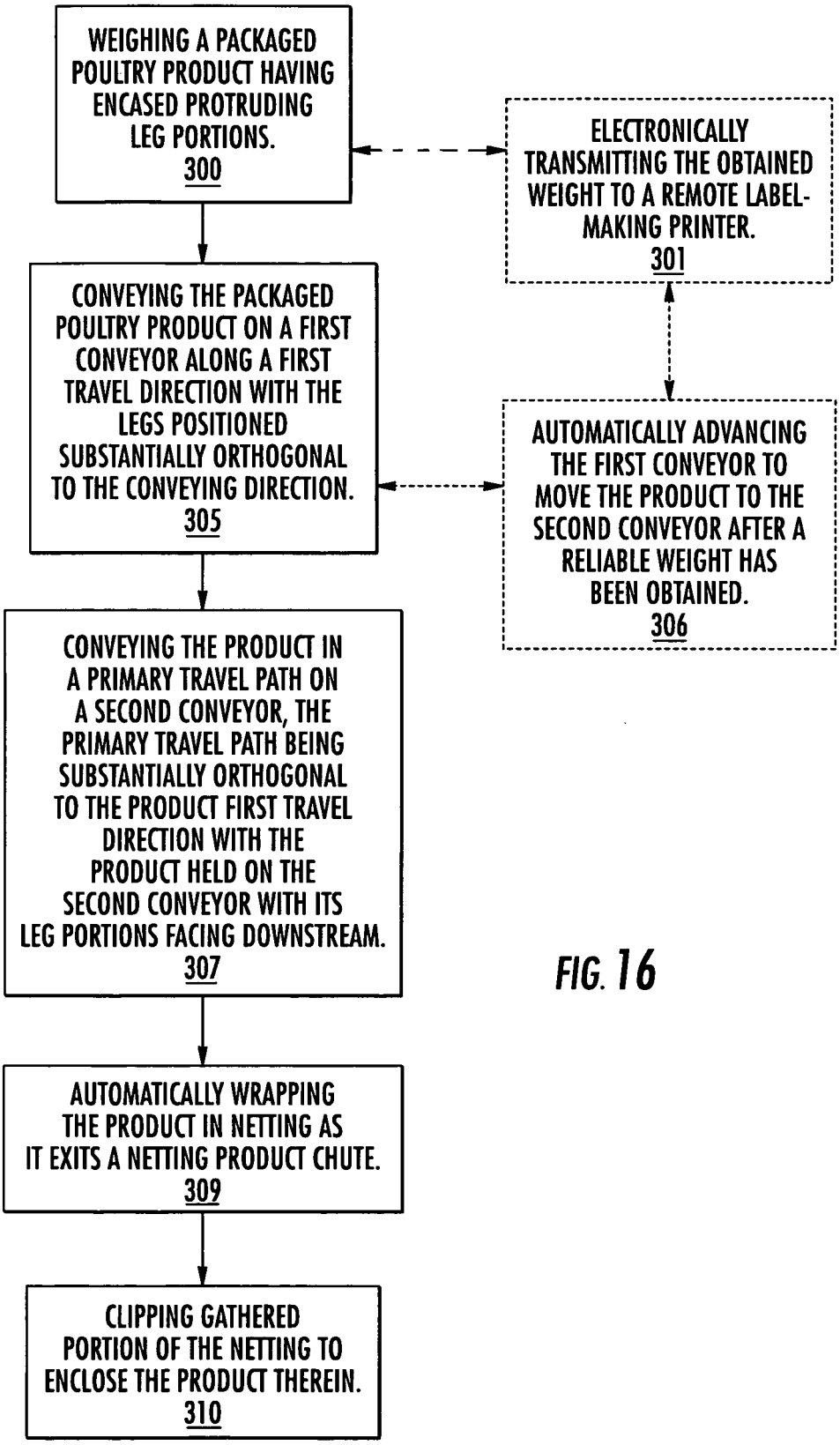
FIG. 16 is a flow chart of operations that can be carried out according to embodiments of the present invention.

FIG. 16 illustrates operations that can be used to carry out certain embodiments of the present invention. A packaged poultry product with encased protruding leg portions can be weighed (block 300). The product can be conveyed on a first conveyor having a first travel direction with the leg portions positioned substantially orthogonal to the conveying direction (block 305). The product is then conveyed on a second conveyor in a primary travel path, the primary travel path being substantially orthogonal to the fist travel direction, with the product held thereon so that the leg portions face generally downstream (block 307). The product is automatically wrapped in netting as it exits a netting product chute (block 309) and a gathered portion of the netting is clipped to enclose the product in the netting (block 310).

In some embodiments, the obtained weight can be electronically transmitted to a remote label-making printer (block 301) and the fist conveyor can be automatically advanced to move the product to the second conveyor in response to data collected by a scale after a reliable weight has been obtained (block 306).

Figure 17:
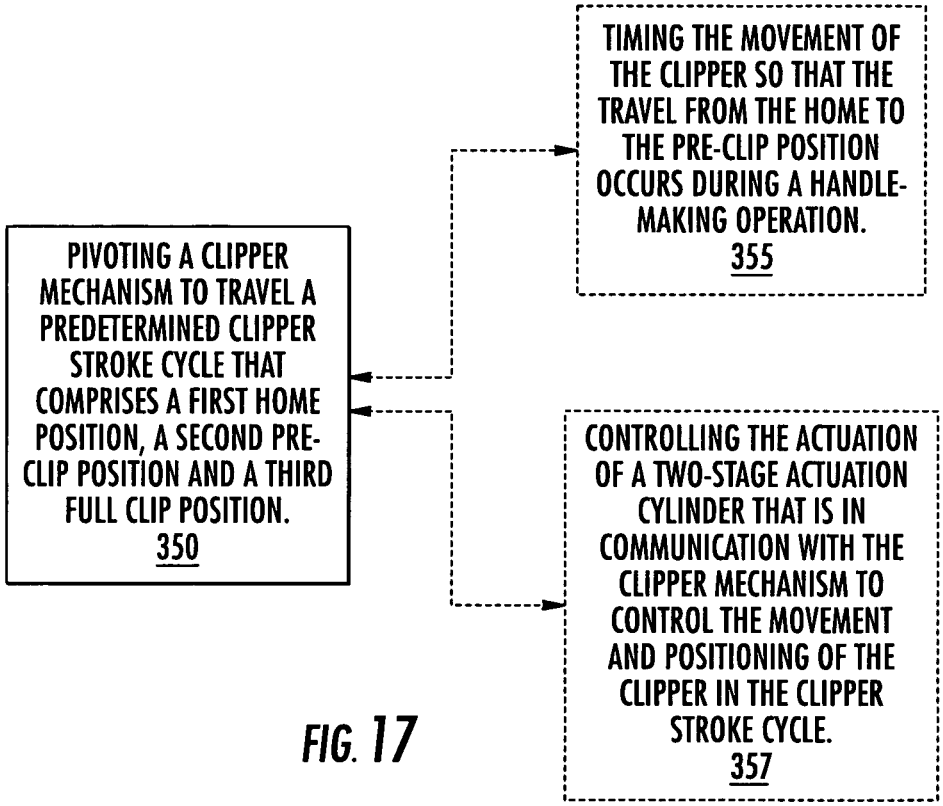
FIG. 17 is a flow chart of operations that can be carried out according to embodiments of the present invention.

FIG. 17 illustrates other operations that can be used to carry out other embodiments of the present invention. As shown, a clipper mechanism can be pivoted to travel a predetermined clipper stroke cycle that includes (but is not necessarily limited to) a first home position, a second pre-clip dwell position and a third full-clip position (block 350). The movement of the clipper can be timed to travel from the home to the pre-clip position during a handle making operation (block 355). The clipper can be moved by controlled actuation of a two-stage actuation cylinder that is in communication with the clipper to control the movement and positioning of the clipper in the clipper stroke cycle (block 357).

Other operations can automatically move the flappers and legs as discussed above.

Figure 18:
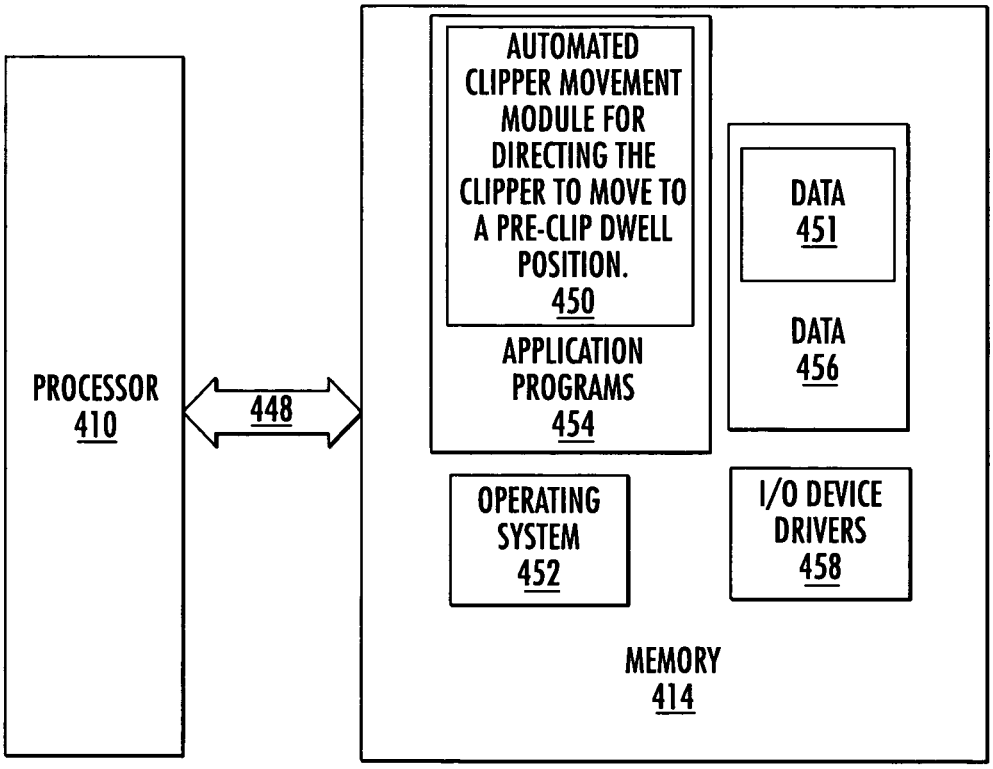
FIGS. 18 and 19 are block diagrams of a data processing system/computer program according to embodiments of the present invention.

FIG. 18 is a block diagram of exemplary embodiments of data processing systems that illustrates systems, methods, and computer program products in accordance with embodiments of the present invention. The data processing systems may be incorporated in a programmable logic controller (such as station 55) and/or be in communication therewith. The processor 410 communicates with the memory 414 via an address/data bus 448. The processor 410 can be any commercially available or custom microprocessor. The memory 414 is representative of the overall hierarchy of memory devices containing the software and data used to implement the functionality of the data processing system. The memory 414 can include, but is not limited to, the following types of devices: cache, ROM, PROM, EPROM, EEPROM, flash memory, SRAM, and DRAM.

Figure 19:
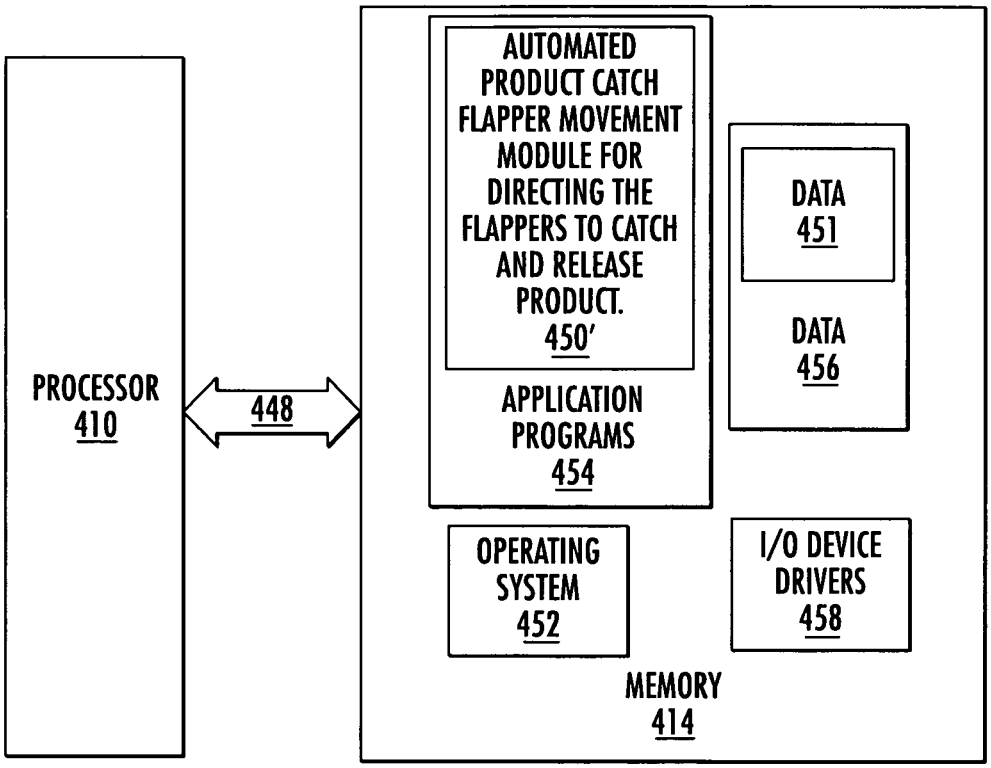

As shown in FIG. 18, the memory 414 may include several categories of software and data used in the data processing system: the operating system 452; the application programs 454; the input/output (I/O) device drivers 458; the Automated Clipper Movement Module that includes a Pre-Clip Dwell Position 450; and the data 456. The Module 450 can be configured to automatically control the movement of the clipper into at least three dwell positions during a clipper stroke cycle. FIG. 19 illustrates a system with an Automated Product Catch Flap Module 450'. The Module 450, 450' can be modified based on whether a handle maker, printer or other predetermined module is included or excluded from the device and/or whether there is a RH or LH clipper operation sequence. The Modules 450, 450' can be implemented on a common controller.

The data 456 may include a look-up chart of different module part lists, configurations, run sequences, target products, covering material type, proximity sensor feedback, safety interlock circuits and the like 451 corresponding to particular or target products for one or more producers or module build types.

As will be appreciated by those of skill in the art, the operating system 452 may be any operating system suitable for use with a data processing system, such as OS/2, AIX, DOS, OS/390 or System390 from International Business Machines Corporation, Armonk, N.Y., Windows CE, Windows NT, Windows95, Windows98 or Windows2000 from Microsoft Corporation, Redmond, Wash., Unix or Linux or FreeBSD, Palm OS from Palm, Inc., Mac OS from Apple Computer, LabView, or proprietary operating systems. The I/O device drivers 458 typically include software routines accessed through the operating system 452 by the application programs 454 to communicate with devices such as I/O data port(s), data storage 456 and certain memory 414 components. The application programs 454 are illustrative of the programs that implement the various features of the data processing system and can include at least one application, which supports operations according to embodiments of the present invention. Finally, the data 456 represents the static and dynamic data used by the application programs 454, the operating system 452, the I/O device drivers 458, and other software programs that may reside in the memory 414.

While the present invention is illustrated, for example, with reference to the Module 450 being an application program in FIGS. 18 and 19, as will be appreciated by those of skill in the art, other configurations may also be utilized while still benefiting from the teachings of the present invention. For example, the Module 450 may also be incorporated into the operating system 452, the I/O device drivers 458 or other such logical division of the data processing system. Thus, the present invention should not be construed as limited to the configuration of FIGS. 18, 19, which is intended to encompass any configuration capable of carrying out the operations described herein. Further, the Module 450, 450' can communicate with other components, such as the HMI or controller (55, 126, FIG. 1A).

The I/O data port can be used to transfer information between the data processing system, the product pusher, and the clipper mechanism or another computer system or a network (e.g., the Internet) or to other devices controlled by the processor. These components may be conventional components such as those used in many conventional data processing systems, which may be configured in accordance with the present invention to operate as described herein.

For example, certain embodiments of the present invention are directed to a computer program product for operating an automated clipped (netting) packaging apparatus so that the clipper mechanism operates from either a left or right hand side.

The computer program product can include: (a) computer readable program code that automatically controllably actuates a clipper mechanism to position a clipping apparatus in a clipping position in response to product pushed by the product pusher out of the product chute and covered in netting. In particular embodiments, the computer program product can also include one or more of: (a) computer readable program code that monitors a proximity sensor positioned to detect when a product is in position to be packaged and automatically controllably actuates the clipper and/or tray cylinder in response thereto; (b) computer readable program code that actuates a cutting tool actuation cylinder to controllably advance the cutting tool and automatically sever netting intermediate two clips thereon; (c) computer readable program code that supplies heat to the cutting tool; (d) computer readable program code that controls the actuation of a braking mechanism to advance the braking mechanism to contact the product chute and selectively apply pressure to netting thereat; and (e) computer readable program code that automatically controllably moves the flaps upstream, downstream and/or pivots the flaps out and/or in, in cooperation with the clipping mechanism.

While the present invention is illustrated, for example, with reference to particular divisions of programs, functions and memories, the present invention should not be construed as limited to such logical divisions. Thus, the present invention should not be construed as limited to the configuration of FIGS. 18, 19 but is intended to encompass any configuration capable of carrying out the operations described herein.

The flowcharts and block diagrams of certain of the figures herein illustrate the architecture, functionality, and operation of possible implementations of the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. An automated or semi-automated clipper mechanism for attaching at least one closure clip to a product held in covering material, comprising:

a pivotable clipper mechanism having a clipper body configured to automatically deliver clips to a clip window and attach at least one clip to gathered covering material, wherein the clipper body is attached to an actuator that moves the clipper body through an automatic stroke cycle that comprises a first retracted home position, a second pre-clip dwell position, and a third clipping position, wherein the clipper body moves forward from the first home position to the second pre-clip dwell position, pauses, then moves forward again from the pre-clip dwell position to the third clipping position.

2. An apparatus for packaging at least one product in a covering material in combination with the clipper mechanism of claim 1, comprising:

an elongate product chute having an outer surface and opposing receiving and discharge end portions with an interior cavity extending therethrough, wherein the clipper mechanism is disposed downstream of the product chute, the clipper mechanism configured to automatically apply at least one clip to a covering material that encloses a product after the product exits the product chute when the clipper body is in the third clipping position.

3. An apparatus according to claim 2, wherein the second pre-clip dwell position is about 75% of the stroke distance between the first and third clipper body positions, the apparatus further comprising a supply of covering material arranged to surround the exterior surface of at least a portion of the product chute and extend in tension in the downstream direction to cover the product as the product exits the discharge end portion of the product chute.

4. An apparatus according to claim 2, wherein the supply of covering material comprises a sleeve of netting.

5. An apparatus according to claim 2, wherein the clipper body is configured to travel from the first home position to the second pre-clip dwell position while a product is exiting the product chute.

6. An apparatus according to claim 5, further comprising an automated handle maker in communication with the covering material and disposed downstream of the product chute proximate the clipper mechanism, wherein the clipper body travels from the first position to the second position while the handle maker is forming a handle to thereby reduce clip cycle time.

7. An apparatus according to claim 6, further comprising a modular mounting frame with a plurality of apertures formed in predetermined locations on both right and left hand sides of the frame, the aperture locations providing alignment and/or mounting apertures for the clipper mechanism when mounted on the right or left hand side of the frame, wherein the handle maker and the clipper mechanism are configured to be selectively mounted to either a right or left hand side of the modular mounting frame and align to a desired operating position irrespective of which side the handle maker and/or clipper mechanism are mounted to the frame.

8. An apparatus according to claim 2, further comprising:

a mounting frame configured to pivotably hold the clipper mechanism; and a printer located downstream of the product chute, the printer having an output port with a flat tag guide held on a printer platform that is mounted to the mounting frame at a location that automatically feeds a printed tag from the printer onto a product during operation, wherein the printer platform is configured to pivot outwardly away from an axial center line of the product chute to thereby allow access to the printer for replacement of a roll of consumable tags and provide increased precision re-alignment of the tag guide with an operative location of a tag feed plate attached to a lower portion of the clipper body upon repositioning into operative position.

9. An apparatus according to claim 8, further comprising a weighing station disposed upstream of the product chute in communication with the printer, wherein the weighing station is configured to serially weigh a plurality of discrete products and electronically transmit product weights in FIFO queue order to the printer, wherein the printer is configured to automatically print respective product labels that provide product weight data from the weighing station and transmit the printed labels onto the covering and/or product, and wherein the printer platform is configured to longitudinally slide in a direction that is generally parallel to the axial center line of the product chute to facilitate access for replacement of consumable items.

10. An apparatus according to claim 9, further comprising a first conveyor disposed upstream of the product chute, the first conveyor configured to travel in a primary product travel direction, and a second conveyor in communication with the weighing station disposed upstream of the first conveyor in cooperating alignment with the first conveyor.

11. An apparatus according to claim 10, wherein the second conveyor travels in a path that is generally orthogonal to the first conveyor.

12. An apparatus according to claim 11, further comprising:

a stationary ramp member extending between the first and second conveyors; and an alignment stop member that is disposed on an outermost portion of the first conveyor upstream of the product chute and is laterally adjustable to extend inwardly at different distances in a direction toward the ramp member, the alignment stop member configured to position product on the first conveyor to be aligned with the product chute.

13. An apparatus according to claim 10, further comprising a plurality of discrete pre-packaged poultry products with intact outwardly extending leg portions that are serially introduced to the weighing station, wherein the second conveyor is configured to serially advance the discrete pre-packaged poultry products toward the first conveyor while the poultry product legs extend across the second conveyor in a direction that is generally aligned with the product primary travel direction.

14. An apparatus according to claim 13, wherein the pre-packaged poultry product comprises turkey.

15. An apparatus according to claim 2, wherein, in operation, the clipper mechanism is configured to advance the clipper body to the third position to apply at least one clip to a target product, then automatically retract away from the product to the first position so as to allow the product to move downstream thereof, and wherein the clipper mechanism defines a clip window for supplying at least one closure clip to the product, the system further comprising first and second longitudinally spaced apart clipper gathering plates mounted to the clipper mechanism so that, in operation, the clipper gathering plates advance and retract in concert with the clipper mechanism, a respective clipper gathering plate disposed on each side of the clip window.

16. An apparatus according to claim 2, further comprising a discharge tray with a floor disposed downstream of the clipper mechanism, the tray having first and second spaced apart upwardly extending flaps with free ends that automatically pivot laterally inward to reside closer together to trap a forwardmost position of a respective product, then automatically pivot away from each other to allow the clipped product to pass.

17. An apparatus according to claim 16, the floor further comprising first and second longitudinally extending laterally spaced apart slots, said first and second pivotable flaps each having a leg that extends downwardly through a respective slot and automatically advances and retracts in the respective slots to thereby position the flaps at longitudinally adjustable distances.

18. An apparatus according to claim 17, wherein an underside of the tray comprises a four bar linkage with a center link and opposing first and second side links attached to the center link, the side links having opposing first and second end portions, wherein one leg is attached to a first end portion of the first side link and the other leg is attached to a first end portion of the second side link, and wherein the four bar linkage is in communication with an actuation cylinder that automatically moves the flaps in concert to trap and release a respective product.

19. An apparatus according to claim 18, wherein the center link comprises a slot on opposing end portions thereof, wherein the second end portion of the first side link travels in one of the center link slots and the second end portion of the second side link travels in the other center link slot.

20. An apparatus according to claim 2, comprising:

a mounting frame having opposing first and second upstanding sides residing on opposing sides of a product flow path; and a printer platform holding a printer thereon, the printer platform pivotably mounted to a mounting frame, wherein the printer platform has an operative position that aligns a printer label guide member with a clipper label feed plate and label feed window and a re-load position wherein the printer platform pivots laterally outward, the printer platform thereby providing increased precision re-alignment with the feed window upon repositioning in the operative position.

21. An apparatus according to claim 20, wherein the printer has a generally planar top member sized and configured to hold the printer thereon, and wherein the top member is configured to slide in a predetermined direction to allow loading of consumable items.

22. A clipper apparatus according to claim 21, wherein the printer platform comprises a generally upright pivot bracket defining a pivot axis that is disposed on an outer side of the platform away from the clipper mechanism that allows the printer to pivot away from the clipper body.

23. An apparatus according to claim 2, wherein the product chute is angled to travel down in the product primary direction of travel and is configured to allow products to slide therethrough.

24. An apparatus according to claim 2, wherein the product chute is substantially horizontal.

25. A clipper mechanism according to claim 1, wherein the clipper mechanism actuator comprises a two-stroke actuation cylinder to pivotably and controllably serially advance the clipper body from the first position, to the second position, and the third position, then pivotably retract the clipper body back to the first position after an active clipping operation.

26. A clipper mechanism according to claim 1, wherein the second pre-clip dwell position is at least about 50% of the stroke distance between the first and third clipper mechanism positions.

27. A mechanism according to claim 1, wherein the clipper mechanism actuator comprises a two-stroke actuation cylinder in communication with upper and lower rods that are attached to the clipper mechanism at spaced apart locations, the lower rod attached to the clipper body and residing below the upper rod, whereby the actuation cylinder causes the rods to extend and retract to controllably position the clipper body in serial order in the first position, the second position, the third position, then pivotably retract the clipper mechanism back to the first position.

28. A mechanism according to claim 1, wherein the clipper mechanism comprises:

a curvilinear clip rail attached to the clipper body having opposing top and bottom end portions and defining a generally downwardly extending clip feed direction;

a clip entry window in communication with the bottom end portion of the clip rail and a clip closure delivery path in communication with a punch mechanism that is adapted to wrap a clip from the clip rail about the target covering encasing a target product;

a clip pusher configured to selectively engage with clips held on the clip rail to force the clips in the feed direction;

a first gathering plate disposed on a first side of the clip entry window, the first clipper gathering plate configured to extend a distance below the clip rail and generally outwardly therefrom toward the target covering material; and a second clipper gathering plate disposed on an opposing side of the clip entry window downstream of the first clipper gathering plate so as to be spaced apart from the first clipper gathering plate, the second clipper gathering plate configured to extend a distance below the clip rail and generally outwardly therefrom toward the target covering material, wherein, in operation, the first and second clipper gathering plates move in concert with the clipper body into the first, second and third positions.

29. A mechanism according to claim 28 further comprising a cutting member attached to a lower portion of the clipper mechanism.

30. A mechanism according to claim 29, wherein the cutting member is configured to travel in concert with the clipper mechanism from the first to the second and third clipping positions.

31. A mechanism according to claim 29, wherein the covering material is netting, and wherein the cutting member is configured to operate with a generally downward stroke to sever the netting.

32. A mechanism according to claim 29, wherein the cutting member is configured to operate with a generally lateral stroke to sever the netting.

33. An apparatus comprising:

a product chute;

a clipper assembly in communication with the product chute;

a mounting frame configured to pivotably hold the clipper assembly; and a printer located downstream of the product chute, the printer held on a printer platform that is mounted to the mounting frame at a location that automatically feeds a printed label from the printer onto a product during operation, wherein the printer platform is configured to pivot outwardly away from an axial center line of the product chute to thereby allow access to the printer for replacement of consumable items and provide increased precision re-alignment with an operative location upon repositioning into position.

34. An apparatus according to claim 33, further comprising a discharge tray with a floor disposed downstream of the clipper mechanism, the tray having first and second spaced apart upwardly extending flaps that automatically pivot laterally inward to reside closer together to trap a forwardmost position of a respective product, then pivot away from each other to allow the clipped product to pass, the floor further comprising first and second longitudinally extending laterally spaced apart slots, said first and second pivotable flaps each having a leg that extends downwardly through a respective slot and automatically advances and retracts in the respective slots to thereby position the flaps at longitudinally adjustable distances, wherein an underside of the tray comprises a four bar linkage with a center link and opposing first and second side links attached to the center link, the side links having opposing first and second end portions, wherein one leg is attached to a first end portion of the first side link and the other leg is attached to a first end portion of the second side link, and wherein the four bar linkage is in communication with an actuation cylinder that automatically moves the flaps in concert to trap and release a respective product.

35. An apparatus according to claim 33, wherein the printer platform has an operative position that aligns a printer label guide member with a clipper label feed plate and label feed window and a re-load position wherein the printer platform pivots laterally outward, the printer platform thereby providing increased precision re-alignment with the label feed window upon repositioning in the operative position.

36. An apparatus according to claim 35, further comprising a slide plate supported by the pivoting printer platform, the slide plate holding the printer and configured to slide back and forth to allow access to replace consumable items associated with the printer.

37. An apparatus according to claim 36, further comprising a stop clamp in communication with the slide plate and/or printer configured to allow the slide plate to slide with respect to the platform and to position the printer and plate in proper operational alignment with the clipper.

38. An apparatus according to claim 37, wherein the stop clamp is configured to travel between two fixed positions to allow the slide plate to slide relative to the printing platform.

39. An apparatus comprising:

a clipper; and a discharge tray with a floor disposed downstream of the clipper, the tray having first and second spaced apart upwardly extending flaps that automatically pivot laterally inward to reside closer together to trap a forwardmost position of a respective product, then pivot away from each other to allow the clipped product to pass.

40. An apparatus according to claim 39, wherein the floor further comprising first and second longitudinally extending laterally spaced apart slots, said first and second pivotable flaps each having a leg that extends downwardly through a respective slot and automatically advances and retracts in the respective slots to thereby position the flaps at longitudinally adjustable distances.

41. An apparatus according to claim 40, wherein an underside of the tray comprises a four bar linkage with a center link and opposing first and second side links attached to the center link, the side links having opposing first and second end portions, wherein one leg is attached to a first end portion of the first side link and the other leg is attached to a first end portion of the second side link, and wherein the four bar linkage is in communication with an actuation cylinder that automatically moves the flaps in concert to trap and release a respective product.

42. An apparatus according to claim 41, wherein the center link comprises a slot on opposing end portions thereof, wherein the second end portion of the first side link travels in one of the center link slots and the second end portion of the second side link travels in the other center link slot.

43. An apparatus according to claim 41, further comprising:

a mounting frame having opposing first and second upstanding sides residing on opposing sides of a product flow path; and a printer platform holding a printer thereon, the printer platform pivotably mounted to a mounting frame, wherein the printer platform has an operative position that aligns a printer label guide member with a clipper label feed plate and label feed window and a re-load position wherein the printer platform pivots laterally outward, the printer platform thereby providing increased precision re-alignment with the feed window upon repositioning in the operative position.

44. An apparatus according to claim 43, wherein the printer has a generally planar top member sized and configured to hold the printer thereon, and wherein the top member is configured to slide in a predetermined direction to allow loading of consumable items.

45. A clipper apparatus according to claim 44, wherein the printer platform comprises a generally upright pivot bracket defining a pivot axis that is disposed on an outer side of the platform away from the clipper mechanism that allows the printer to pivot away from the clipper, the apparatus further comprising an automated handle maker attached to the second side of the mounting frame.

46. An automated or semi-automated clipper mechanism for attaching at least one closure clip to a product held in covering material, comprising:

a pivotable clipper mechanism having a clipper body configured to deliver clips to a clip window and attach at least one clip to gathered covering material, wherein the clipper mechanism has a stroke cycle that comprises a home position, a forward pre-clip dwell position, and a forward clipping position that extends past the second pre-clip position whereby the clipper mechanism serially moves the clipper body forward from the home position to the pre-clip dwell position, pauses, then moves forward again from the pre-clip dwell position to the clipping position, wherein the clipper mechanism comprises a two-stroke actuation cylinder in communication with upper and lower rods that are attached to the clipper mechanism at spaced apart locations, the lower rod attached to the clipper body and residing below the upper rod, whereby the actuation cylinder causes the rods to extend and retract to controllably position the clipper body in serial order in the first position, the second position, the third position, then pivotably retract the clipper mechanism back to the first position.

* * * * *

UNITED STATES PATENT AND TRADEMARK OFFICE

CERTIFICATE OF CORRECTION

PATENT NO. : 8,584,436 B2
APPLICATION NO. : 11/151669
DATED : November 19, 2013
INVENTOR(S) : Griggs et al.

It is certified that error appears in the above-identified patent and that said Letters Patent is hereby corrected as shown below:

On the Title Page:
Item (56), References Cited, U.S. Patent Documents, page 2, left column: Please add the reference below:

-- 6,945,171 09/2005 Marietta et al. --

Signed and Sealed this
Eighteenth Day of March, 2014

Michelle K. Lee

Michelle K. Lee
*Deputy Director of the United States Patent and Trademark Office*